US012117214B2

(12) United States Patent
Hu et al.

(10) Patent No.: US 12,117,214 B2
(45) Date of Patent: Oct. 15, 2024

(54) COMPRESSOR AND REFRIGERATION CYCLE DEVICE

(71) Applicant: GREE GREEN REFRIGERATION TECHNOLOGY CENTER CO., LTD. OF ZHUHAI, Guangdong (CN)

(72) Inventors: Yusheng Hu, Zhuhai (CN); Huijun Wei, Zhuhai (CN); Peng Zou, Zhuhai (CN); Ouxiang Yang, Zhuhai (CN); Jian Wu, Zhuhai (CN)

(73) Assignee: Gree Green Refrigeration Technology Center Co., Ltd. of Zhuhai, Guangdong (CN)

( * ) Notice: Subject to any disclaimer, the term of this patent is extended or adjusted under 35 U.S.C. 154(b) by 684 days.

(21) Appl. No.: 17/254,222

(22) PCT Filed: Dec. 12, 2018

(86) PCT No.: PCT/CN2018/120658
§ 371 (c)(1),
(2) Date: Dec. 18, 2020

(87) PCT Pub. No.: WO2020/006986
PCT Pub. Date: Jan. 9, 2020

(65) Prior Publication Data

US 2021/0140689 A1 May 13, 2021

(30) Foreign Application Priority Data

Jul. 5, 2018 (CN) ..... 201810729765.7

(51) Int. Cl.
*F25B 31/02* (2006.01)
*F01C 1/32* (2006.01)
(Continued)

(52) U.S. Cl.
CPC ..... *F25B 31/026* (2013.01); *F01C 1/32* (2013.01); *F01C 1/356* (2013.01); *F01C 11/006* (2013.01);
(Continued)

(58) Field of Classification Search
CPC ..... F25B 31/026; F25B 13/00; F01C 1/356; F01C 11/006; F01C 13/04; F01C 1/32;
(Continued)

(56) References Cited

U.S. PATENT DOCUMENTS 3,837,764 A * 9/1974 Fritch ..... F04C 25/02 418/11
4,192,152 A * 3/1980 Armstrong ..... F01C 1/0238 418/5
4,807,444 A * 2/1989 Aoki ..... G05D 23/1912 236/49.5
5,127,238 A * 7/1992 Ichikawa ..... B60H 1/00871 415/53.3
(Continued)

FOREIGN PATENT DOCUMENTS

CN 105402124 A 3/2016
CN 105485012 A 4/2016
(Continued)

OTHER PUBLICATIONS

Extended European Search Report for European Application No. 18917904.7 dated May 3, 2021 (8 pages).

*Primary Examiner* — Ljiljana V. Ciric
(74) *Attorney, Agent, or Firm* — J. Miguel Hernandez; James R. Gourley; Carstens, Allen & Gourley, LLP

(57) ABSTRACT

A compressor includes a housing, and a drive assembly, a compression assembly and an expansion assembly which are provided in the housing; the compression assembly is connected to and driven by the drive assembly, and is configured to perform multi-stage compression on a refrigerant under
(Continued)

drive of the drive assembly; the expansion assembly is connected to the drive assembly and is configured to expand the refrigerant compressed by the compression assembly. A refrigeration cycle device includes the above-mentioned compressor.

19 Claims, 41 Drawing Sheets

(51) Int. Cl.

| | |
|---|---|
| ***F01C 1/356*** | (2006.01) |
| ***F01C 11/00*** | (2006.01) |
| ***F01C 13/04*** | (2006.01) |
| ***F04C 18/32*** | (2006.01) |
| ***F04C 18/356*** | (2006.01) |
| ***F04C 23/00*** | (2006.01) |
| ***F04C 27/00*** | (2006.01) |
| ***F04C 29/02*** | (2006.01) |
| ***F25B 13/00*** | (2006.01) |

(52) U.S. Cl.
CPC ..... *F01C 13/04* (2013.01); *F04C 18/322* (2013.01); *F04C 18/356* (2013.01); *F04C 23/005* (2013.01); *F04C 23/008* (2013.01); *F04C 27/00* (2013.01); *F04C 29/02* (2013.01); *F25B 13/00* (2013.01); *F04C 2240/30* (2013.01); *F04C 2240/603* (2013.01)

(58) Field of Classification Search
CPC ..... F04C 27/00; F04C 29/02; F04C 2240/30; F04C 2240/603; F04C 18/322; F04C 18/356; F04C 23/005; F04C 23/008; F04C 23/02
See application file for complete search history.

(56) References Cited

U.S. PATENT DOCUMENTS

| | | | | |
|---|---|---|---|---|
| 5,194,043 | A * | 3/1993 | Takahashi | F24F 11/74 454/316 |
| 5,547,018 | A * | 8/1996 | Takahashi | F24F 1/0011 454/258 |
| 5,678,417 | A * | 10/1997 | Nigo | F24F 3/14 236/44 R |
| 5,924,923 | A * | 7/1999 | Chiguchi | F24F 1/0011 165/122 |
| 6,338,676 | B1 * | 1/2002 | Kondou | F24F 1/0011 454/319 |
| 7,856,834 | B2 * | 12/2010 | Haley | F04D 29/441 62/115 |
| 9,982,902 | B2 * | 5/2018 | Hayashi | F24F 1/0011 |
| 10,024,563 | B2 * | 7/2018 | Nakamoto | F24F 11/79 |
| 10,180,285 | B2 * | 1/2019 | Josserand | F28D 7/0058 |
| 10,895,388 | B2 * | 1/2021 | Shirota | F24F 1/0057 |
| 11,994,127 | B2 * | 5/2024 | Okamoto | F04C 23/001 |
| 2005/0069423 | A1 * | 3/2005 | Ebara | F04C 23/001 417/313 |
| 2021/0140689 | A1 * | 5/2021 | Hu | F25B 13/00 |
| 2023/0304706 | A1 * | 9/2023 | Moon | F04D 29/4206 62/498 |

FOREIGN PATENT DOCUMENTS

| | | | |
|---|---|---|---|
| CN | 107131564 | A | 9/2017 |
| CN | 107166528 | A | 9/2017 |
| CN | 108050066 | A | 5/2018 |
| CN | 108167185 | A | 6/2018 |
| CN | 108799118 | A | 11/2018 |
| EP | 2455679 | A1 | 5/2012 |
| EP | 2813777 | A1 | 12/2014 |
| EP | 2821717 | A1 | 11/2017 |
| JP | 2007-239574 | A | 9/2007 |

* cited by examiner

COMPRESSOR AND REFRIGERATION CYCLE DEVICE

CROSS REFERENCE TO RELATED APPLICATION

The present application claims priority to Chinese Patent Application No. 201810729765.7, entitled "Compressor and Refrigeration Cycle Device", filed on Jul. 5, 2018, the content of which is expressly incorporated herein by reference in its entirety. This application is a national phase under 35 U.S.C. § 120 of international patent application PCT/CN2018/120658, entitled "Compressor and Refrigeration Cycle Apparatus" filed on Dec. 12, 2018, published as WO 2020/006986 A1 on Jan. 9, 2020. Every patent application and publication listed in this paragraph is hereby incorporated by reference in its entirety.

TECHNICAL FIELD

The present disclosure relates to the field of compressor refrigeration technology, and particularly relates to a compressor and a refrigeration cycle device.

BACKGROUND

At present, in the refrigeration industry, the commonly used refrigerants are mainly CFC and HCFC. However, the CFC and HCFC refrigerants have a destructive effect on the ozone layer and produce a greenhouse effect. In recent years, industry insiders have carried out research work to replace the refrigerants CFC and HCFC. Since the carbon dioxide has advantages of ODP=0, GWP=1, no destruction to the ozone layer, no pollution to the environment, abundant sources, low price, and excellent heat transfer performance, it has attracted attention as a possible substitute for refrigerants. Compared to the CFC and HCFC, the carbon dioxide has a low critical temperature (31.1° C.) and a high critical pressure (7.37 MPa). When the carbon dioxide is used as refrigerant, the main form is a transcritical refrigeration cycle, and a performance coefficient thereof is more than 20% lower than that of conventional refrigerant cycles. A main reason is that an operating pressure and a pressure difference of the carbon dioxide are both very high, accordingly the throttling loss is greater. In order to improve the cycle refrigeration performance, one of the technical paths is to improve the performance of the compressor.

The related art mainly discloses the following two compressors using the carbon dioxide as refrigerant. The first type of compressor is a rolling rotor type intermediate back pressure carbon dioxide compressor, which adopts a two-stage principle. Specifically, the compressor has two cylinders, one of which is a first-stage compression cylinder, and the other is a second-stage compression cylinder; the low-pressure refrigerant first flows into the first-stage compression cylinder at a bottom portion of the compressor, then the low-pressure refrigerant first is compressed to have an intermediate pressure under an action of the compression structure and is directly discharged into a housing of the compressor, and then flows into the second-stage cylinder at an upper portion of the compressor after being cooled in an intercooler. In the second-stage cylinder, the refrigerant is compressed to have a high pressure and then discharged. The second type of compressor is a vortex rotor compressor with an expansion mechanism. The expansion mechanism is in the form of a vortex, and the compression mechanism is in the form of a rolling rotor. The vortex and the rotor are designed to be coaxial to expand the refrigerant flowing into the expansion mechanism, and together with the motor drive the main shaft to rotate to drive the compression mechanism to compress, so that power is recovered during the refrigeration cycle and used in the compression process, thereby improving the performance of the refrigeration cycle.

SUMMARY

In view of this, the present disclosure provides a compressor and a refrigeration cycle device which can not only compress the refrigerant with multi-stage compression, but can also expand the compressed refrigerant and recover the expansion work. A main purpose of the present disclosure is to reduce a pressure difference of each stage and reduce refrigerant leakage and compressor power consumption to improve the performance coefficient of the compressor and the refrigeration cycle device.

In order to achieve the above objectives, the present disclosure mainly provides the following technical solution.

In one aspect, some embodiments of the present disclosure provides a compressor, including:

- a housing;
- a drive assembly, provided in the housing;
- a compression assembly, provided in the housing, and connected to and driven by the drive assembly, the compression assembly being configured to perform a multi-stage compression on a refrigerant under drive of the drive assembly;
- an expansion assembly, provided in the housing and connected to the drive assembly, the expansion assembly being configured to expand the refrigerant compressed by the compression assembly.

The purpose of the present disclosure and the technical problems to be solve can be further achieved by the following technical means.

In some embodiments, the compressor further includes a first cooler;

- the refrigerant compressed by the compression assembly is cooled by the first cooler before being expanded by the expansion assembly.

In some embodiments, the compression assembly includes:

- a first-stage compression structure, configured to perform first-stage compression on a refrigerant discharged from an evaporator;
- a second-stage compression structure, configured to perform second-stage compression on a first-stage refrigerant, the first-stage refrigerant including the refrigerant compressed through the first-stage compression of the first-stage compression structure.

In some embodiments, the compressor includes a gas supplement passage configured to supplement a gaseous refrigerant into the compressor;

- the first-stage refrigerant further includes the refrigerant supplemented by the gas supplement passage.

In some embodiments, the compressor further includes a second cooler;

- the first-stage refrigerant is cooled by the second cooler before being compressed through the second-stage compression of the second-stage compression structure.

In some embodiments, the first-stage compression structure includes:

- a first-stage cylinder, provided with a first gas inlet and a first gas outlet, the first gas inlet being configured to communicate with an outlet of the evaporator;

a first-stage roller, arranged in the first-stage cylinder and configured to cooperate with the first-stage cylinder to perform the first-stage compression on refrigerant under drive by the drive assembly;

a first-stage cavity, being in communication with the first gas outlet to discharge the refrigerant compressed through the first-stage compression into the first-stage cavity.

In some embodiments, the second-stage compression structure includes:

a second-stage cylinder, provided with a second gas inlet and a second gas outlet, the second gas inlet inhaling the first-stage refrigerant into the second-stage cylinder;

a second-stage roller, arranged in the second-stage cylinder and configured to cooperate with the second-stage cylinder to perform the second-stage compression on the first-stage refrigerant under drive by the drive assembly;

a second-stage cavity, being in communication with the second gas outlet to discharge the refrigerant compressed through the second-stage compression into the second-stage cavity.

In some embodiments, a ratio of a volume of the first-stage cylinder to a volume of the second-stage cylinder is in a range of 0.5 to 1.35.

In some embodiments, an exhaust pipeline is provided on the housing, and the exhaust pipeline is in communication with an inner cavity of the housing;

when the compressor includes a second cooler, the first-stage cavity is in communication with the inner cavity of the housing, and the exhaust pipeline is configured to communicate with an inlet of the second cooler, an outlet of the second cooler is in communication with the second gas inlet on the second-stage cylinder; or the first-stage cavity is in communication with the second gas inlet on the second-stage cylinder, the second-stage cavity is in communication with the inner cavity of the housing, and the exhaust pipeline is configured to communicate with an inlet of the first cooler.

In some embodiments, the expansion assembly includes:

a first expansion cylinder, provided with a third gas inlet and a third gas outlet;

a first roller, arranged in the first expansion cylinder;

the third gas inlet is configured to draw the refrigerant compressed through the multi-stage compression of the compression assembly into the first expansion cylinder; the first roller is configured to expand the refrigerant drawn into the first expansion cylinder under drive of the drive assembly; the expanded refrigerant is discharged from the third gas outlet;

when the compressor is connected to the first cooler, the third gas inlet is connected to an outlet of the first cooler.

In some embodiments, the expansion assembly further includes a first cavity, the first cavity is in communication with the third gas outlet, and the first cavity is provided with a fourth gas outlet to discharge the refrigerant expanded by the expansion assembly to a heat exchange component connected to the compressor.

In some embodiments, a ratio of an intake volume to an expansion volume of the first expansion cylinder is in a range of 2.0 to 5.55.

In some embodiments, the expansion assembly further includes:

a second expansion cylinder, provided with a fourth gas inlet and a fifth gas outlet, the fourth gas inlet being in communication with the third gas outlet;

a second roller, arranged in the second expansion cylinder, and connected to and driven by the drive assembly.

In some embodiments, the drive assembly includes a crankshaft and a drive structure configured to drive the crankshaft to operate; the drive structure includes a motor stator and a motor rotor;

the compression assembly and the expansion assembly sleeve the crankshaft;

when an exhaust pipeline is provided on the housing, the refrigerant in a cavity of the housing passes through the drive structure before being drawn into the exhaust pipeline to cool the drive structure.

In some embodiments, an oil baffle plate is mounted on the crankshaft at a position higher than the drive structure and is configured to separate refrigerant oil from the refrigerant;

the expansion assembly is located above the drive structure; or the expansion assembly is located below the drive structure.

In some embodiments, the compressor further includes a variable-volume assembly, and the variable-volume assembly is configured to control loading or unloading of at least one of the compression assembly and the expansion assembly.

In some embodiments, the compression assembly includes:

a first-stage compression structure, configured to perform first-stage compression on a refrigerant discharged from an evaporator;

a second-stage compression structure, configured to perform second-stage compression on a first-stage refrigerant, the first-stage refrigerant including the refrigerant compressed through the first-stage compression of the first-stage compression structure.

In some embodiments, the variable-volume assembly is configured to control loading or unloading of the first-stage compression structure; and/or the variable-volume assembly is configured to control loading or unloading of the second-stage compression structure.

In some embodiments, the first-stage compression structure includes:

a first-stage cylinder, provided with a first gas inlet and a first gas outlet, the first gas inlet being configured to communicate with an outlet of the evaporator;

a first-stage roller, arranged in the first-stage cylinder and configured to cooperate with the first-stage cylinder to perform first-stage compression on the refrigerant under drive of the drive assembly;

a first-stage cavity, being in communication with the first gas outlet to discharge the refrigerant compressed though the first-stage compression into the first-stage cavity;

a first sliding groove is provided in the first-stage cylinder, a first sliding vane is slidably provided in the first sliding groove, the variable-volume assembly controls loading and unloading of the first-stage compression structure by controlling a working state of the first sliding vane;

and/or, the second-stage compression structure includes:

a second-stage cylinder, provided with a second gas inlet and a second gas outlet, the second gas inlet inhaling the first-stage refrigerant into the second-stage cylinder;

a second-stage roller, arranged in the second-stage cylinder and configured to cooperate with the second-stage cylinder to perform the second-stage compression on the first-stage refrigerant under drive of the drive assembly;

a second-stage cavity, being in communication with the second gas outlet to discharge the refrigerant compressed through the second-stage compression into the second-stage cavity;

a second sliding groove is provided in the second-stage cylinder, a second sliding vane is slidably provided in the second sliding groove, the variable-volume assembly controls loading and unloading of the second-stage compression structure by controlling a working state of the second sliding vane.

In some embodiments, the variable-volume assembly includes a first pin, a first mounting plate is provided on a side of the first-stage cylinder, a first guide groove is provided on a first mounting plate, the first pin is slidably provided in the first guide groove, a first pin hole is provided on a side of the first sliding vane facing the first mounting plate, the first pin is capable of being switched between a first position at which the first pin is stuck into the first pin hole and a second position at which the first pin is out of the first pin hole;

and/or, the variable-volume assembly further includes a second pin, a second mounting plate is provided on a side of the second-stage cylinder, a second guide groove is provided on the second mounting plate, the second pin is slidably provided in the second guide groove, a second pin hole is provided on a side of the second sliding vane facing the second mounting plate, and the second pin is capable of being switched between a first position at which the second pin is stuck into the second pin hole and a second position at which the second pin is out of the second pin hole.

In some embodiments, the first pin hole is in communication with a side of the first sliding groove away from the first-stage roller, the first sliding groove is supplied with a refrigerant with a first pressure, a side of the first guide groove away from the first pin hole is supplied with a refrigerant with a second pressure, the first pressure and the second pressure are adjustable to enable the first pin to be switched between the first position and the second position;

and/or, the second pin hole is in communication with a side of the second sliding groove away from the second-stage roller, the second sliding groove is supplied with the refrigerant with the first pressure, a side of the second guide groove away from the second pin hole is supplied with the refrigerant with the second pressure, the first pressure and the second pressure are adjustable to enable the second pin to be switched between the first position and the second position.

In some embodiments, the first mounting plate is located on a lower side of the first-stage cylinder, the first pressure is an intake pressure, the second pressure is capable of being switched among a second-stage exhaust pressure, the intake pressure and an intermediate pressure; or, the first pressure is the intermediate pressure, and the second pressure is capable of being switched among the second-stage exhaust pressure, the intermediate pressure and the intake pressure.

In some embodiments, the first mounting plate is located on an upper side of the first-stage cylinder, the first pressure is a second-stage exhaust pressure, the second pressure is capable of being switched among the second-stage exhaust pressure, an intake pressure and an intermediate pressure; or, the first pressure is the intermediate pressure, the second pressure is capable of being switched among the second-stage exhaust pressure, the intermediate pressure and the intake pressure.

In some embodiments, the variable-volume assembly further includes an elastic member, the elastic member is provided at one end of the first guide groove away from the first pin hole, the first pin is in contact with the elastic member, the elastic member provides the first pin with an elastic force moving the first pin towards the first pin hole;

and/or, the variable-volume assembly further comprises an elastic member, the elastic member is provided at an end of the second guide groove away from the second pin hole, the second pin is in contact with the elastic member, and the elastic member provides the second pin with an elastic force moving the second pin towards the second pin hole.

In some embodiments, the first pressure is a second-stage exhaust pressure, the second pressure is capable of being switched among the second-stage exhaust pressure, an intake pressure and an intermediate pressure; or, the first pressure is an intermediate pressure, the second pressure is capable of being switched among a second-stage exhaust pressure, the intermediate pressure and an intake pressure.

In some embodiments, the expansion assembly, the second-stage compression structure and the first-stage compression structure are sequentially provided in an axial direction away from the drive assembly; or the second-stage compression structure, the expansion assembly and the first-stage compression structure are sequentially provided in the axial direction away from the drive assembly, and a lower flange is provided on a side of the first-stage compression structure away from the drive assembly, and the lower flange is the first mounting plate;

or, the expansion assembly, the first-stage compression structure and the second-stage compression structure are sequentially provided in the axial direction away from the drive assembly; or the first-stage compression structure, the expansion assembly and the second-stage compression structure are sequentially provided in the axial direction away from the drive assembly, and a lower flange is provided on a side of the second-stage compression structure away from the drive assembly, and the lower flange is the second mounting plate.

In some embodiments, a lower cover plate is provided on a side of the lower flange away from the first-stage compression structure, and the lower cover plate is provided with a mounting groove corresponding to the first pin hole;

or, a lower cover plate is provided on a side of the lower flange away from the second-stage compression structure, and the lower cover plate is provided with a mounting groove corresponding to the second pin hole.

In some embodiments, the expansion assembly, the first-stage compression structure and the second-stage compression structure are sequentially provided in an axial direction away from the drive assembly; or the second-stage compression structure, the first-stage compression structure and the expansion assembly are sequentially provided in the axial direction away from the drive assembly, and a lower partition plate is provided on a side of the first-stage compression structure away from the drive assembly, and the lower partition plate is the first mounting plate;

or, the expansion assembly, the second-stage compression structure and the first-stage compression structure are sequentially provided in the axial direction away from the drive assembly; or, the first-stage compression structure, the second-stage compression structure and the expansion assembly are sequentially provided in the axial direction away from the drive assembly, a lower partition plate is provided on a side of the second-stage compression structure away from the drive assembly, and the lower partition plate is the second mounting plate.

In some embodiments, the first-stage compression structure, the expansion assembly and the second-stage compression structure are sequentially provided in an axial direction away from the drive assembly; or the first-stage compression structure, the second-stage compression structure and the expansion assembly are sequentially provided in the axial direction away from the drive assembly, an upper partition plate is provided on a side of the first-stage compression structure away from the drive assembly, and the upper partition plate is the first mounting plate;

or, the second-stage compression structure, the expansion assembly, and the first-stage compression structure are sequentially provided in the axial direction away from the drive assembly; or, the second-stage compression structure, the first-stage compression structure and the expansion assembly are sequentially provided in the axial direction away from the drive assembly, an upper partition plate is provided on a side of the second-stage compression structure away from the drive assembly, and the upper partition plate is the second mounting plate.

In some embodiments, a middle partition plate is provided on a side of the upper partition plate away from the first-stage compression structure, and the middle partition plate is provided with a mounting groove corresponding to the first pin hole;

or, a middle partition plate is provided on a side of the upper partition plate away from the second-stage compression structure, and the middle partition plate is provided with a mounting groove corresponding to the second pin hole.

In some embodiments, the compressor further includes a gas supplement inlet, the variable-volume assembly further includes a first pipeline and a second pipeline, a first end of the first pipeline is in communication with the gas outlet of the second-stage compression structure, a second end of the first pipeline is in communication with a side of the first sliding groove away from the first-stage roller, a first end of the second pipeline is selectively in communication with at least one of the first gas inlet and the gas supplement inlet as well as the gas outlet of the second-stage compression structure, a second end of the second pipeline is in communication with a side of the first guide groove away from the first pin hole;

or, the first end of the first pipeline is in communication with the gas supplement inlet, the second end of the first pipeline is in communication with a side of the first sliding groove away from the first-stage roller, the first end of the second pipeline is selectively in communication with at least one of the gas supplement inlet and the gas outlet of the second-stage compression structure as well as the first gas inlet, the second end of the second pipeline is in communication with a side of the first guide groove away from the first pin hole;

and/or, the compressor further comprises a gas supplement inlet, the variable-volume assembly further comprises a third pipeline and a fourth pipeline, a first end of the third pipeline is in communication with the second outlet, a second end of the third pipeline is in communication with a side of the second sliding groove away from the second-stage roller, a first end of the fourth pipeline is selectively in communication with at least one of the first gas inlet and the gas supplement inlet as well as the second gas outlet, a second end of the fourth pipeline is in communication with a side of the second guide groove away from the second pin hole;

or, the first end of the third pipeline is in communication with the gas supplement inlet, the second end of the third pipeline is in communication with the side of the second sliding groove away from the second-stage roller, the first end of the second pipeline is selectively in communication with at least one of the gas supplement inlet and the second gas outlet as well as the first gas inlet, the second end of the fourth pipeline is in communication with the side of the second guide groove away from the second pin hole.

In some embodiments, the variable-volume assembly is configured to control loading or unloading of the expansion assembly.

In some embodiments, the expansion assembly includes:

a first expansion cylinder, provided with a third gas inlet and a third gas outlet;

a first roller, arranged in the first expansion cylinder;

the third gas inlet is configured to draw the refrigerant compressed through the multi-stage compression of the compression assembly into the first expansion cylinder; the first roller is configured to expand the refrigerant drawn into the first expansion cylinder under drive of the drive assembly; the expanded refrigerant is discharged from the third gas outlet;

when the compressor is connected to the first cooler, the third gas inlet is connected to the outlet of the first cooler, and the variable-volume assembly controls loading or unloading of the expansion assembly by controlling a working state of the first roller.

In some embodiments, the variable-volume assembly further includes a third pin, a third mounting plate is provided on a side of the first roller, the third mounting plate is provided with a third guide groove, the third pin is slidably provided in the third guide groove, a third pin hole is provided on a side of the first roller facing the third mounting plate, the third pin is capable of being switched between a first position at which the third pin is stuck into the third pin hole and a second position at which the third pin is out of the third pin hole.

In some embodiments, the third pin hole is supplied with a refrigerant with a first pressure, a side of the third guide groove away from the third pin hole is supplied with a refrigerant with a second pressure, the first pressure and the second pressure are adjustable to enable the third pin to be switched between the first position and the second position.

In some embodiments, the variable-volume assembly further comprises an elastic member, the elastic member is provided at one end of the third guide groove away from the third pin hole, the third pin is in contact with the elastic member, and the elastic member provides the third pin with an elastic force moving the third pin towards the third pin hole.

In some embodiments, the first pressure is a second-stage exhaust pressure, the second pressure is capable of being switched among the second-stage exhaust pressure, an intake pressure and an intermediate pressure; or, the first pressure is an intermediate pressure, the second pressure is capable of being switched among a second-stage exhaust pressure, the intermediate pressure and an intake pressure.

In some embodiments, the second-stage compression structure, the first-stage compression structure and the expansion assembly are sequentially provided in an axial direction away from the drive assembly; or the first-stage compression structure, the second-stage compression structure and the expansion assembly are sequentially provided in the axial direction away from the drive assembly, a lower flange is provided on a side of the expansion assembly away from the drive assembly, and the lower flange is the third mounting plate.

In some embodiments, a lower cover plate is provided on a side of the lower flange away from the expansion assembly, and the lower cover plate is provided with a mounting groove corresponding to the third pin hole.

In some embodiments, the second-stage compression structure, the expansion assembly, and the first-stage compression structure are sequentially provided in an axial direction away from the drive assembly; or the first-stage compression structure, the expansion assembly and the second-stage compression structure are sequentially provided in the axial direction away from the drive assembly, a lower partition plate is provided on a side of the expansion assembly away from the drive assembly, and the lower partition plate is the third mounting plate.

In some embodiments, the expansion assembly, the second-stage compression structure, and the first-stage compression structure are sequentially provided in an axial direction away from the drive assembly; or the expansion assembly, the first-stage compression structure and the second-stage compression structure are sequentially provided in the axial direction away from the drive assembly, an upper partition plate is provided on a side of the expansion assembly away from the drive assembly, and the upper partition plate is the third mounting plate.

In some embodiments, a middle partition plate is provided on a side of the upper partition plate away from the expansion assembly, and the middle partition plate is provided with a mounting groove corresponding to the third pin hole.

In some embodiments, the compressor further includes a gas return inlet and a gas supplement inlet, wherein the variable-volume assembly further comprises a fifth pipeline and a sixth pipeline, a first end of the fifth pipeline is in communication with the gas outlet of the second-stage compression structure, a second end of the fifth pipeline is in communication with the third pin hole, a first end of the sixth pipeline is selectively in communication with at least one of the gas return inlet and the gas supplement inlet as well as the gas outlet of the second-stage compression structure, a second end of the sixth pipeline is in communication with a side of the third guide groove away from the third pin hole;

or, the first end of the fifth pipeline is in communication with the gas supplement inlet, the second end of the fifth pipeline is in communication with the third pin hole, the first end of the sixth pipeline is selectively in communication with at least one of the gas supplement inlet and the gas outlet of the second-stage compression structure as well as the gas return inlet, and the second end of the sixth pipeline is in communication with the side of the third guide groove away from the third pin hole.

In some embodiments, the variable-volume assembly is configured to supply a refrigerant with a first pressure to a side of the first sliding groove away from the first-stage roller, and the first pressure is an intake pressure or a second-stage exhaust pressure.

In some embodiments, the compressor further includes a gas supplement inlet, wherein the variable-volume assembly further comprises a first pipeline, a first end of the first pipeline is selectively in communication with at least one of the gas supplement inlet and the gas outlet of the second-stage compression structure as well as the first gas inlet, a second end of the first pipeline is in communication with the side of the first sliding groove away from the first-stage roller.

In some embodiments, a one-way valve is provided on a pipeline between the variable-volume assembly and the first gas inlet.

In some embodiments, the compressor is a horizontal compressor.

In some embodiments, the compressor further includes a crankshaft, the crankshaft comprises a center oil hole, one end of the crankshaft away from the drive assembly is provided with an oil suction assembly, and the oil suction assembly is configured to transport oil in the housing to the center oil hole.

In some embodiments, the oil suction assembly includes a sealing housing and an oil suction pipe in communication with a cavity of the sealing housing, and the sealing housing is provided at and seals a first end of the crankshaft, and the oil suction pipe extends downward.

In some embodiments, the compressor further includes an upper flange, a side of the upper flange facing the drive assembly is provided with a pressure separation plate, and a refrigerant passage is provided on the pressure separation plate.

In some embodiments, a second end of the crankshaft is provided with a fan, and the fan is configured to generate a negative pressure on the center oil hole.

In another aspect, some embodiments of the present disclosure provides a refrigeration cycle device, including the above-mentioned compressor.

In some embodiments, the refrigeration cycle device further includes:

an evaporator, an inlet of the evaporator being configured to communicate with the expansion assembly, and an outlet of the evaporator being configured to communicate with the compression assembly.

In some embodiments, when the compressor includes a gas supplement passage, the refrigeration cycle device further includes an economizer;

an inlet of the economizer is in communication with the expansion assembly;

the economizer is provided with a first outlet and a second outlet, the first outlet is in communication with the inlet of the evaporator and is configured to transport a liquid refrigerant to the evaporator; the second outlet is in communication with the gas supplement passage and is configured to supplement a gaseous refrigerant emitted through flash evaporation into the compressor through the gas supplement passage.

In some embodiments, an expansion mechanism is further provided on a pipeline connected between the economizer and the evaporator, and is configured to reduce power of operation of the refrigerant.

In some embodiments, the economizer is a flash evaporator, the refrigeration cycle device further comprises an adjustment pipeline, one end of the adjustment pipeline is connected to the expansion assembly, the other end of the adjustment pipeline is connected to an inlet of the flash evaporator, and an expansion valve is provided on the adjustment pipeline.

Compared to the related art, the compressor and refrigeration cycle device provided by embodiments of the present disclosure at least have the following beneficial effects.

The compressor provided by the embodiments can perform multi-stage compression on the refrigerant, which can reduce the pressure difference of each stage and the leakage, and improve the volumetric efficiency of the compressor; at the same time, the compressed refrigerant is expanded by the expansion assembly, such that the drive assembly uses the power generated by the expansion of the refrigerant to drive the compression assembly, so as to reduce the power consumption of the compressor. In addition, the refrigerant is compressed through the multi-stage compression, the compressed refrigerant is expanded, and the expansion work is absorbed, which have a synergistic effect on the performances of the compressor and the refrigeration cycle device, such that the performance coefficients of the compressor and the refrigeration cycle device are high.

Further, the compressor provided by the embodiments of the present disclosure further includes a first cooler provided outside the housing; the refrigerant compressed by the compression assembly is cooled by the first cooler before being expanded by the expansion assembly. Such arrangement can avoid a high temperature of the compressor body, protect the compressor, and improve the compression efficiency.

Further, the compressor provided by the embodiments of the present disclosure further includes a gas supplement passage for supplementing a gaseous refrigerant into the compressor. Through such arrangement, the compressor has a function of supplementing gas and increasing enthalpy, which can further increase the volumetric efficiency and cooling capacity of the compressor.

Further, the compressor provided by the embodiments of the present disclosure further includes a second cooler provided outside the housing; the first-stage refrigerant is cooled by the second cooler before being compressed through the second-stage compression of the second-stage compression structure. Such arrangement can avoid the high temperature of the compressor body and protect the compressor.

Further, a ratio of a volume of the first-stage cylinder to a volume of the second-stage cylinder in the compression assembly provided by the embodiments of the present disclosure is in a range of 0.5 to 1.35, and a ratio of the intake volume to the expansion volume of the first expansion cylinder is in a range of 2.0 to 5.55. Through the analysis and verification structure of the refrigeration condition, the ratio of the volume of the first-stage cylinder to the volume of the secondary cylinder is in the range of 0.5 to 1.35, and the ratio of the intake volume to the expansion volume of the first expansion cylinder is in the range of 2.0 to 5.55, which are beneficial to improve the performance of the compressor.

In conclusion, the compressor and refrigeration cycle device provided by the embodiments of the present disclosure have a two-stage compression with inter-stage gas supplement and enthalpy increase structure. Compared to the single-stage compression, such structure can reduce the pressure difference of each stage and the leakage, and increase the volumetric efficiency and refrigeration capacity of the compressor. At the same time, the expansion work can be recovered by the expansion assembly, thereby reducing the power consumption of the compressor, and improving the performance coefficients of the compressor and the circulation system, and greatly improving the performance coefficient of the transcritical refrigeration cycle device.

The above description is only an overview of the technical solution of the present disclosure. In order to understand the technical means of the present disclosure more clearly and implement it in accordance with the content of the description, the preferred embodiments of the present disclosure are described in detail below with reference to the accompanying drawings.

DETAILED DESCRIPTION

In order to further explain the technical means and effects of the present disclosure for achieving the intended purpose of the disclosure, specific implementations, structures, features and effects thereof according to the present disclosure will be described in detail below with reference to accompanying drawings and preferred embodiments. In the following description, different "an embodiment" or "embodiment" does not definitely refer to the same embodiment. In addition, specific features, structures, or characteristics in one or more embodiments may be combined in any appropriate form.

Embodiment I

Figure 1:
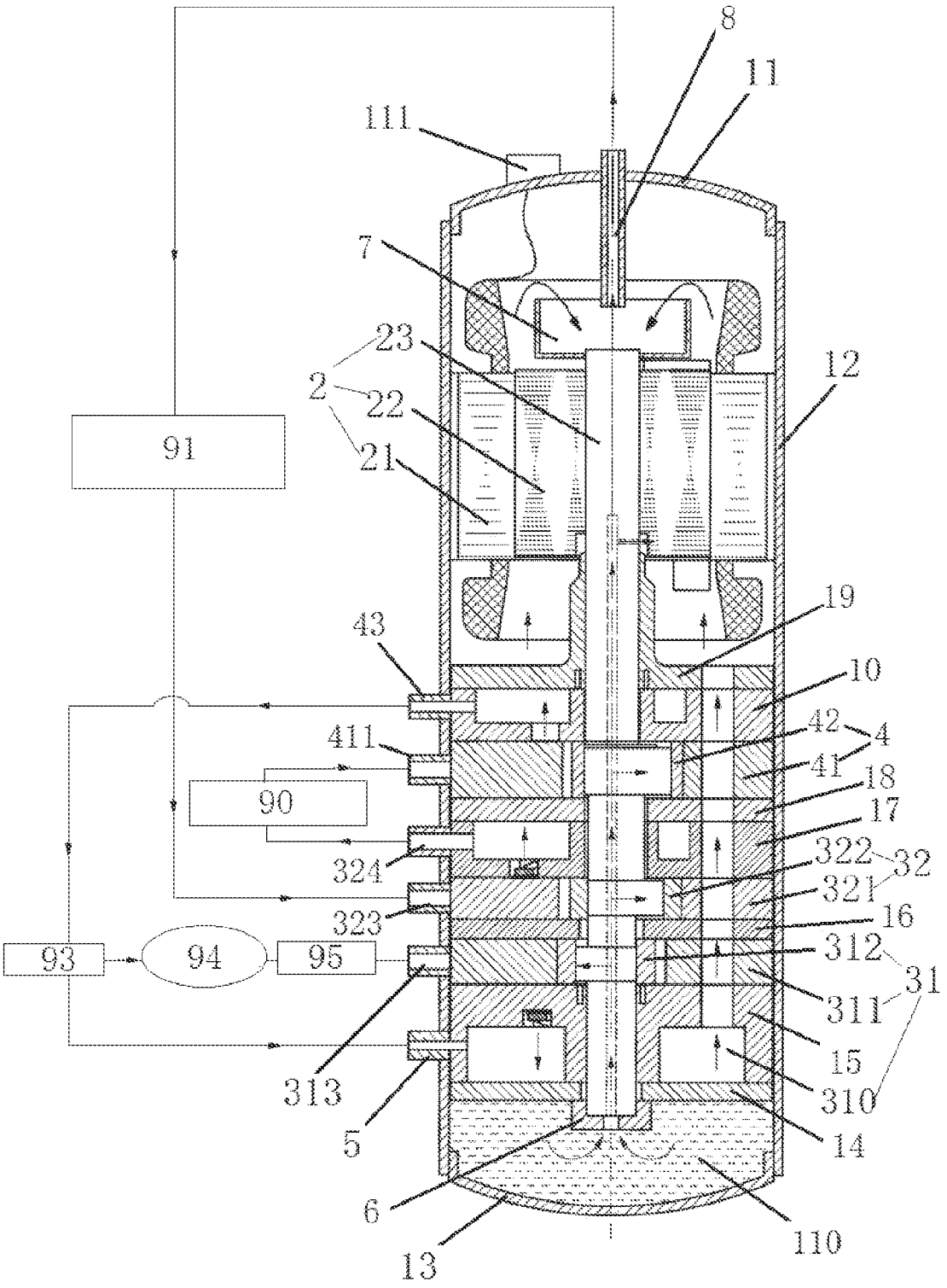
FIG. 1 is a schematic structure diagram of a first type of refrigeration cycle device according to some embodiments of the present disclosure.
Figure 2:
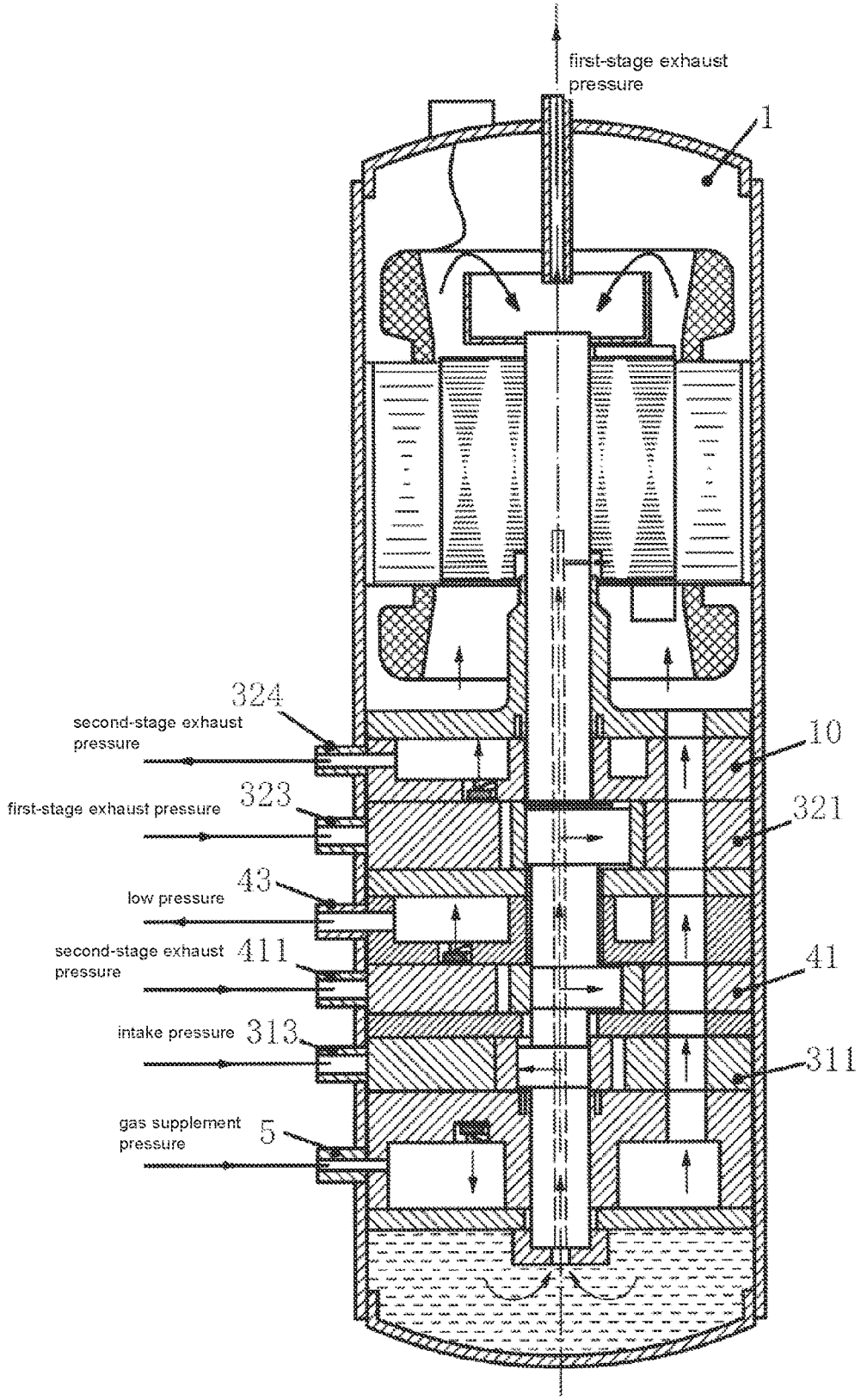
FIG. 2 is a schematic structure diagram of a second type of compressor according to some embodiments of the present disclosure.
Figure 3:
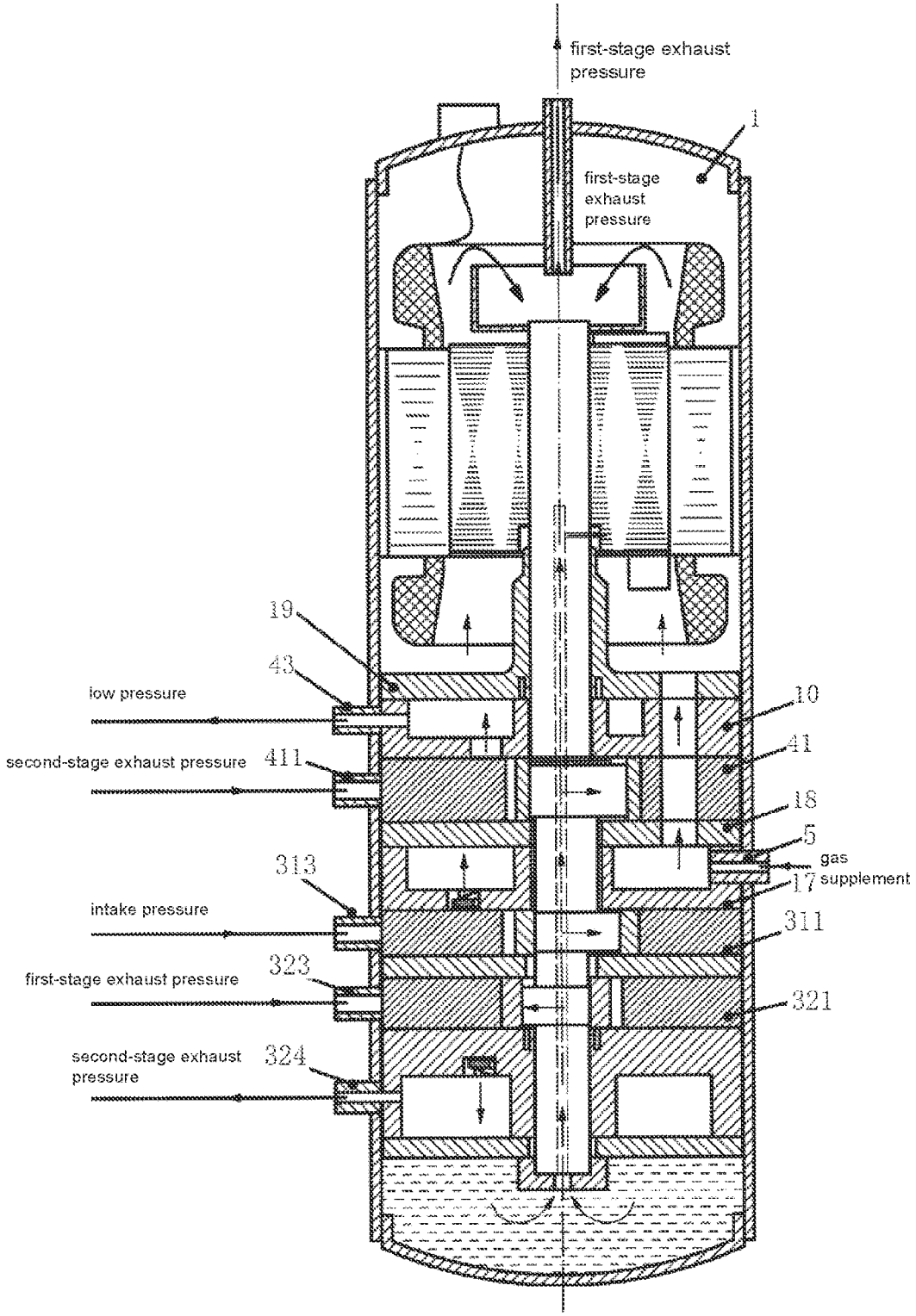
FIG. 3 is a schematic structure diagram of a third type of compressor according to some embodiments of the present disclosure.
Figure 4:
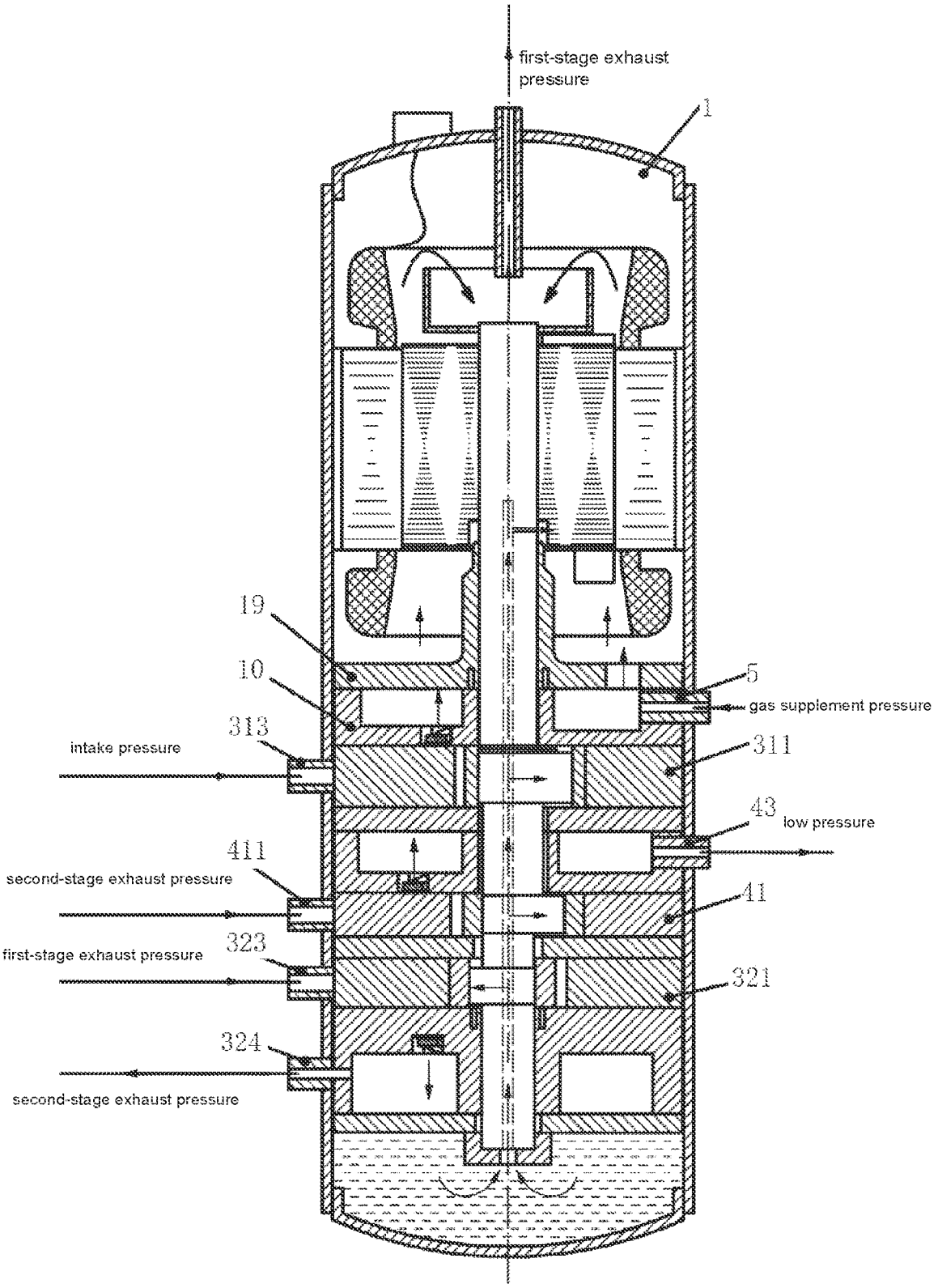
FIG. 4 is a schematic structure diagram of a fourth type of compressor according to some embodiments of the present disclosure.
Figure 5:
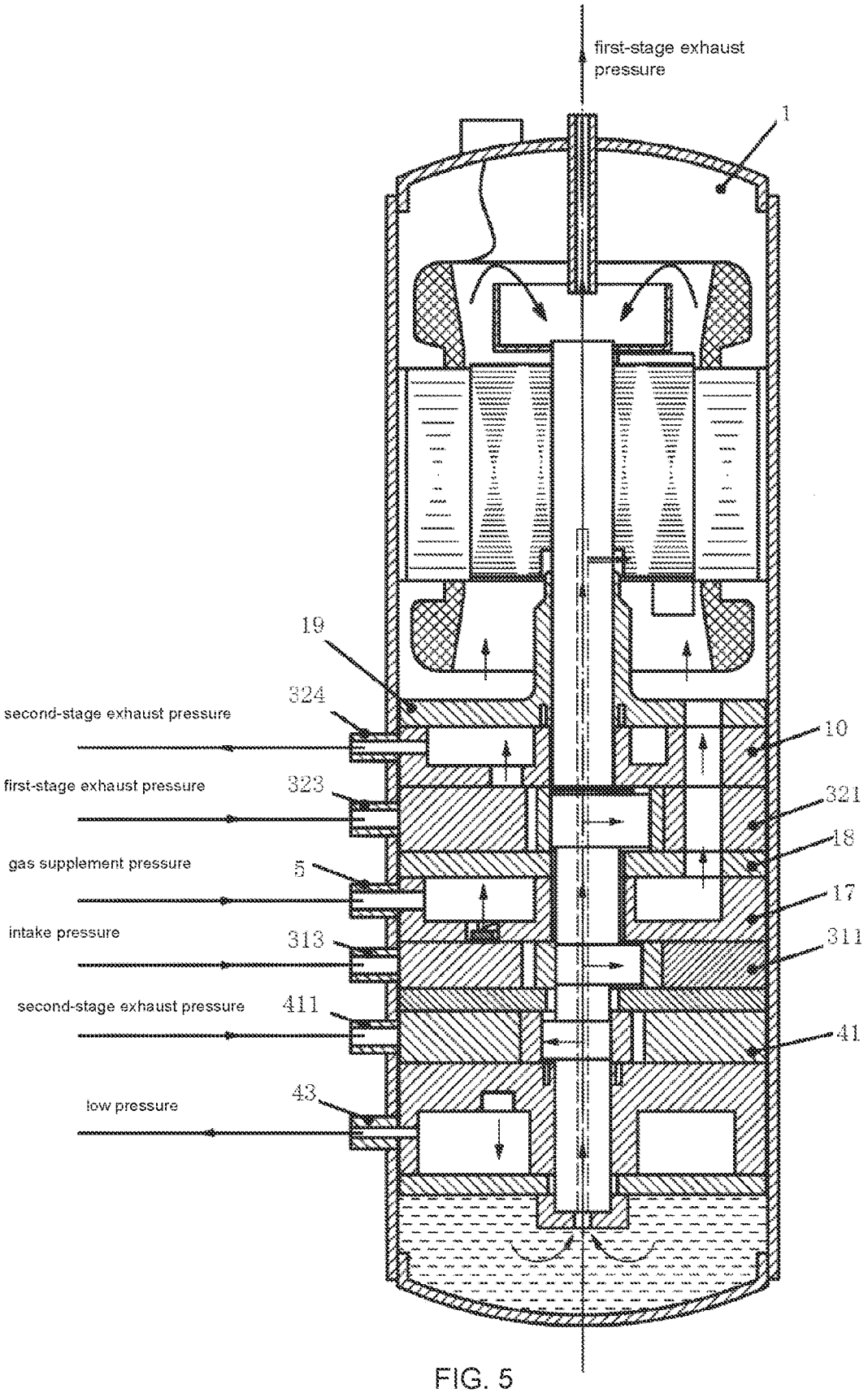
FIG. 5 is a schematic structure diagram of a fifth type of compressor according to some embodiments of the present disclosure.
Figure 6:
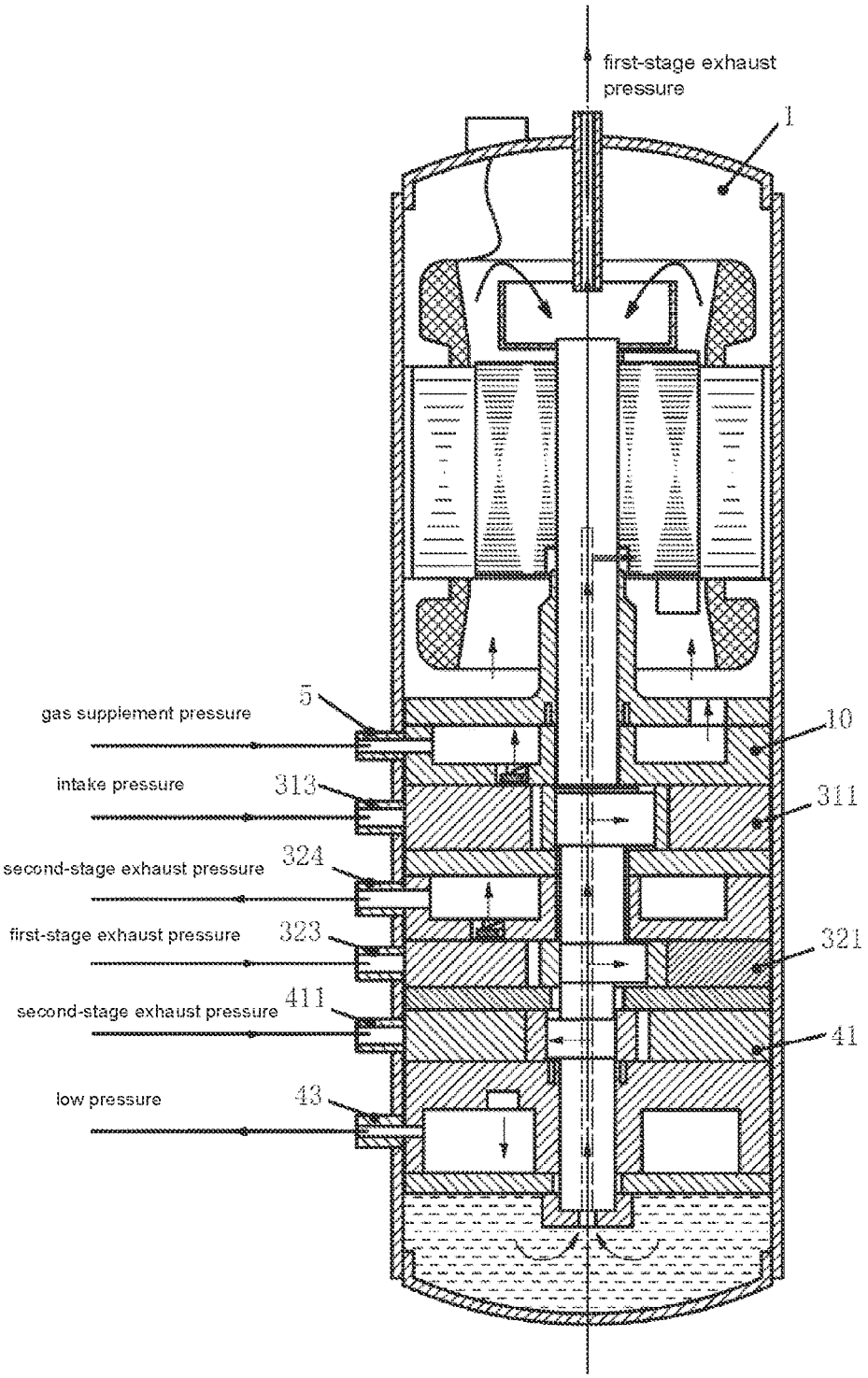
FIG. 6 is a schematic structure diagram of a sixth type of compressor according to some embodiments of the present disclosure.

The present embodiment provides a compressor, as shown in FIG. 1, the compressor in the embodiment includes: a housing (the housing consists of an upper cover 11, a housing body 12 and a lower cover 13) and a drive assembly 2 provided in the housing, a compression assembly and an expansion assembly 4. The compression assembly is connected to and driven by the drive assembly 2 to perform multi-stage compression processing on a refrigerant under drive of the drive assembly 2 (the multi-stage compression processing here refers to: a gas is drawn into the compressor and goes through many boosts (at least twice) to reach a required working pressure). The expansion assembly 4 is connected to the drive assembly 2; the expansion assembly 4 is configured to expand the refrigerant which is compressed by the compression assembly, and the drive assembly 2 is capable of driving the compression assembly together with a power generated by the expansion assembly 4.

The compressor provided in the embodiment can perform multi-stage compression processing on the refrigerant, which can reduce a pressure difference of each stage, reduce a leakage, and improve a volumetric efficiency of the compressor; meanwhile, the compressed refrigerant is expanded by the expansion assembly, and the drive assembly is made drive the compression assembly together with the power generated by the expansion of the refrigerant, thereby reducing a power consumption of the compressor. In addition, the multi-stage compression process to the refrigerant, the expansion process to the compressed refrigerant, and the suction of expansion work have a synergistic effect on performances of the compressor and the refrigeration cycle device, such that the performance coefficients of the compressor and the refrigeration cycle device are high.

In some embodiments, the compressor further includes a first cooler 90. The first cooler 90 is provided outside the housing, and the refrigerant compressed by the compression assembly is cooled by the first cooler 90 and then expanded by the expansion assembly 4. Such arrangement can avoid a high temperature of the compressor body, protect the compressor, and improve the expansion efficiency of the expansion assembly. An inlet and an outlet of the first cooler 90 are connected to the compressor 1 (specifically, the inlet of the first cooler 90 is in communication with a gas outlet of the two-stage compression structure, and the outlet of the first cooler 90 is in communication with a gas inlet of the expansion assembly).

In some embodiments, the compressor further includes a gas supplement passage 5 configured to supplement a gaseous refrigerant into the compressor. Through such arrangement, the compressor has functions of supplementing gas and increasing enthalpy, thereby further improving the volumetric efficiency and cooling capacity of the compressor.

In addition, the compressors described in the embodiment and the following embodiments mainly use carbon dioxide as refrigerant.

Embodiment II

In some embodiments, the present embodiment provides a compressor. Compared to the previous embodiment, as shown in FIG. 1, the present embodiment further designs the compression assembly as follows.

The compression assembly in the embodiment includes a first-stage compression structure 31 and a second-stage compression structure 32. The first-stage compression structure 31 performs first-stage compression processing on the refrigerant discharged from an evaporator 95; the second-stage compression structure 32 performs second-stage compression processing on a first-stage refrigerant. The first-stage refrigerant includes a refrigerant compressed by the first-stage compression structure 31. In some embodiments, the first-stage refrigerant further includes a refrigerant supplemented by the gas supplement passage 5. In some embodiments, the compressor further includes a second cooler 91 (the second cooler 91 is provided outside the housing, and an inlet of the second cooler 91 is in communication with a gas outlet of the first-stage refrigerant of the compressor 1, and an outlet of the second cooler 91 is in communication with the second-stage compression structure); the first-stage refrigerant is cooled by the second cooler 91 and then processed by the second-stage compression of the second-stage compression structure 32. Through such arrangement, a high temperature of the compressor body can be avoided, and the compressor can be protected.

In some embodiments, as shown in FIG. 1, specific structure designs of the first-stage compression structure 31 and the second-stage compression structure 32 in the embodiment are as follows.

The first-stage compression structure 31 includes: a first-stage cylinder 311, a first-stage roller 312, and a first-stage cavity 310. The first-stage cylinder 311 is provided with a first gas inlet 313 and a first gas outlet; the first gas inlet 313 is configured to communicate with a gas outlet of the evaporator 95. The first-stage roller 312 is arranged in the first-stage cylinder 311, and the first-stage roller 312 is driven by the drive assembly 2 to cooperate with the first-stage cylinder 311 to perform first-stage compression on the refrigerant. The first-stage cavity 310 is in communication with the first gas outlet, so that the refrigerant obtained after the first-stage compression is discharged into the first-stage cavity 310. As shown in the structure of the compressor shown in FIG. 1, with respect to the second-stage compression structure and expansion assembly, the first-stage compression structure 31 is located at the bottom, the first-stage cavity 310 is provided on a lower flange 15, and the first-stage cavity 310 is a closed cavity enclosed by the lower flange 15 and the lower cover 14.

The second-stage compression structure 32 includes a second-stage cylinder 321, a second-stage roller 322 and a second-stage cavity. The second-stage cylinder is provided with a second gas inlet 323 and a second gas outlet; the second gas inlet 323 is configured to draw the first-stage refrigerant. The second-stage roller 322 is arranged in the second-stage cylinder 321, and the second-stage roller is driven by the drive assembly 2 to cooperate with the second-stage cylinder 321 to perform second-stage compression on the refrigerant. The second-stage cavity is in communication with the second gas outlet, so that the refrigerant obtained after the second-stage compression is discharged into the second-stage cavity. The structure of the compressor shown in FIG. 1, the second-stage cavity is provided on a middle partition plate 17, and is a sealed cavity enclosed by the middle partition plate 17 and an upper partition plate 18; the second-stage cavity is configured to store the refrigerant after the second-stage compression, and is provided with a master gas outlet 324 of the second-stage compression structure to communicate with the first cooler 90.

In some embodiments, a ratio of a volume of the first-stage cylinder 311 to a volume of the second-stage cylinder 321 is in a range of 0.5 to 1.35; here, the ratio of the volume of the first-stage cylinder 311 to the volume of the second-stage cylinder 321 is set in the range of 0.5 to 1.35 through the analysis and verification structure of the refrigeration condition, which is beneficial to improve the performance of the compressor.

Figure 8:
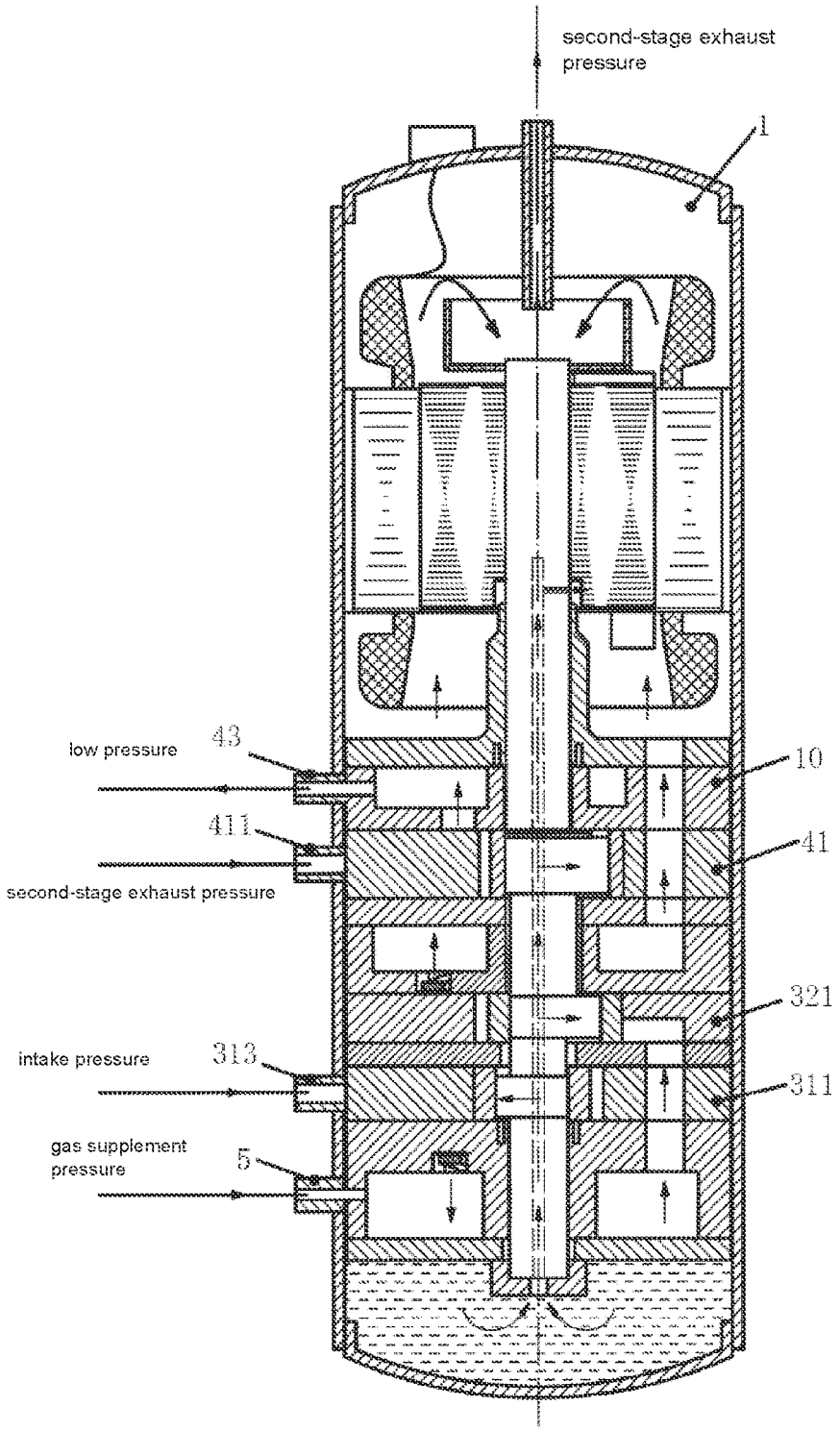
FIG. 8 is a schematic structure diagram of an eighth type of compressor according to some embodiments of the present disclosure.
Figure 9:
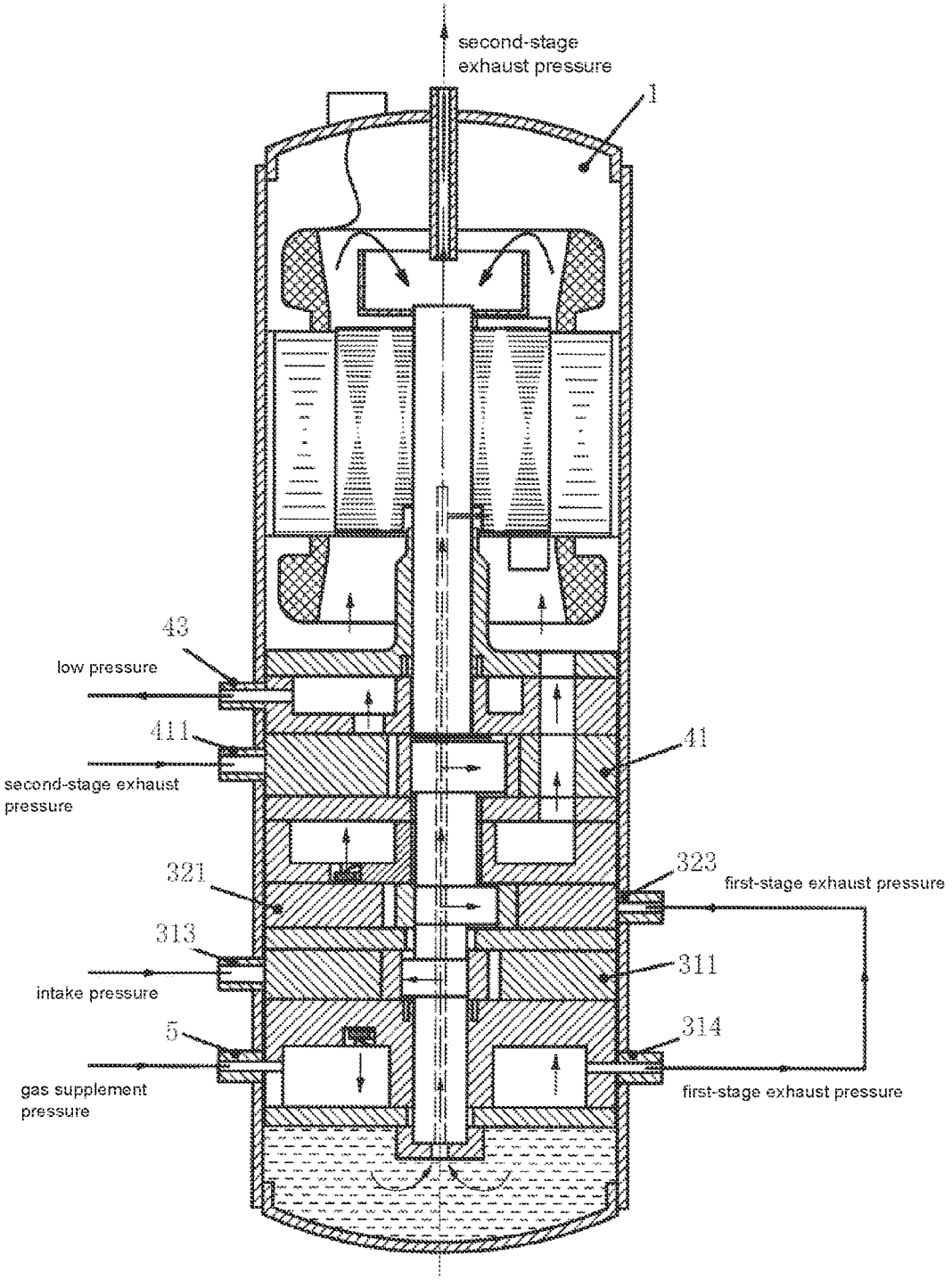
FIG. 9 is a schematic structure diagram of a ninth type of compressor according to some embodiments of the present disclosure.

In some embodiments, an exhaust pipeline 8 is provided on the housing (in some embodiments, the exhaust pipeline 8 is provided on the upper cover 11), and the exhaust pipeline 8 is in communication with an inner cavity of the housing (i.e., an inner cavity of the compressor); here, the housing is a fully enclosed structure. Here, there are two following design solutions: the compressor structure shown in FIG. 1 is the first solution, that is, the first-stage cavity 310 is in communication with the inner cavity of the housing, and the exhaust pipeline 8 is configured to communicate with the inlet of the second cooler 91, and the outlet of the second cooler 91 is in communication with the second gas inlet 323 on the second-stage cylinder 321. For the solution, the first-stage refrigerant in the first-stage cavity 310 passes through circulation passages on the first-stage cylinder 311, on the lower partition plate 16, on the second-stage cylinder 321, on the middle partition plate 17, on the upper partition plate 18, on the first expansion cylinder 41, on the exhaust chamber 10 and on the upper flange 19 in sequence from bottom to top, to enter the inner cavity of the housing. If the refrigeration cycle device is not provided with the second cooler, the compressor structures shown in FIG. 8 and FIG. 9 are a second solution: the first-stage cavity 310 is in communication with the second gas inlet of the second-stage cylinder 321, the second-stage cavity is in communication with the inner cavity of the housing, and the exhaust pipeline 8 is configured to communicate with the inlet of the first cooler 90. As shown in FIG. 8, the first-stage cavity is directly in communication with the gas inlet of the second-stage cylinder 321, and the refrigerant after the second-stage compression enters the second-stage cavity, and passes through circulation passages on the first expansion cylinder 41, on the exhaust cavity and on the upper flange in sequence to enter the inner cavity of the housing. As shown in FIG. 9, the gas outlet 314 on the first-stage cavity is directly in communication with the gas inlet 323 of the second-stage cylinder 321 through an external passage of the compressor; the refrigerant after the second-stage compression enters the second-stage cavity, and passes through the circulation passages on the first expansion cylinder 41, on the exhaust cavity and on the upper flange in sequence to enter the inner cavity of the housing.

Figure 7:
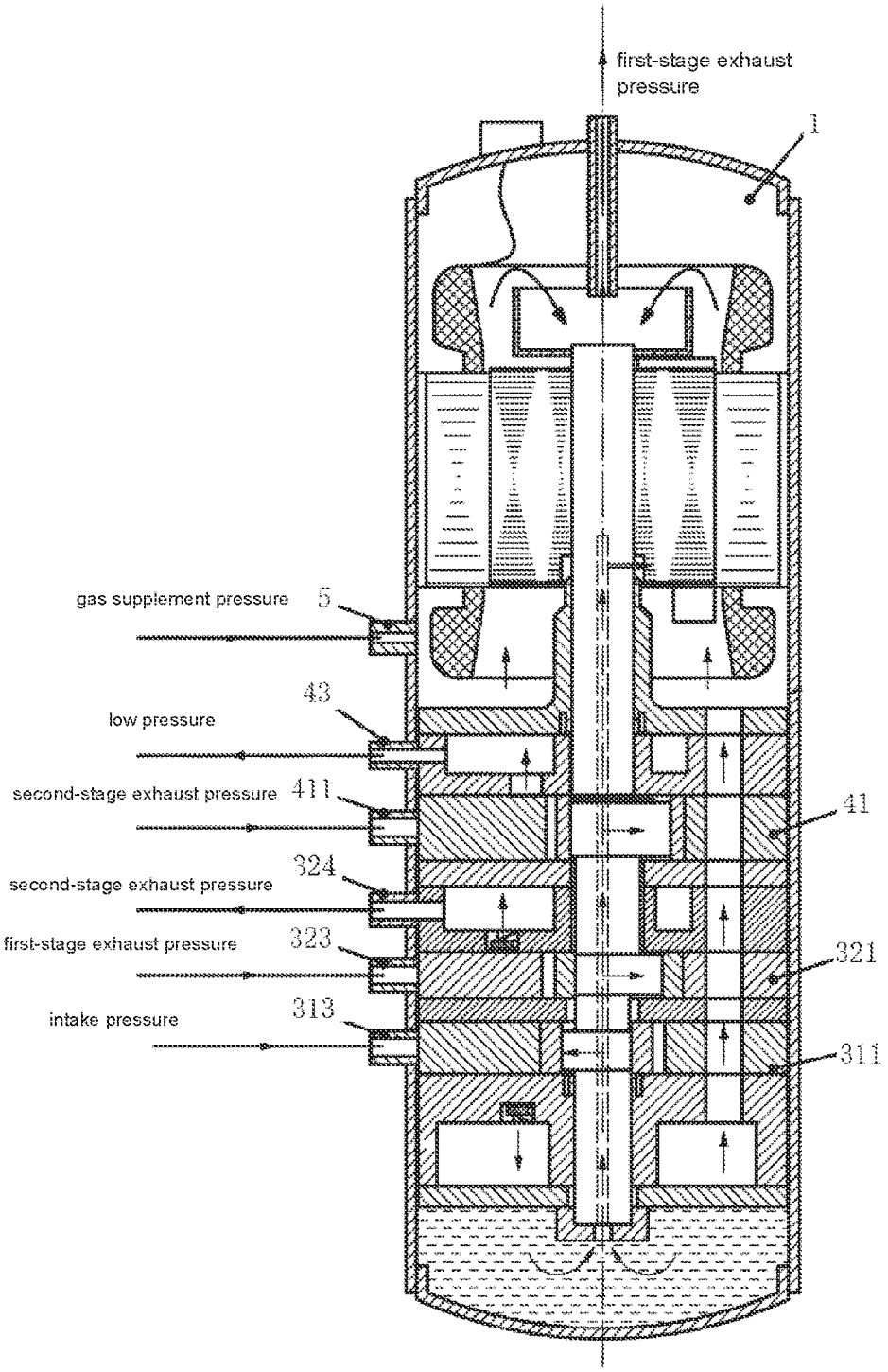
FIG. 7 is a schematic structure diagram of a seventh type of compressor according to some embodiments of the present disclosure.

In some embodiments, if the exhaust pipeline 8 is in communication with the first-stage cavity (as shown in FIGS. 1 to 7, 10 and 11), the gas supplement passage 5 is directly in communication with the first-stage cavity (as shown in FIGS. 1 to 6, FIG. 10 and FIG. 11); or the gas supplement passage is directly in communication with the inner cavity of the housing (as shown in FIG. 7, the gas supplement passage 5 is directly provided on the housing); or the gas supplement passage can be in communication with a circulation passage between the first-stage cavity and the inner cavity of the housing. As shown in FIGS. 8 and 9, if the exhaust pipeline 8 is in communication with the second-stage cavity, the gas supplement passage 5 is directly in communication with the first-stage cavity.

Embodiment III

In some embodiments, the present embodiment provides a compressor. Compared to the above-mentioned embodiments, as shown in FIGS. 1 to 11, the embodiment mainly designs the expansion assembly 4 as follows.

The expansion assembly 4 in the embodiment mainly includes: a first expansion cylinder 41 and a first roller 42; the first expansion cylinder 41 is provided with a third gas inlet 411 and a third gas outlet. The first roller 42 is arranged in the first expansion cylinder 41. The third gas inlet 411 is configured to draw the refrigerant processed by the multi-stage compression of the compression assembly into the first expansion cylinder 41; the first roller 42 is configured to expand the refrigerant drawn into the first expansion cylinder 41 under drive of the drive assembly 2; the refrigerant after expansion is discharged from the third gas outlet. When the compressor is connected to the first cooler 90, the third gas inlet 411 is connected to the outlet of the first cooler. Here, the first expansion cylinder does not need to compress the refrigerant. A volume change (from small to large) of the high-pressure refrigerant inside the first expansion cylinder changes from a high pressure to a low pressure, and the refrigerant changes from a gas phase to a liquid phase. During the state change, the refrigerant does work on the first expansion cylinder, which can recover part of lost work and improve the compression efficiency of the compressor.

In some embodiments, as shown in FIGS. 1-9, the expansion assembly further includes a first cavity. The first cavity is in communication with the third gas outlet, and the first cavity is provided with a fourth gas outlet. The fourth gas outlet is used as the master gas outlet 43 of the expansion assembly, and is configured to discharge the refrigerant expanded by the expansion assembly to a heat exchange component (e.g., an economizer 93) connected to the compressor.

In some embodiments, a ratio of an intake volume to an expansion volume of the first expansion cylinder 41 is in a range of 2.0 to 5.55; through the analysis and verification structure of the freezing condition, the ratio of the intake volume to the expansion volume of the first expansion cylinder 41 is in the range of 2.0 to 5.55, which is beneficial to improve the performance of the compressor.

Figure 11:
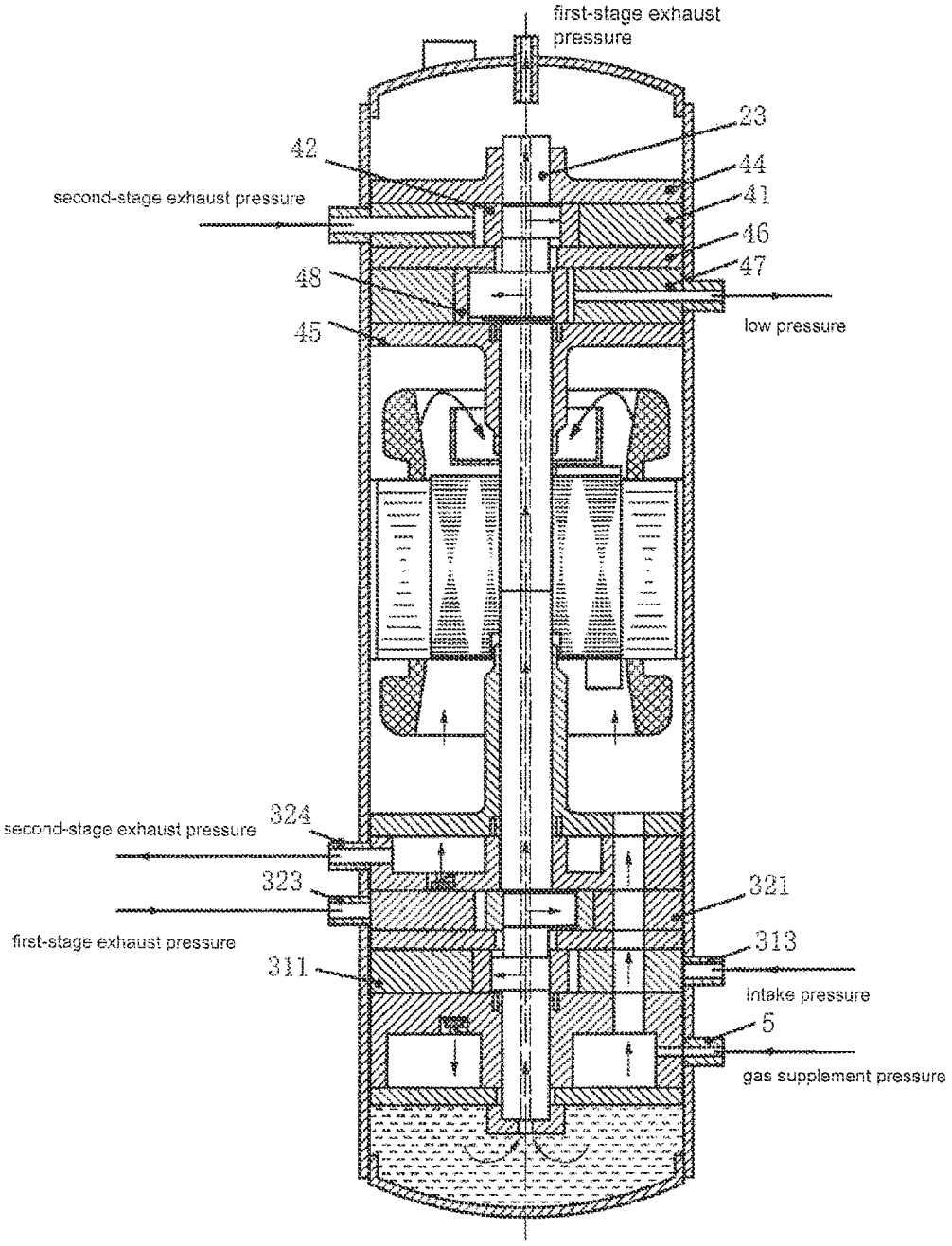
FIG. 11 is a schematic structure diagram of an eleventh type of compressor according to some embodiments of the present disclosure.

In some embodiments, as shown in FIG. 11, the expansion assembly further includes: a second expansion cylinder 47 and a second roller 48; the second expansion cylinder 47 is provided with a fourth gas inlet and a fifth gas outlet; the fourth gas inlet is in communication with the fifth gas outlet; the second roller 48 is arranged in the second expansion cylinder 47, and the second roller 48 is connected to and driven by the drive assembly. The fifth gas outlet is used as the master gas outlet of the expansion assembly, and is configured to discharge the refrigerant expanded by the expansion assembly to the heat exchange component (e.g., the economizer 93) connected to the compressor.

The expansion assembly in the embodiment can be a single-cylinder expansion form (only the first expansion cylinder is provided) and a dual-cylinder expansion form (the first expansion cylinder and the second expansion cylinder are provided simultaneously); a second expansion cylinder is further provided on the basis of the first expansion cylinder, which can improve the expansion efficiency. In addition, in the embodiment, by providing an expansion cylinder form, the expansion efficiency is higher than that of the scroll type, the manufacturability is good, and the cost is low.

Embodiment IV

In some embodiments, the present embodiment provides a compressor. Compared to the above-mentioned embodiment, as shown in FIG. 1, the drive assembly of the embodiment is designed as follows: the drive assembly 2 includes a motor. Specifically, the drive assembly includes a drive structure and crankshaft 23; the drive structure includes a motor stator 21 and a motor rotor 22; the compression assembly and the expansion assembly sleeve the crankshaft 23 of the motor.

The stator 21 of the motor sleeves outside the rotor 22, and the rotor 22 sleeves the crankshaft 23. A terminal 111 is provided on the arc-shaped upper cover 11 and is connected to the stator 21 through a power line; when the terminal 111 is energized, a magnetic pull force is generated between the motor stator 21 and the motor rotor 22, and drives the crankshaft 23 assembled in the middle of the motor rotor 22 to rotate at a high speed. The crankshaft 23 is provided with three eccentric portions. The three eccentric portions are respectively provided with a first-stage roller, a second-stage roller and a first roller, which respectively perform rotation and compression in the first-stage cylinder, the second-stage cylinder and the first expansion cylinder.

In some embodiments, the inlet of the exhaust pipeline 8 is located above the motor stator 21 and the motor rotor 22, so that the refrigerant in the cavity of the housing passes through the motor stator 21 and the motor rotor 22 on the motor before being drawn into the exhaust pipeline 8, to cool the motor stator 21 and the motor rotor 22.

In some embodiments, an oil baffle plate 7 is mounted at a position on the crankshaft 23 higher than the motor rotor 22 (in some embodiments at a position on the crankshaft 23 5 mm higher than the rotor) to separate the refrigerant oil. In addition, a bottom portion of the compressor in the embodiment is provided with an oil reservoir, and the bottom portion is filled with the refrigerant oil 110; specifically, the oil reservoir consists of a pump body assembly, a housing, and a lower cover 13, and a lower end of the crankshaft 23 is connected to an oil pump 6.

Embodiment V

On the basis of the above embodiments, the present embodiment further describes the compressor structure shown in FIGS. 1 to 11 in detail as follows.

The structure of the compressor shown in FIG. 1 is first taken as an example for detailed description: as shown in FIG. 1, the housing of the compressor shown in FIG. 1 is a fully enclosed drum-shaped closed container, which receives a drive structure assembled on the upper portion of the housing and a pump body assembly on the lower portion of the container. The pump body assembly includes a compression assembly and an expansion assembly 4. The compression assembly consists of independent first-stage compression structure 31 and second-stage compression structure 32. The first-stage compression structure 31 includes a first-stage cylinder 311, a first-stage roller 312 and a first-stage cavity 310 provided on the lower flange 15. The second-stage compression structure consists of a second-stage cylinder 321, a second-stage roller 322, and a second-stage cavity provided on the middle partition plate 17 (the second-stage cavity is a closed cavity formed by the upper partition plate 18 and the middle partition plate 17, and is configured to store the refrigerant compressed by the second-stage cylinder); the second-stage cylinder 321 is located on the first-stage cylinder 311, and a lower partition plate 16 is provided between the first-stage cylinder 311 and the second-stage cylinder 321. The expansion assembly 4 includes a first expansion cylinder 41, a first roller 42, and a first cavity provided on the exhaust chamber 10 (the closed cavity formed between the upper flange 19 and the exhaust chamber 10 is the first cavity, which is configured to store the refrigerant expanded by the first expansion cylinder 41; a master gas outlet 43 of the expansion assembly is provided on a side of the exhaust chamber 10, and is connected to the economizer of the refrigeration system). The exhaust chamber 10 is connected to the upper flange 19, and an upper partition plate 18 is provided between the first expansion cylinder 41 and the middle partition plate 17. The compression assembly 3 and the expansion assembly 4 are designed to be coaxial, and the refrigerant expands in the expansion assembly to push the crankshaft 23 to rotate, and a torque is transmitted to the compression assembly 3. Both the middle partition plate 17 and the lower flange 15 are provided with an exhaust valve assembly. The upper flange 19 and the exhaust chamber 10 above the first expansion cylinder 41, and the lower flange 15 under the first-stage cylinder 311 function to support and seal.

A first gas inlet 313 is provided on a side of the first-stage cylinder 311; a gas supplement passage 5 is provided on a side of the lower flange 15; a second gas inlet 323 is provided on a side of the second-stage cylinder 321; a third gas inlet 411 is provided on a side of the first expansion cylinder 41; a fourth gas outlet is provided on a side of the exhaust chamber 10, which serves as the master gas outlet 43 of the expansion assembly; and a master gas outlet 324 of the second-stage compression structure is provided on a side of the middle partition plate 17. In addition, the gas supplement passage 5 is capable of being provided on the side of the lower flange 15, or on a side of the first-stage cylinder 311, the lower partition plate 16, the second-stage cylinder 321, the middle partition plate 17, the upper partition plate 18, the first expansion cylinder 41, and the upper flange 19 (a middle circulation passage is provided on the lower flange 15, the first-stage cylinder 311, the lower partition plate 16, the second-stage cylinder 321, the middle partition plate 7, the upper partition plate 18, the first expansion cylinder 41, the exhaust chamber 10, and the upper flange 19; and the passage is circular, curved, square or otherwise irregular). The master gas outlet 43 of the expansion assembly 4, the gas inlet 411 of the first expansion cylinder 41, the master gas outlet 324 of the second-stage compression structure, the gas inlet 323 of the second-stage cylinder 321, and the gas inlet 313 of the first-stage cylinder 311, and the gas supplement passage 5 are welded to the housing to ensure the reliability of the compressor. The lower cover plate 14 and the lower flange 15 form a closed cavity for storing a mixed first-stage refrigerant (including: the refrigerant compressed by the first-stage cylinder 311 and the intermediate pressure refrigerant supplemented by the economizer 93 through the gas supplement passage 5).

In addition, the oil pump 12 is mounted at a lower end of the crankshaft 23, draws and supplies oil from the oil reservoir with the rotation of the crankshaft 23, and transmits the refrigerated oil to each friction pair through a circulation hole in the crankshaft 23 to ensure good lubrication of the compressor under various working conditions and improve the reliability of the compressor.

Compared to the structure of the compressor shown in FIG. 1, the mounting positions of the expansion assembly, the first-stage compression structure and the second-stage compression structure in the compressor structure in the housing are correspondingly adjusted in FIGS. 2 to 6. Specifically, with respect to the compressor structure shown in FIG. 1 (in FIG. 1, the expansion assembly, the second-stage compression structure, and the first-stage compression structure are provided in sequence from top to bottom), the positions of the expansion assembly (the first expansion cylinder 41, the first cavity) and the second-stage compression structure (the second-stage cylinder 321, the second-stage cavity) are switched in the structure of the compressor shown in FIG. 2 (in FIG. 2, the second-stage compression structure, the expansion assembly and the firs-stage compression structure are provided in sequence from top to bottom). Based on the structure shown in FIG. 1, the positions of the first-stage compression structure and the second-stage compression structure are switched in the structure of the compressor shown in FIG. 3 (in FIG. 3, the expansion assembly, the first-stage compression structure, the second-stage compression structure are provided in sequence from top to bottom). Based on the structure of the compressor shown in FIG. 2, the positions of the first-stage compression structure and the second-stage compression structure are switched in the structure of the compressor shown in FIG. 4 (in FIG. 4, the first-stage compression structure, the expansion assembly and the second-stage compression structure are provided in sequence from top to bottom). Based on the structure of the compressor shown in FIG. 2, the positions of the expansion assembly and the first-stage compression structure are switched in the structure of the compressor shown in FIG. 5 (in FIG. 5, the second-stage compression structure, the first-stage compression structure and the expansion assembly are provided in sequence from top to bottom). Based on the structure of the compressor shown in FIG. 4, the positions of the second-stage compression structure and expansion assembly are switched in the structure of the compressor shown in FIG. 6 (in FIG. 6, the first-stage compression structure, the second-stage compression structure and the expansion assembly are provided in sequence from top to bottom).

Compared to the structure of the compressor shown in FIG. 1, in the structure of the compressor shown in FIG. 7, the gas supplement passage 5 is directly in communication with the inner cavity of the housing instead of the first-stage cavity.

The discharge pipeline in the compressor shown in FIGS. 1 to 7 discharges the refrigerant with the first-stage pressure.

Compared to the compressor structure shown in FIG. 1, in the compressor structure shown in FIG. 8, the first-stage cavity in the first-stage compression structure is directly in communication with the gas inlet of the second-stage cylinder; the second-stage cavity is in communication with the inner cavity of the housing through a middle circulation passage inside the pump body assembly. The exhaust pipeline discharges the refrigerant with the second-stage pressure.

Compared to the compressor structure shown in FIG. 8, in the compressor structure shown in FIG. 9, the first-stage cavity in the first-stage compression structure is in communication with the gas inlet of the second-stage cylinder through an external passage; the second-stage cavity is in communication with the inner cavity of the housing through the middle circulation passage inside the pump body assembly. The exhaust pipeline discharges the refrigerant with the second-stage pressure.

The compression assembly and the expansion assembly of the compressor shown in FIGS. 1 to 9 are both located below the drive structure.

Figure 10:
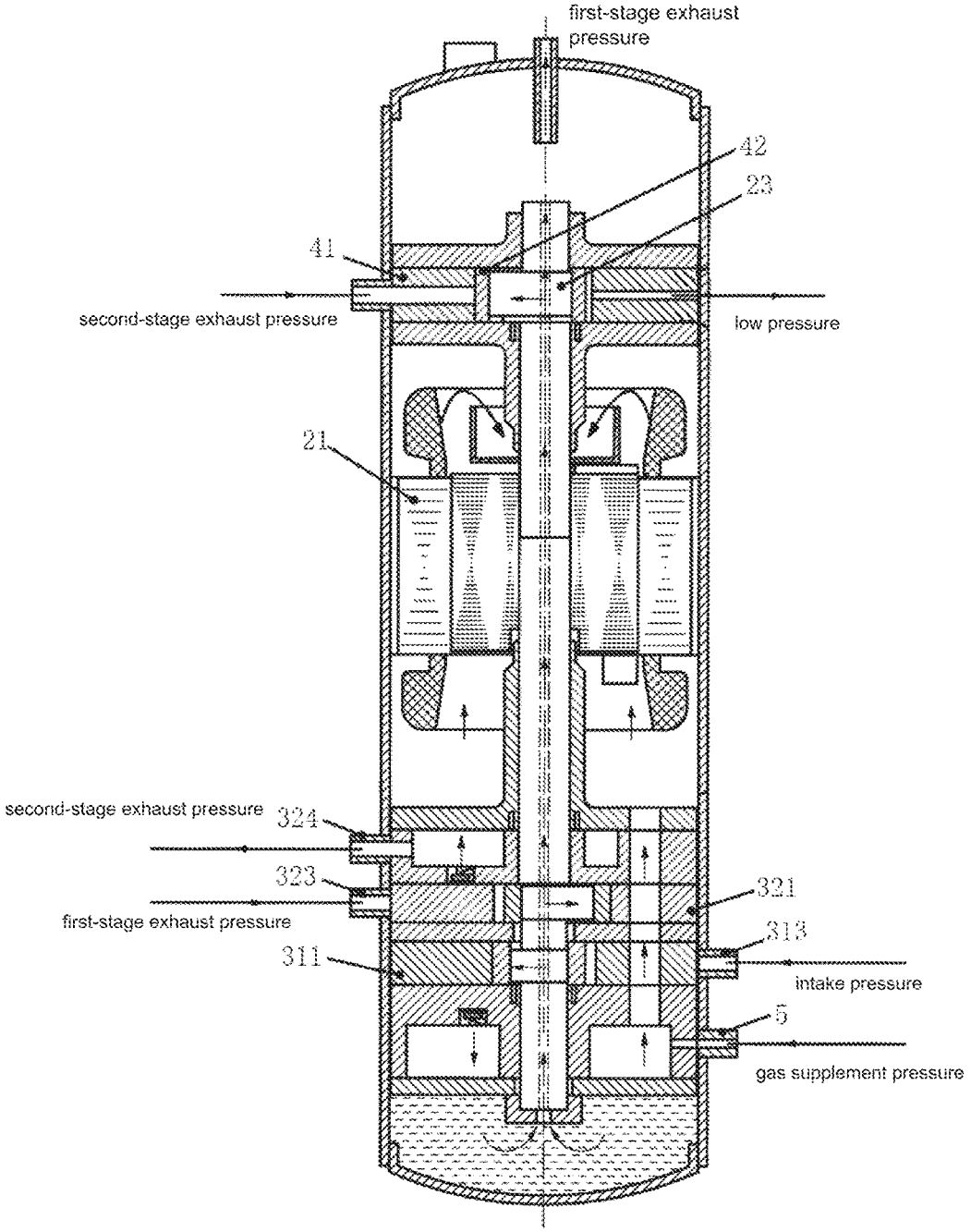
FIG. 10 is a schematic structure diagram of a tenth type of compressor according to some embodiments of the present disclosure.

Compared to the compressor structure shown in FIG. 1, in the compressor shown in FIG. 10, the expansion assembly is mounted above the drive structure, and the upper and lower sides of the first expansion cylinder 41 are positioned by flanges.

Based on the compressor shown in FIG. 10, in the compressor shown in FIG. 11, a second expansion cylinder 47 is added on the basis of the first expansion cylinder 41, and a second roller 48 is provided in the second expansion cylinder. The first expansion cylinder 41 is separated from the second expansion cylinder 47 by a partition plate 46. A first flange 44 is provided above the first expansion cylinder 41, and a second flange 45 is provided below the second expansion cylinder 47.

With reference to FIGS. 17 to 41, the compressor further includes a variable-volume assembly 50. The variable-volume assembly 50 is configured to control loading or unloading of at least one of the compression assembly and the expansion assembly 4. Specifically, when the compression assembly of the compressor has the first-stage compression structure 31, the variable-volume assembly 50 only controls loading or unloading of the expansion assembly 4; when the compression assembly of the compressor has a multi-stage compression structure, the variable-volume assembly 50 controls loading or unloading of at least one of the multi-stage compression structure and the expansion assembly 4, in which at least the first-stage compression structure 31 in the multi-stage compression structure normally performs the compression work to ensure normal operation of the compressor.

Figure 17:
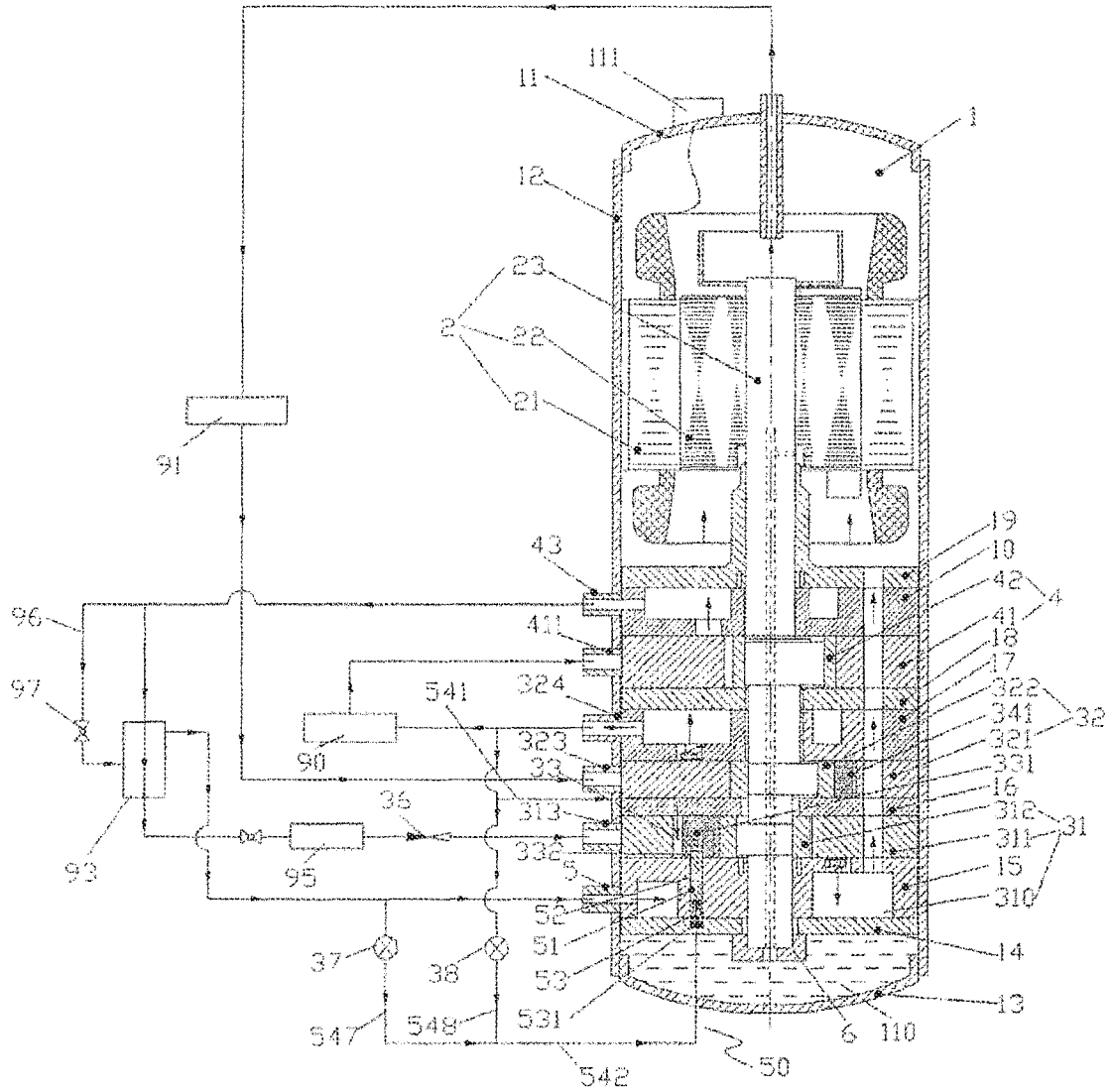
FIG. 17 is a schematic structure diagram of a fifth type of refrigeration cycle device according to some embodiments of the present disclosure.
Figure 18:
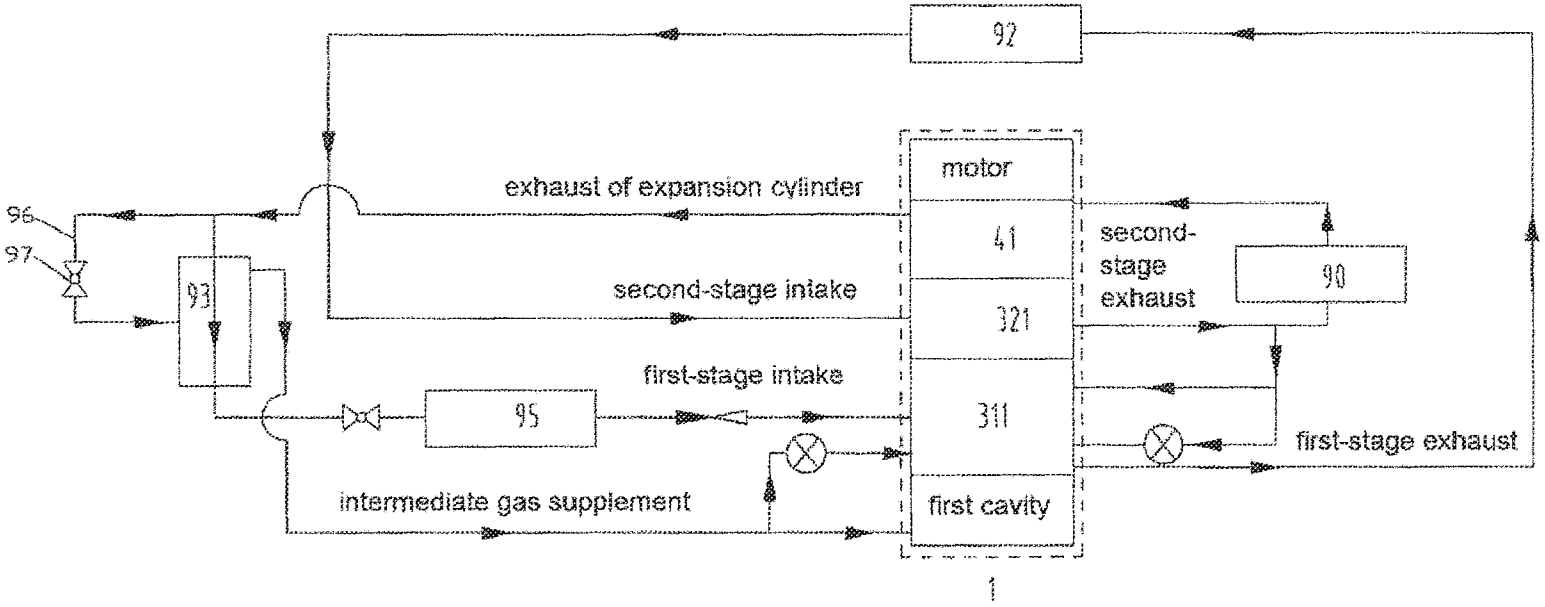
FIG. 18 is a simplified structure diagram of the refrigeration cycle device shown in FIG. 17.

With reference to FIGS. 17 and 18, according to the schematic structure diagram of the fifth type of refrigeration cycle device of the present disclosure, the compression assembly includes: a first-stage compression structure 31 configured to compress the refrigerant discharged from the evaporator 95, a second-stage compression structure 32 configured to perform second-stage compression on a first-stage refrigerant; the first-stage refrigerant includes a refrigerant compressed through the first-stage compression of the first-stage compression structure 31.

The variable-volume assembly 50 is configured to control loading or unloading of the first-stage compression structure 31; and/or the variable-volume assembly 50 is configured to control loading or unloading of the second-stage compression structure 32. In the embodiment, although the variable-volume assembly has the ability to simultaneously control loading or unloading of the first-stage compression structure 31 and loading or unloading of the second-stage compression structure 32, the first-stage compression structure 31 and the second-stage compression structure 32 are not unloaded at the same time, so as to ensure the basic compression function of the compressor. In such a way, it should be possible to reasonably select a compression structure to unload according to the requirements, so that the compressor has more optional working states and has a stronger applicability.

In the compressor disclosed in the embodiment, the first-stage compression structure 31 includes: a first-stage cylinder 311, the first-stage cylinder 311 is provided with a first gas inlet 313 and a first gas outlet, the first gas inlet 313 is configured to communicate with the outlet of the evaporator 95; a first-stage roller 312, the first-stage roller 312 is arranged in the first-stage cylinder 311, and the first-stage roller 312 is driven by the drive assembly 2 to cooperate with the first-stage cylinder 311 to perform a first-stage compression on the refrigerant; a first-stage cavity 310, the first-stage cavity 310 is in communication with the first gas outlet, so that the refrigerant compressed through the first-stage compression is discharged into the first-stage cavity 310; a first sliding groove 33 is provided in the first-stage cylinder 311, a first sliding vane 331 is slidably provided in the first sliding groove 33, and the variable-volume assembly 50 controls loading or unloading of the first-stage compression structure 31 by controlling the working state of the first sliding vane 331.

In the working process of the compressor, the first sliding vane 331 is generally utilized to press an outer peripheral wall of the first-stage roller 312 to separate the intake cavity and the discharge cavity of the first-stage cylinder 311. When the first sliding vane 331 cannot separate the intake chamber from the discharge chamber, the compression function of the first-stage compression structure 31 of the compressor disappears correspondingly, that is, the first-stage compression structure 31 is in an unloaded state. By using this characteristic, loading or unloading of the first-stage compression structure 31 is capable of being conveniently controlled by controlling the position of the sliding vane 331.

In the embodiment, the variable-volume assembly 50 includes a first pin 51; a side of the first-stage cylinder 311 is provided with a first mounting plate, the first mounting plate is provided with a first guide groove 52, and the first pin 51 is slidably provided in the first guide groove 52. A side of the first sliding vane 331 facing the first mounting plate is provided with a first pin hole 332. The first pin 51 is capable of being switched between a first position at which the first pin 51 is capable of being stuck in the first pin hole 332 and a second position at which the first pin 51 is capable of being out of the first pin hole 332.

In the embodiment, by controlling the sliding position of the first pin 51, when the first sliding vane 331 moves to a maximum retraction position in the first sliding groove 33, the first pin 51 is capable of being stuck in the first pin hole 332, so that the first sliding vane 331 is maintained in the maximum retraction position. In such a way, during rolling of the first-stage roller 312, the gas in the first-stage cylinder 311 is not compressed, and accordingly unloading of the first-stage compression structure 31 is completed. When the first-stage compression structure 31 needs to be loaded, it is only needed to control the first pin 51 to come out of the first pin hole 332, so that the first-stage compression structure 31 can continue to perform the gas compression.

The extension and retraction of the first pin 51 is capable of being controlled by a mechanical structure or a pneumatic structure. In the embodiment, the position of the first pin 51 is controlled by using a refrigerant pressure of the compressor itself, accordingly the structure is simpler, the control is flexible and convenient and is easier to implement.

In the embodiment, the first pin hole 332 is in communication with a side of the first sliding groove 33 away from the first-stage roller 312; the first sliding groove 33 is supplied with a refrigerant with a first pressure, and a side of the first guide groove 52 away from the first pin hole 332 is supplied with a refrigerant with a second pressure, and the first pressure and the second pressure can be adjusted so that the first pin 51 is capable of being switched between the first position and the second position.

In an alternative embodiment, when the first mounting plate is located on a lower side of the first-stage cylinder 311, the first pressure is an intake pressure, and the second pressure is capable of being switched among the second-stage exhaust pressure, the intake pressure and the intermediate pressure; alternatively, the first pressure is an intermediate pressure, and the second pressure is capable of being switched among the second-stage exhaust pressure, the intermediate pressure and the intake pressure. When the first pressure is the intake pressure, if the second pressure is the second-stage exhaust pressure or the intermediate pressure, the second-stage exhaust pressure or the intermediate pressure can overcome the intake pressure at the top end of the first pin 51 and a force of gravity of the first pin 51 itself, and push the first pin 51 into the first pin hole 332 to lock the position of the first sliding vane 331 by the first pin 51. If the second pressure is the intake pressure, since the upper and lower ends of the first pin 51 have the same pressure, the first pin 51 falls back under the gravity of the first pin 51 and comes out of the first pin hole 332 to unlock the position of the first sliding vane 331.

In another alternative embodiment, when the first mounting plate is located on an upper side of the first-stage cylinder 311, the first pressure is the second-stage exhaust pressure, and the second pressure is capable of being switched among the second-stage exhaust pressure, the intake pressure, and the intermediate pressure; alternatively, the first pressure is the intermediate pressure, and the second pressure is capable of being switched among the second-stage exhaust pressure, the intermediate pressure and the intake pressure. Based on the above analysis, under the set first pressure condition, the loading or unloading of the first-stage compression structure 31 can be conveniently implemented by adjusting the magnitude of the second pressure.

In some embodiments, in the embodiment, the variable-volume assembly 50 further includes an elastic member 53, which is provided at an end of the first guide groove 52 away from the first pin hole 332, the first pin 51 is in contact with the elastic member 53, and the elastic member 53 provides an elastic force to the first pin 51 to move towards the first pin hole 332. The elastic member 53 is capable of being overlapped with the first pin 51 or being fixedly connected to one end of the first pin 51. The elastic member 53 is, for example, a spring.

After the elastic member 53 is added, when considering a movement state of the first pin 51, the elastic force provided by the elastic member 53 needs to be considered at the same time. In such situation, when the first pressure is the second-stage exhaust pressure, the second pressure is capable of being switched among the second-stage exhaust pressure, the intake pressure and the intermediate pressure; alternatively, when the first pressure is the intermediate pressure, the second pressure is capable of being switched among the second-stage exhaust pressure, the intermediate pressure and intake pressure.

When the elastic member 53 is added, when the first pressure is the second-stage exhaust pressure, if the first-stage compression structure 31 needs to be loaded, the second pressure is capable of being adjusted to the second-stage exhaust pressure at this time; since the refrigerants at both ends of the first pin 51 have the same pressure, this moment the first pin 51 is only affected by the elastic force of the elastic member 53. Under the action of the elastic member 53, the first pin 51 extends and is stuck in the first pin hole 332 to implement loading of the first-stage compression structure 31. If the first-stage compression structure 31 needs to be loaded, this moment the second pressure is capable of being adjusted to be the intake pressure or the intermediate pressure. Since the first pressure is the second-stage exhaust pressure, the first pressure can overcome the second pressure and the elastic force of the elastic member 53, such that the first pin 51 is retracted into the first guide groove 52, so as to unlock the first sliding vane 331, so that the first sliding vane 331 continues to be pressed outside the first-stage roller 312 to implement unloading of the first-stage compression structure 31. When the first pressure is the intermediate pressure, the control process is similar to the process when the first pressure is the second-stage exhaust pressure, and will not be detailed herein.

In the embodiment, the compressor further includes a gas supplement inlet, and the variable-volume assembly 50 further includes a first pipeline 541 and a second pipeline 542. A first end of the first pipeline 541 is in communication with the gas outlet of the second-stage compression structure. A second end of the first pipeline 541 is in communication with a side of the first sliding groove 33 away from the first-stage roller 312. A first end of the second pipeline 542 is selectively in communication with at least one of the first gas inlet 313 and the gas supplement inlet as well as the gas outlet of the second-stage compression structure. A second end of the second pipeline 542 is in communication with a side of the first guide groove 52 away from the first pin hole 332. Specifically, in the embodiment, the first end of the second pipeline 542 can be selectively in communication with the gas supplement inlet and the gas outlet of the second-stage compression structure, or with the gas outlet of the second-stage compression structure and the first gas inlet 313, or can also be simultaneously selectively in communication with the gas supplement inlet, the gas outlet of the second-stage compression structure, and the first gas inlet 313. This is because when the first end of the first pipeline 541 is in communication with the gas outlet of the second-stage compression structure, the first pressure at the top end of the first pin 51 is the second-stage exhaust pressure. This moment, if it is intended to guarantee that the first pin 51 is capable of being extended and stuck in the first pin hole 332, a resultant force of the second pressure and the elastic member 53 needs to be greater than the second-stage exhaust pressure. Accordingly, the second pressure needs to be optionally equal to the second-stage exhaust pressure. Accordingly, the first end of the second pipeline 542 needs to be selectively in communication with the gas outlet of the second-stage compression structure, to ensure that unloading of the first-stage compression structure 31 can be successfully completed.

In another alternative embodiment, the first end of the first pipeline 541 is in communication with the gas supplement inlet. The second end of the first pipeline 541 is in communication with the side of the first sliding groove 33 away from the first-stage roller 312. The first end of the second pipeline 542 is selectively in communication with at least one of the gas supplement inlet and the gas outlet of the second-stage compression structure as well as the first gas inlet 313. The second end of the second pipeline 542 is in communication with the side of the first guide groove 52 away from the first pin hole 332. Specifically, in the embodiment, the first end of the second pipeline 542 can be selectively in communication with the gas supplement inlet and the first gas inlet 313, or with the gas outlet of the second-stage compression structure and the first gas inlet 313, or can also be simultaneously selectively in communication with the gas supplement inlet, the gas outlet of the second-stage compression structure, and the first gas inlet 313. This is because when the first end of the first pipeline 541 is in communication with the gas supplement inlet, the first pressure at the top end of the first pin 51 is the intermediate pressure. This moment, if it is intended to guarantee that the first pin 51 can descend, the intermediate pressure needs to overcome the resultant force of the second pressure and the elastic member 53. Accordingly, the second pressure needs to be selected as a pressure less than the intermediate pressure, i.e., the intake pressure, in consequence the first end of the second pipeline 542 needs to be selectively in communication with the first gas inlet 313, to guarantee that the loading of the first-stage compression structure 31 can be successfully completed.

In the embodiment, the expansion assembly 4, the second-stage compression structure 32, and the first-stage compression structure 31 are sequentially arranged in an axial direction away from the drive assembly 2. A lower flange 15 is provided on a side of the first-stage compression structure 31 away from the drive assembly 2. The lower flange 15 is the first mounting plate.

In some embodiments, a lower cover plate 14 is provided on a side of the lower flange 15 away from the first-stage compression structure 31, and the lower cover plate 14 is provided with a mounting groove 531 corresponding to the first pin hole 332. One end of the elastic member 53 is fixedly provided at a bottom portion of the mounting groove 531.

By adding the mounting groove 531, sufficient space can be provided for the mounting and movement of the elastic member 53 and the first pin 51, and a thickness of the lower flange 15 can be reduced, accordingly the material cost can be reduced, and the weight of the compressor can be reduced.

In some embodiments, a one-way valve 36 is provided on the pipeline between the variable-volume assembly 50 and the first gas inlet 313. The one-way valve 36 functions to prevent the refrigerant from flowing from a high pressure to a low pressure, and to ensure the stability and reliability of the compressor during operation. The one-way valve 36 can also be provided at other positions where it is needed to prevent the refrigerant from flowing from the high pressure to the low pressure.

Figure 19:
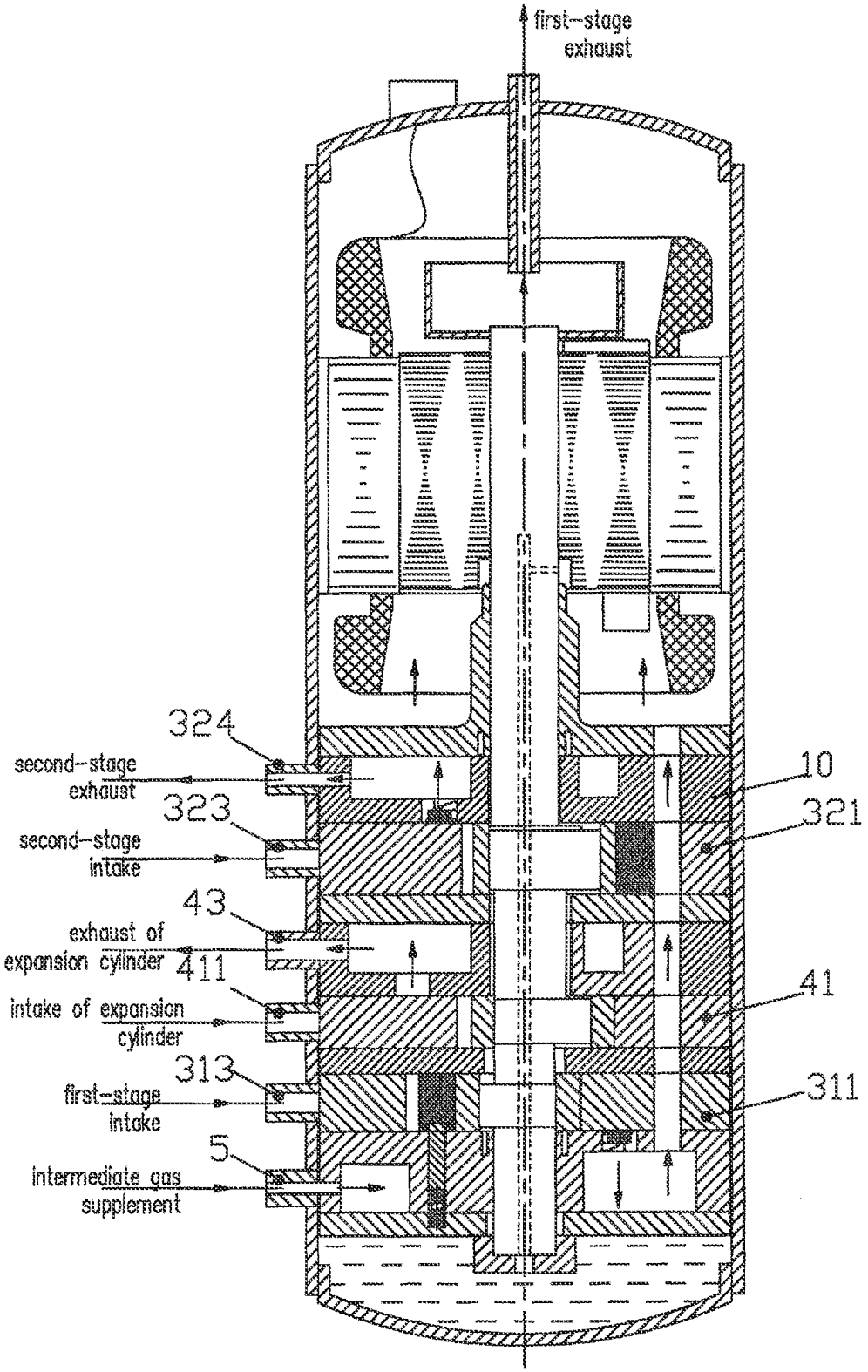
FIG. 19 is a schematic structure diagram of a twelfth type of compressor according to some embodiments of the present disclosure.

With reference to FIG. 19, which shows a substantially same compressor structure as FIG. 18, except that, in the embodiment, the second-stage compression structure 32, the expansion assembly 4; and the first-stage compression structure 31 are provided in sequence in the axial direction away from the drive assembly 2.

Figure 20:
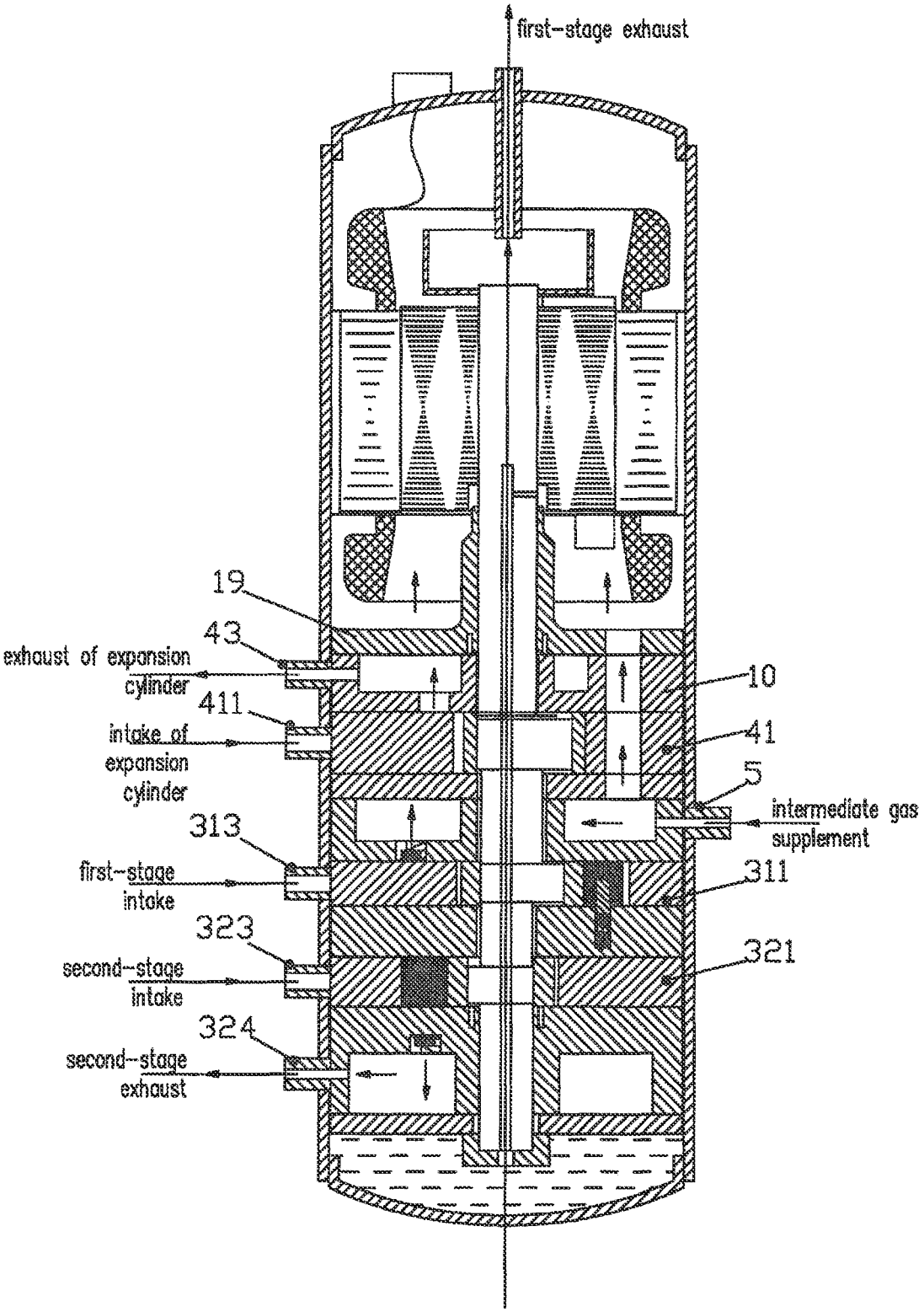
FIG. 20 is a schematic structure diagram of a thirteenth type of compressor according to some embodiments of the present disclosure.

With reference to FIG. 20, which shows a substantially same compressor structure as FIG. 18, except that, in the embodiment, the expansion assembly 4, the first-stage compression structure 31, and the second-stage compression structure 32 are provided in sequence in the axial direction away from the drive assembly 2; a lower partition plate 16 is provided on a side of the first-stage compression structure 31 away from the drive assembly 2, and the lower partition plate 16 is the first mounting plate.

Figure 21:
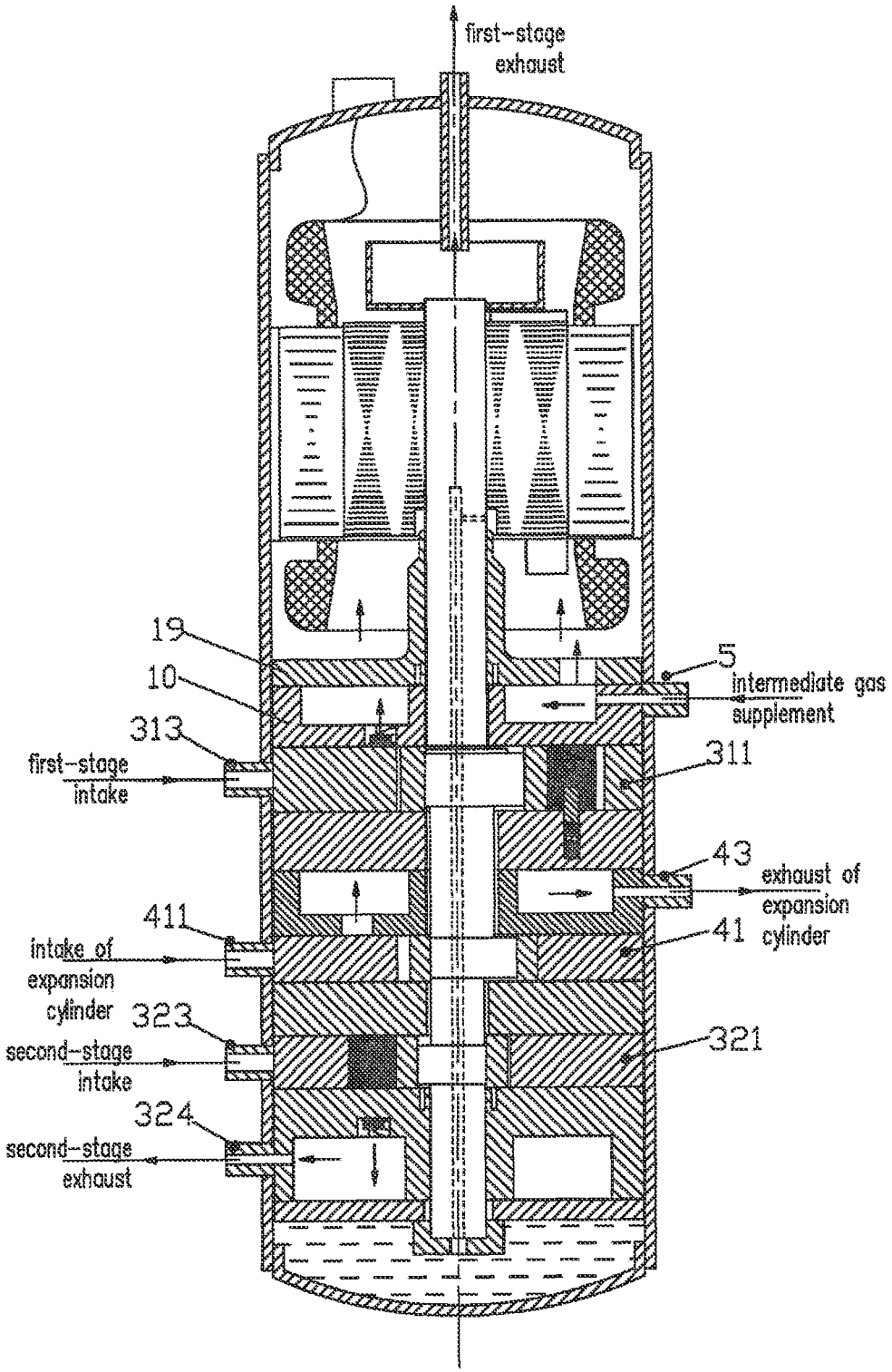
FIG. 21 is a schematic structure diagram of a fourteenth type compressor according to some embodiments of the present disclosure.

With reference to FIG. 21, which shows a substantially same compressor structure as FIG. 20, except that, in the embodiment, the second-stage compression structure 32, the first-stage compression structure 31 and the expansion assembly 4 are provided in sequence in the axial direction away from the drive assembly 2.

Figure 22:
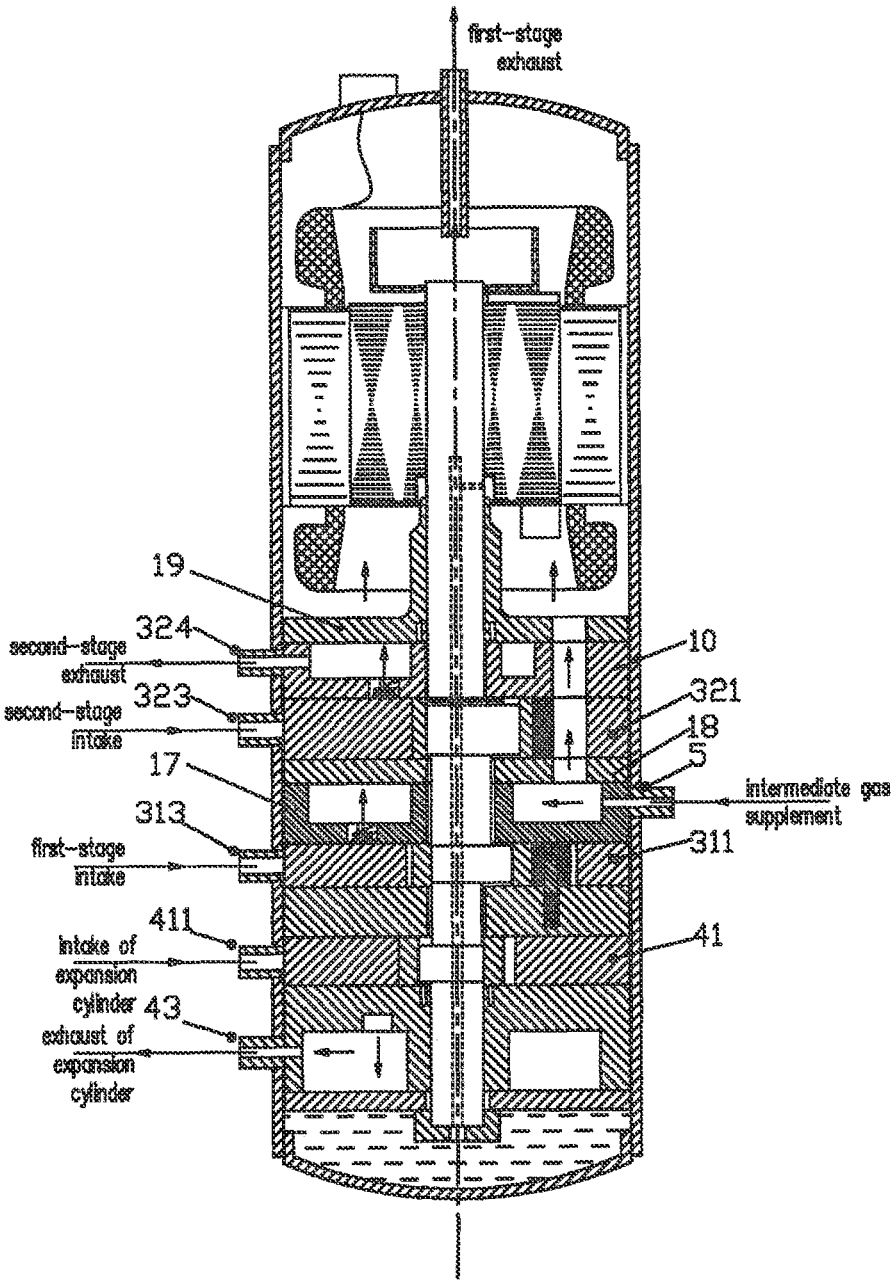
FIG. 22 is a schematic structure diagram of a fifteenth type of compressor according to some embodiments of the present disclosure.

With reference to FIG. 22, which shows a substantially same compressor structure as FIG. 18, except that, in the embodiment, the first-stage compression structure 31, the expansion assembly 4, and the second-stage compression structure 32 are provided in sequence in the axial direction away from the drive assembly 2; an upper partition plate 18 is provided on a side of the first-stage compression structure 31 away from the drive assembly 2, and the upper partition plate 18 is the first mounting plate.

In some embodiments, a middle partition plate 17 is provided on a side of the upper partition plate 18 away from the first-stage compression structure 31, and the middle partition plate 17 is provided with a mounting groove 531 corresponding to the first pin hole 332.

Figure 23:
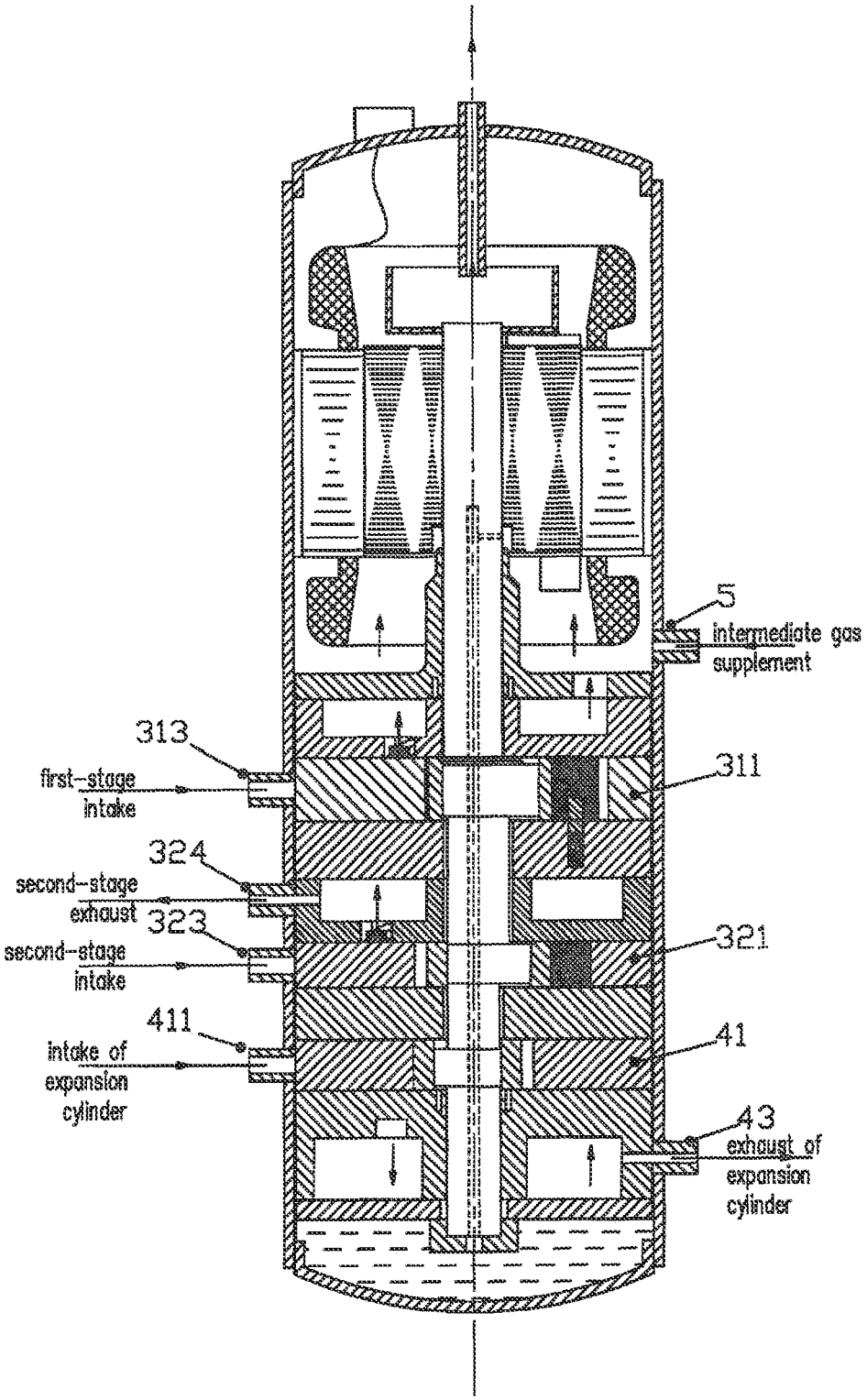
FIG. 23 is a schematic structure diagram of a sixteenth type of compressor according to some embodiments of the present disclosure.

With reference to FIG. 23, which shows a substantially same compressor structure as FIG. 22, except that, in the embodiment, the first-stage compression structure 31, the second-stage compression structure 32, and the expansion assembly 4 are provided in sequence in the axial direction away from the drive assembly 2.

Figure 24:
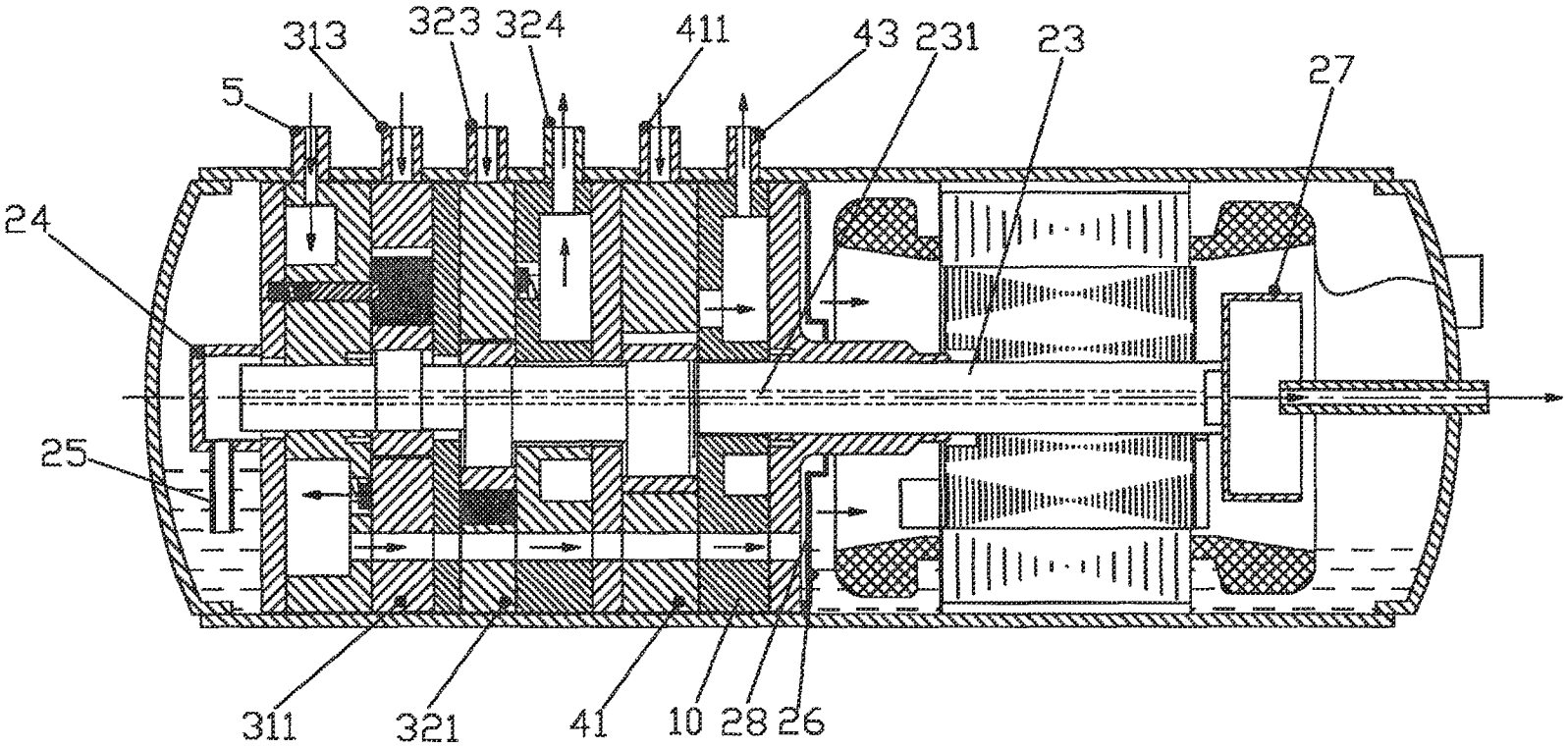
FIG. 24 is a schematic structure diagram of a seventeenth type of compressor according to some embodiments of the present disclosure.

With reference to FIG. 24, which shows a substantially same compressor structure as FIG. 18, except that, in the embodiment, the compressor is a horizontal compressor.

The compressor further includes a crankshaft. The crankshaft includes a center oil hole 231. One end of the crankshaft away from the drive assembly 2 is provided with an oil suction assembly which is configured to transport the oil in the housing to the center oil hole 231. The oil suction assembly can draw the lubricating oil stored in the housing of the compressor and then transport it to the center oil hole 231, thereby improving the fluidity of the lubricating oil and ensure the lubrication effect on various components of the compressor.

The oil suction assembly includes a sealing housing 24 and an oil suction pipe 25 in communication with a cavity of the sealing casing 24. The sealing housing 24 is provided at and seals a first end of the crankshaft, and the oil suction pipe 25 extends downward. In the embodiment, the oil suction pipe 25 is provided at a bottom portion of the sealing housing 24 and extends vertically downwards, so that the oil suction stroke of the oil suction pipe 25 is capable of being shortened, thereby improving the efficiency of the oil suction and ensuring effective circulation of lubricating oil.

The compressor further includes an upper flange. A pressure separation plate 26 is provided on a side of the upper flange facing the drive assembly 2, and a refrigerant passage 28 is provided on the pressure separation plate 26. The pressure separation plate 26 is capable of separating a pressure of a space where the pump body assembly is located from a pressure of a space where the drive assembly 2 is located, and ensure a pressure difference between the two sides, such that the lubricating oil at the bottom portion of the compressor is capable of being smoothly pressed into the oil suction pipe 25, and then is transported to the cavity where the drive assembly 2 is located through the center oil hole 231.

A second end of the crankshaft is provided with a fan 27. The fan 27 is configured to generate a negative pressure on the center oil hole 231, so that when the fan 27 rotates with the crankshaft 23, the lubricating oil at the other end of the center oil hole 231 is suctioned through the action of the negative pressure and is transported to the end where the fan 27 is located.

Figure 25:
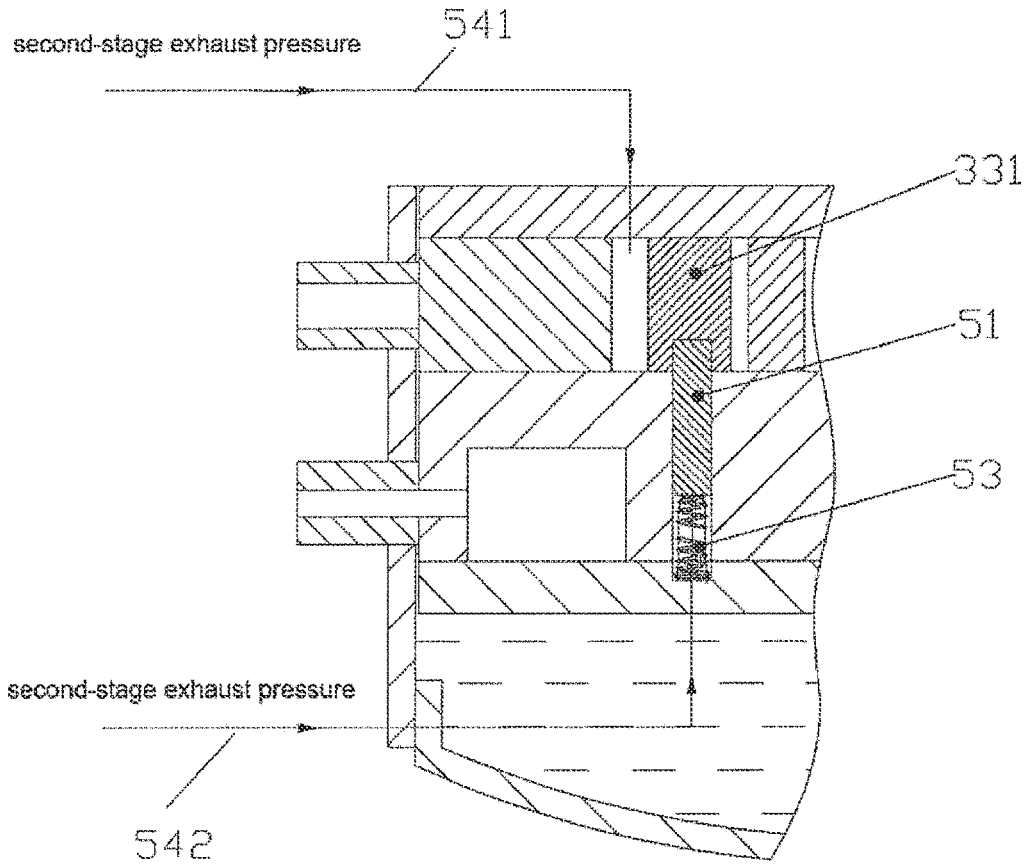
FIG. 25 is a first matching structure diagram of the twelfth type of compressor with a first-stage cylinder being unloaded according to some embodiments of the present disclosure.
Figure 26:
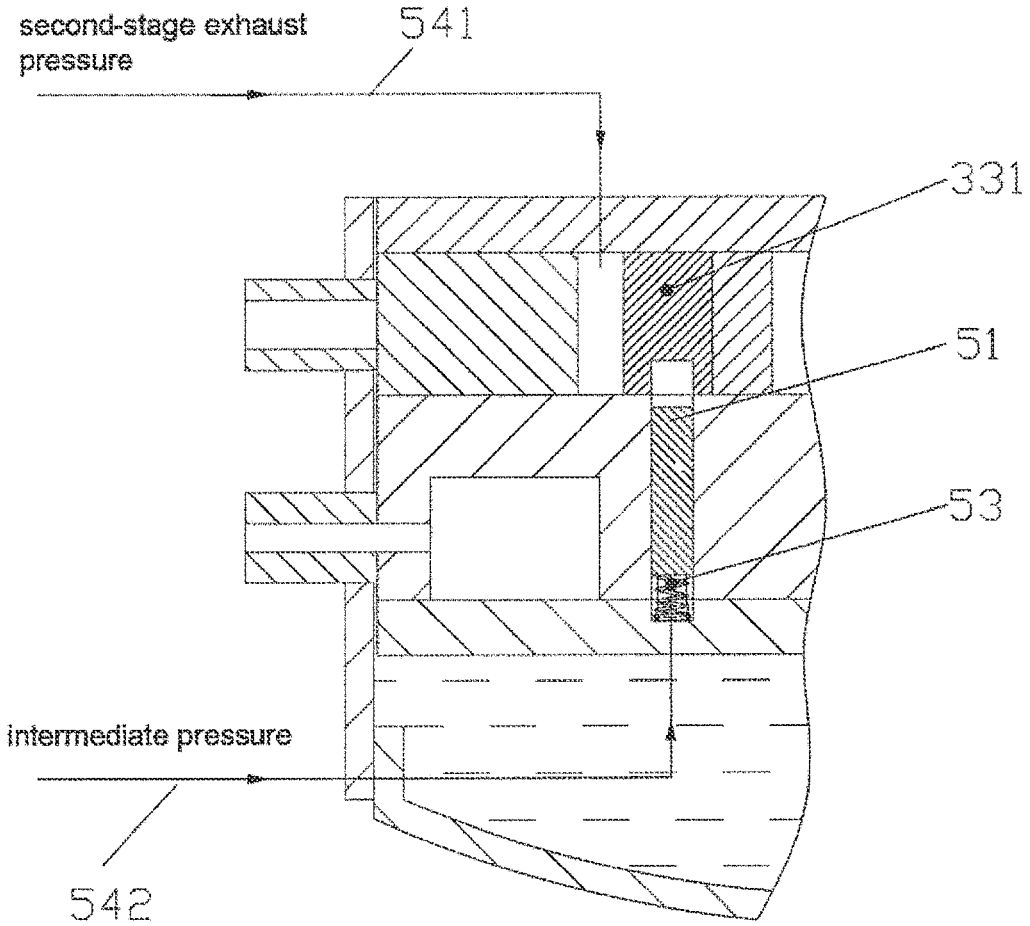
FIG. 26 is the first matching structure diagram of the twelfth type of compressor with the first-stage cylinder being loaded according to some embodiments of the present disclosure.

FIGS. 25 to 26 are schematic diagrams illustrating a high-pressure variable-volume control. When a tail portion and a head portion of the first pin 51 are both at the second-stage exhaust pressure, the first pin 51 moves upward and gets stuck at a lower portion of the first sliding van 331 under the action of the spring force due to the balance of the upper and lower pressures. This moment, the first sliding vane 331 is stuck and cannot reciprocate. When the tail portion of the first pin 51 is at the intake pressure or intermediate pressure, since the top portion of the first pin 51 is at a continuous high pressure, under the action of a force of the pressure difference, the first pin 51 falls off the first sliding vane 331, accordingly the first sliding vane 331 is capable of reciprocating in the first-stage cylinder 311 so as to contact the first-stage roller 312 to form a first-stage compression process.

Figure 27:
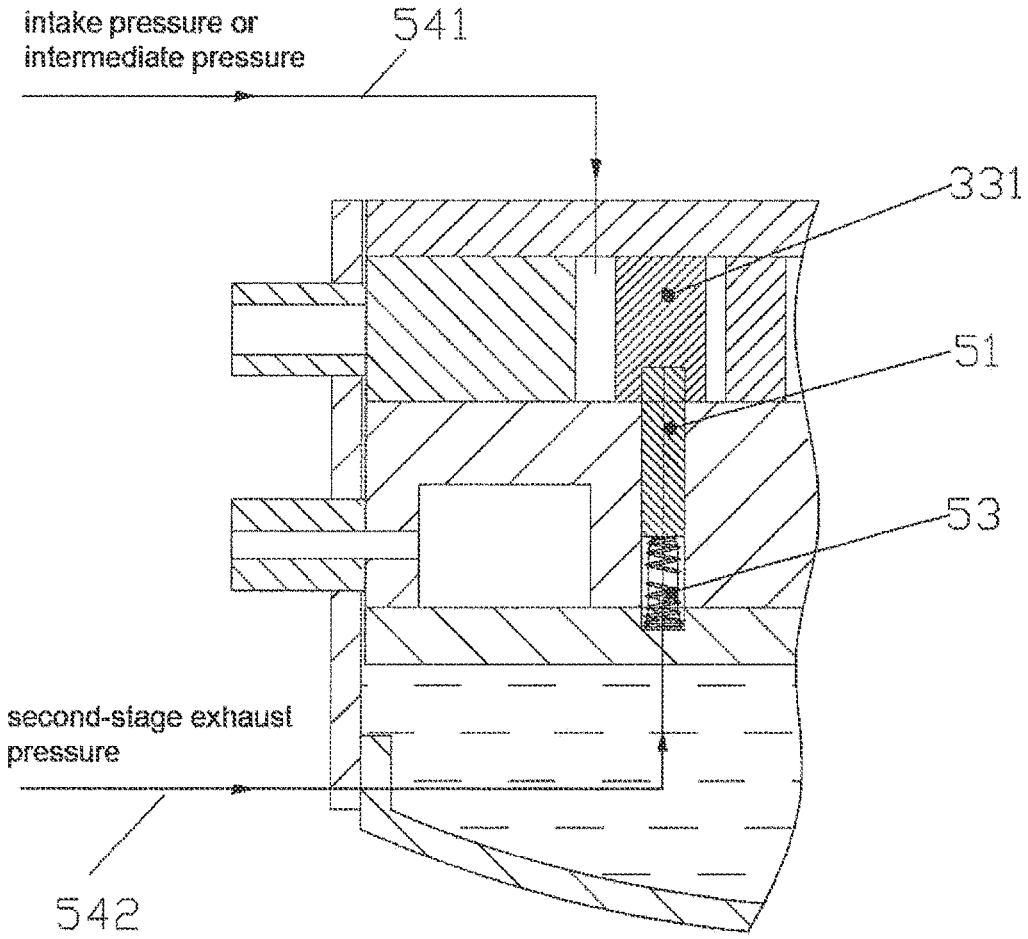
FIG. 27 is a second matching structure diagram of the twelfth type of compressor with the first-stage cylinder being unloaded according to the embodiment of the present disclosure.
Figure 28:
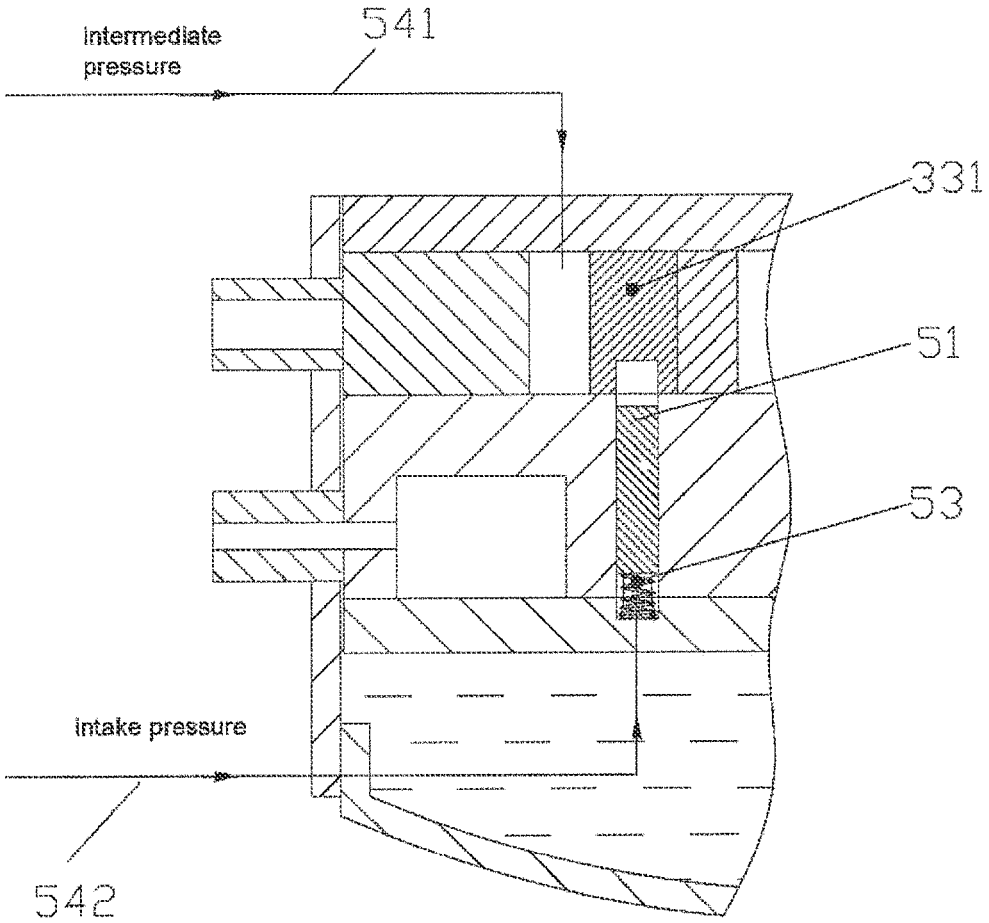
FIG. 28 is the second matching structure diagram of the twelfth type of compressor with the first-stage cylinder being loaded according to some embodiments of the present disclosure.

FIGS. 27-28 are schematic diagrams illustrating a low or intermediate pressure variable-volume control. When the head portion of the first pin 51 is at the intake pressure or intermediate pressure, and the tail portion of the first pin 51 is at the second-stage exhaust pressure, since the pressure at the tail portion is greater than the pressure at the head portion, the first pin 51 moves upward and gets stuck at the lower portion of the first sliding vane 331 under the action of the upward pressure difference and the spring force. This moment, the first sliding vane 331 is stuck and cannot reciprocate. When the head portion of the first pin 51 is at the intermediate pressure and the tail portion is at the intake pressure, the first pin 51 falls off the first sliding vane 331 under the action of the downward pressure difference, accordingly the first sliding vane 331 is capable of reciprocating in the first-stage cylinder 311 so as to contact the first-stage roller 312 to form a first-stage compression process.

Figure 29:
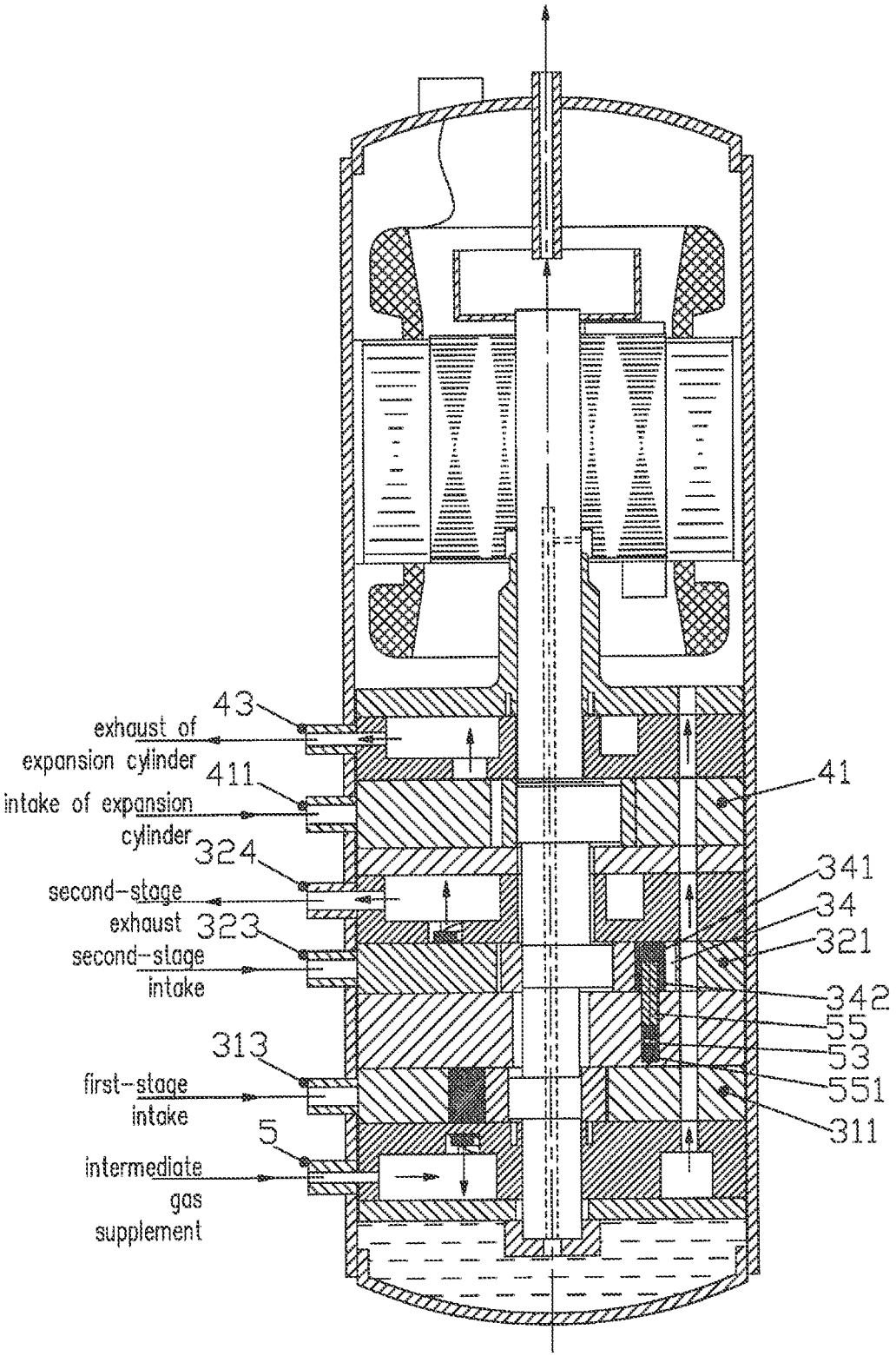
FIG. 29 is a schematic structure diagram of an eighteenth type of compressor according to some embodiments of the present disclosure.
Figure 30:
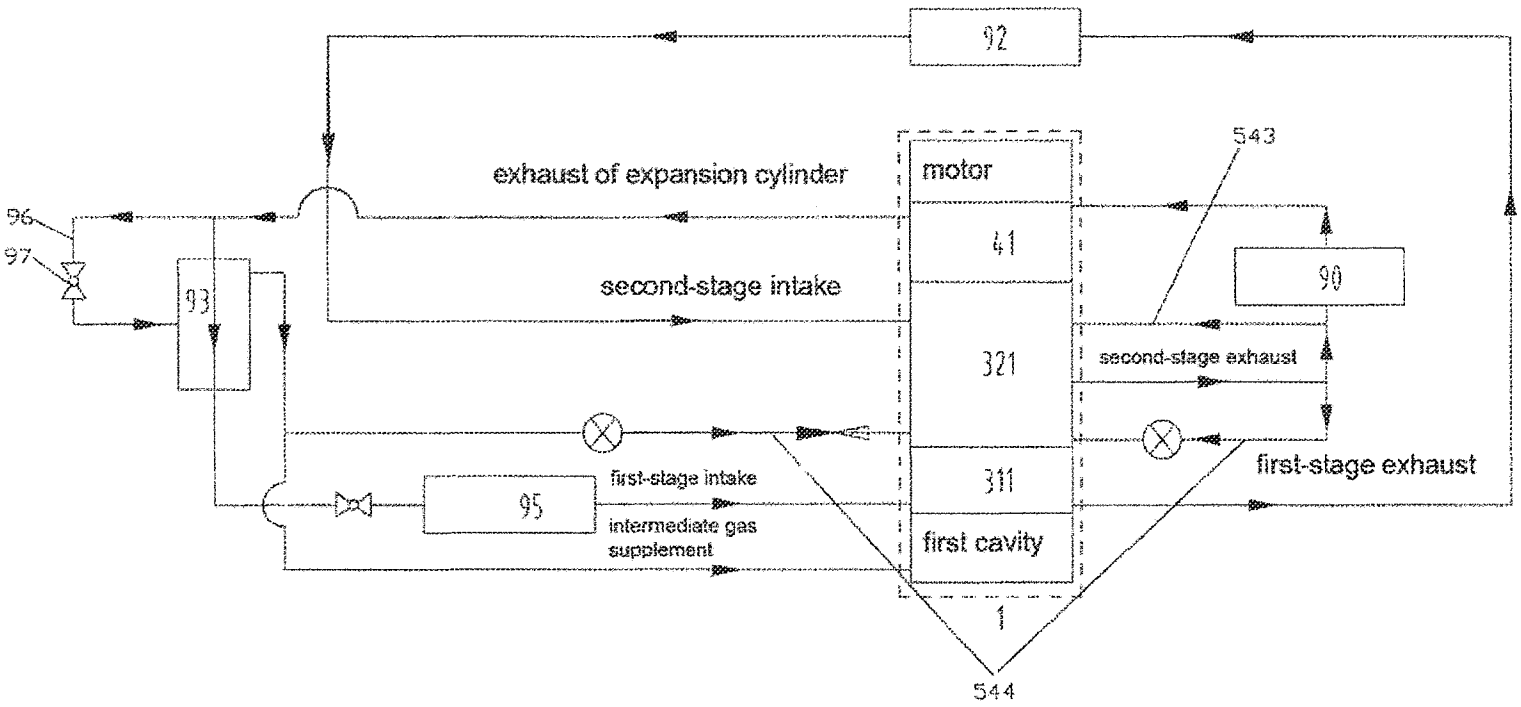
FIG. 30 is a simplified structure diagram of a sixth type of refrigeration cycle device according to some embodiments of the present disclosure.

With reference to FIGS. 29 and 30, which are schematic structure diagrams of an eighteenth type of compressor provided by embodiments of the present disclosure.

In the embodiment, the second-stage compression structure 32 includes: a second-stage cylinder 321, a second-stage roller 322 and a second-stage cavity. The second-stage cylinder 321 is provided with a second gas inlet and a second gas outlet; the second gas inlet draws the first-stage refrigerant into the second-stage cylinder 321. The second-stage roller 322 is provided in the second-stage cylinder 321, and the second-stage roller 322 is driven by the drive assembly 2 to cooperate with the second-stage cylinder 321 to perform the second-stage compression on the first-stage refrigerant. The second-stage cavity is in communication with the second-stage gas outlet, such that the refrigerant compressed through the second-stage compression is discharged into the second-stage cavity. A second sliding groove 34 is provided in the second-stage cylinder 321; a second sliding vane 341 is slidably provided in the second sliding groove 34; and the variable-volume assembly 50 controls loading or unloading of the second-stage compression structure 32 by controlling the working state of the second sliding vane 341.

The variable-volume assembly 50 further includes a second pin 55. A second mounting plate is provided on a side of the second-stage cylinder 321; the second mounting plate is provided with a second guide groove 551; and the second pin 55 is slidably provided in the second guide groove 551. A second pin hole 342 is provided on a side of the second sliding vane 341 facing the second mounting plate. The second pin 55 is capable of being switched between a first position at which the second pin 55 is stuck in the second pin hole 342 and a second position at which the second pin 55 is out of the second pin hole 342.

The second pin hole 342 is in communication with a side of the second sliding groove 34 away from the second-stage roller 322; the second sliding groove 34 is supplied with the refrigerant with the first pressure; and a side of the second guide groove 551 away from the second pin hole 342 is supplied with the refrigerant with the second pressure. The first pressure and the second pressure can be adjusted such that the second pin 55 can be switched between the first position and the second position.

The variable-volume assembly 50 further includes an elastic member 53 which is provided at one end of the second guide groove 551 away from the second pin hole 342. The second pin 55 is in contact with the elastic member 53; and the elastic member 53 provides the second pin 55 with an elastic force for moving the second pin 55 towards the pin holes 342.

The first pressure is the second-stage exhaust pressure; and the second pressure is capable of being switched among the second-stage exhaust pressure, the intake pressure and the intermediate pressure. Alternatively, the first pressure is the intermediate pressure; and the second pressure is capable of being switched among the second-stage exhaust pressure, the intermediate pressure and the intake pressure.

The expansion assembly 4, the first-stage compression structure 31, and the second-stage compression structure 32 are sequentially provided in the axial direction away from the drive assembly 2; or, the first-stage compression structure 31, the expansion assembly 4, and the second-stage compression structure 32 are sequentially provided in the axial direction away from the drive assembly 2. A lower flange 15 is provided on a side of the second-stage compression structure 32 away from the drive assembly 2; and the lower flange 15 is a second mounting plate.

A lower cover plate 14 is provided on a side of the lower flange 15 away from the second-stage compression structure 32; and the lower cover plate 14 is provide with a mounting groove 531 corresponding to the second pin hole 342.

The expansion assembly 4, the second-stage compression structure 32, and the first-stage compression structure 31 are sequentially provided in the axial direction away from the drive assembly 2; or, the first-stage compression structure 31, the second-stage compression structure 32 and the expansion assembly 4 are sequentially provided in the axial direction away from the drive assembly 2. A lower partition plate 16 is provided on a side of the second-stage compression structure 32 away from the drive assembly 2; and the lower partition plate 16 is a second mounting plate.

The second-stage compression structure 32, the expansion assembly 4, and the first-stage compression structure 31 are sequentially provided in the axial direction away from the drive assembly 2; or, the second-stage compression structure 32, the first-stage compression structure 31 and the expansion assembly 4 are sequentially provided in the axial direction away from the drive assembly 2. An upper partition plate 18 is provided on a side of the second-stage compression structure 32 away from the drive assembly 2; and the upper partition plate 18 is a second mounting plate.

A middle partition plate 17 is provided on a side of the upper partition plate 18 away from the second-stage compression structure 32; and the middle partition plate 17 is provided with a mounting groove 531 corresponding to the second pin hole 342.

In an optional embodiment, the compressor further includes a gas supplement inlet. The variable-volume assembly 50 further includes a third pipeline 543 and a fourth pipeline 544. A first end of the third pipeline 543 is in communication with the second gas outlet; a second end of the third pipeline 543 is in communication with a side of the second sliding groove 34 away from the second-stage roller 322; a first end of the fourth pipeline 544 is selectively in communication with at least one of the first gas inlet 313 and the gas supplement inlet as well as the second gas outlet; a second end of the fourth pipeline 544 is in communication with a side of the second guide groove 551 away from the second pin hole 342.

In another optional embodiment, the first end of the third pipeline 543 is in communication with the gas supplement inlet; and the second end of the third pipeline 543 is in communication with the side of the second sliding groove 34 away from the second-stage roller 322. The first end of the second pipeline 542 is selectively in communication with at least one of the gas supplement inlet and the second gas outlet as well as the first gas inlet 313; the second end of the fourth pipeline 544 is in communication with the side of the second guide groove 551 away from the second pin hole 342.

Figure 31:
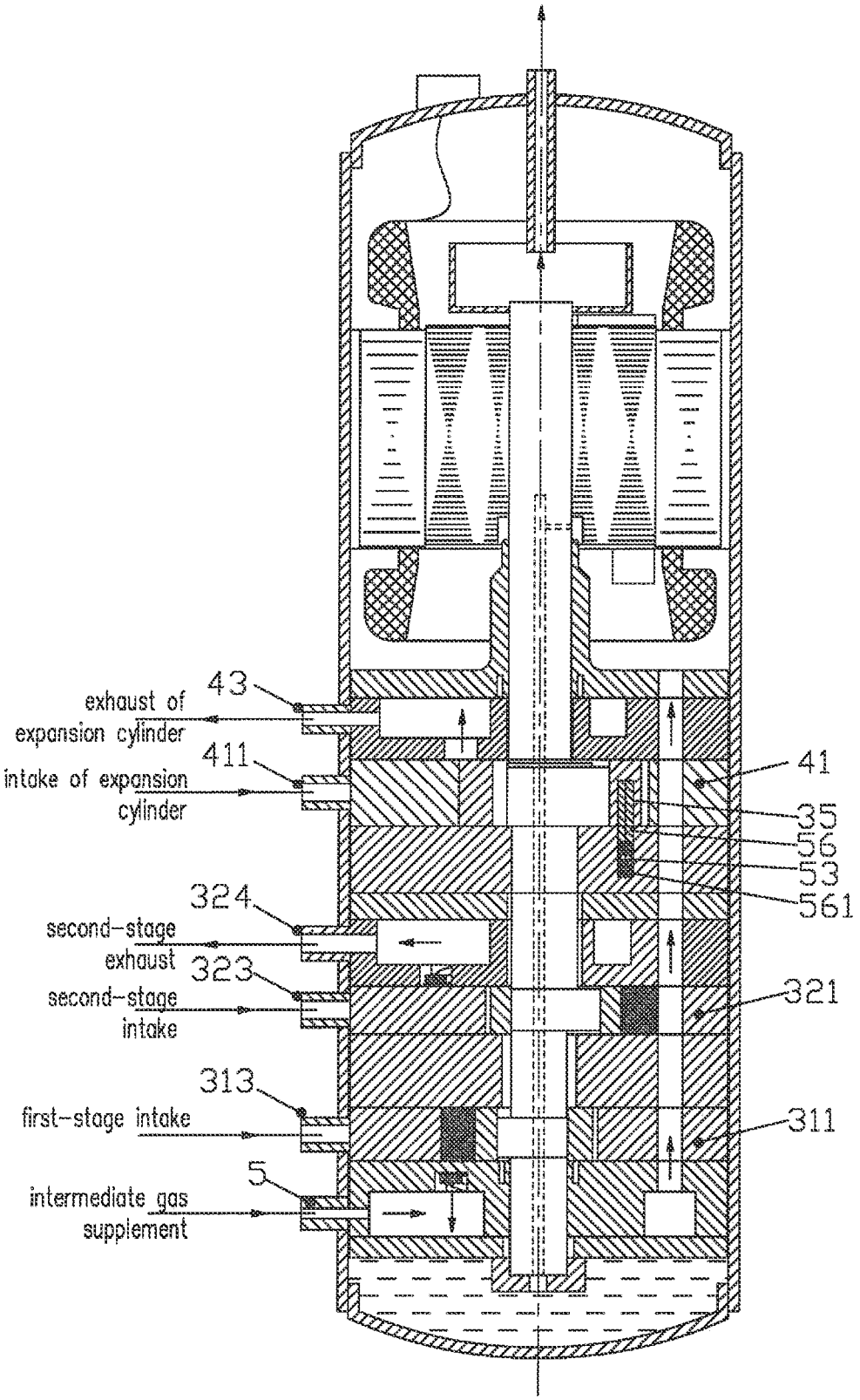
FIG. 31 is a schematic structure diagram of a nineteenth type of compressor according to some embodiments of the present disclosure.
Figure 32:
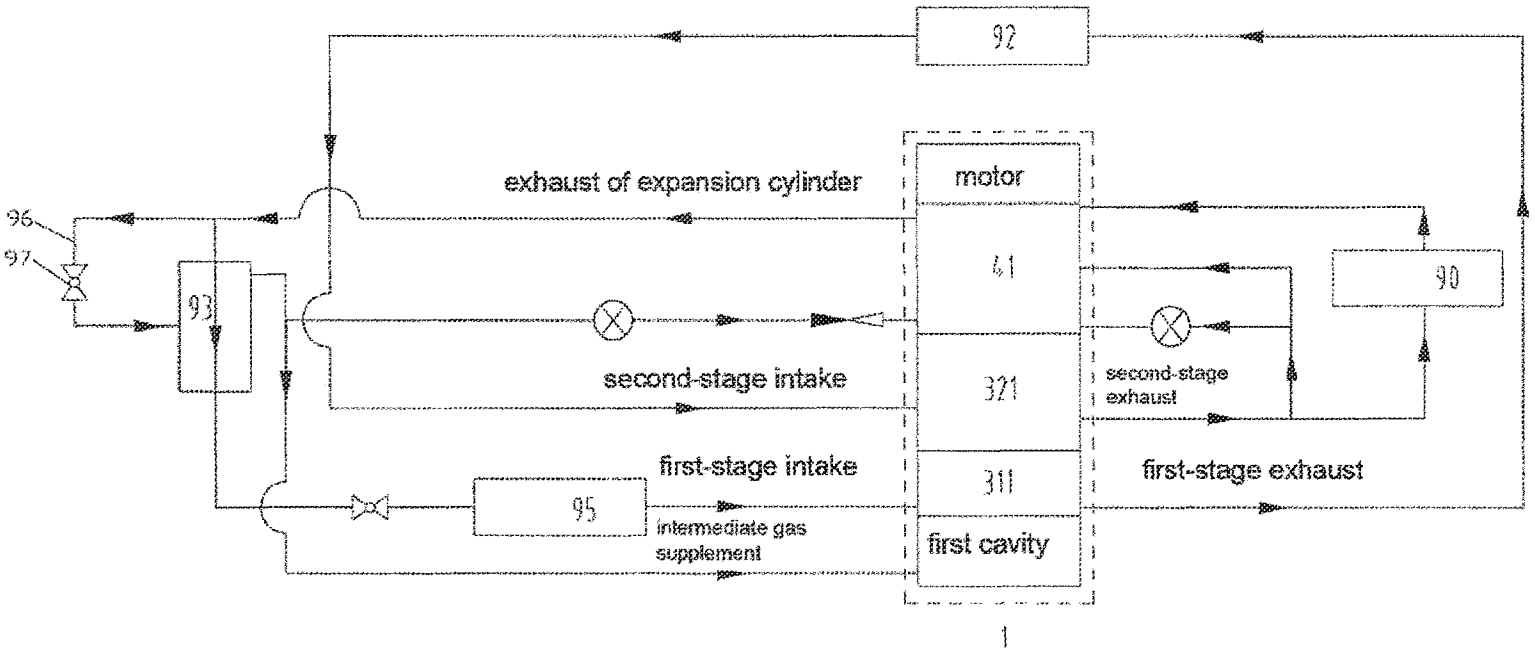
FIG. 32 is a simplified structure diagram of a seventh type of refrigeration cycle device according to some embodiments of the present disclosure.

With reference to FIGS. 31 and 32, according to schematic structure diagrams of a nineteenth type of compressor provided by embodiments of the present disclosure, the variable-volume assembly 50 is configured to control the loading or unloading of the expansion assembly 4.

The expansion assembly 4 includes: a first expansion cylinder 41 and a first roller 42. The first expansion cylinder 41 is provided with a third gas inlet and a third gas outlet; the first roller 42 is arranged in the first expansion cylinder 41. The third gas inlet is configured to draw refrigerant compressed through multi-stage compression of the compression assembly into the first expansion cylinder 41; the first roller 42 is configured to expand the refrigerant drawn into the first expansion cylinder 41 under drive of the drive assembly 2; the expanded refrigerant is discharged from the third gas outlet. When the compressor is connected to the first cooler 90, the third gas inlet is connected to the outlet of the first cooler 90; the variable-volume assembly 50 controls loading or unloading of the expansion assembly 4 by controlling the working state of the first roller 42.

The variable-volume assembly 50 further includes a third pin 56. A third mounting plate is provided on a side of the first roller 42; a third guide groove 561 is provided on the third mounting plate; and the third pin 56 is slidably provided in the third guide groove 561. A third pin hole 35 is provided on a side of the first roller 42 facing the third mounting plate. The third pin 56 is capable of being switched between a position at which the third pin 56 is stuck in the third pin hole 35 and a position at which the third pin 56 is out of the third pin hole 35.

The third pin hole 35 is supplied with a refrigerant with a first pressure; a side of the third guide groove 561 away from the third pin hole 35 is supplied with a refrigerant with a second pressure. The first pressure and the second pressure can be adjusted to enable the third pin 56 to be switched between the first position and the second position.

The variable-volume assembly 50 further includes an elastic member 53 which is provided at one end of the third guide groove 561 away from the third pin hole 35; the third pin 56 is in contact with the elastic member 53; and the elastic member 53 provides the third pin 56 with an elastic force for moving the third pin 56 towards the three pin hole 35.

The first pressure is the second-stage exhaust pressure; the second pressure is capable of being switched among the second-stage exhaust pressure, the intake pressure and the intermediate pressure. Alternatively, the first pressure is the intermediate pressure; the second pressure is capable of being switched among the second-stage exhaust pressure, the intermediate pressure and the intake pressure.

The second-stage compression structure 32, the first-stage compression structure 31 and the expansion assembly 4 are sequentially provided in the axial direction away from the drive assembly 2; or, the first-stage compression structure 31, the second-stage compression structure 32 and the expansion assembly 4 are sequentially provided in the axial direction away from the drive assembly 2. A lower flange 15 is provided on a side of the expansion assembly 4 away from the drive assembly 2; and the lower flange 15 is a third mounting plate.

A lower cover plate 14 is provided on a side of the lower flange 15 away from the expansion assembly 4; and the lower cover plate 14 is provided with a mounting groove 531 corresponding to the third pin hole 35.

The second-stage compression structure 32, the expansion assembly 4, and the first-stage compression structure 31 are sequentially provided in the axial direction away from the drive assembly 2; or, the first-stage compression structure 31, the expansion assembly 4, and the second-stage compression structure 32 are sequentially provided in the axial direction away from the drive assembly 2. A lower partition plate 16 is provided on a side of the expansion assembly 4 away from the drive assembly 2; and the lower partition plate 16 is a third mounting plate.

The expansion assembly 4, the second-stage compression structure 32 and the first-stage compression structure 31 are sequentially provided in the axial direction away from the drive assembly 2; or, the expansion assembly 4, the first-stage compression structure 31 and the second-stage compression structure 32 are sequentially provided in the axial direction away from the drive assembly 2. An upper partition plate 18 is provided on a side of the expansion assembly 4 away from the drive assembly 2; and the upper partition plate 18 is a third mounting plate.

A middle partition plate 17 is provided on a side of the upper partition plate 18 away from the expansion assembly 4; and the middle partition plate 17 is provided with a mounting groove 531 corresponding to the third pin hole 35.

In an optional embodiment, the compressor further includes a gas return inlet and a gas supplement inlet. The variable-volume assembly 50 further includes a fifth pipeline 545 and a sixth pipeline 546. A first end of the fifth pipeline 545 is in communication with the gas outlet of the second-stage compression structure; a second end of the fifth pipeline 545 is in communication with the third pin hole 35. A first end of the sixth pipeline 546 is selectively in communication with at least one of the gas return inlet and the gas supplement inlet as well as the gas outlet of the second-stage compression structure; a second end of the sixth pipeline 546 is in communication with a side of the third guide groove 561 away from the third pin hole 35.

In another alternative embodiment, the first end of the fifth pipeline 545 is in communication with the gas supplement inlet; the second end of the fifth pipeline 545 is in communication with the third pin hole 35; the first end of the sixth pipeline 546 is selectively in communication with at least one of the gas supplement inlet and the gas outlet of the second-stage compression structure as well as the gas return inlet; the second end of the sixth pipeline 546 is in communication with a side of the third guide groove 561 away from the third pin hole 35.

Figure 33:
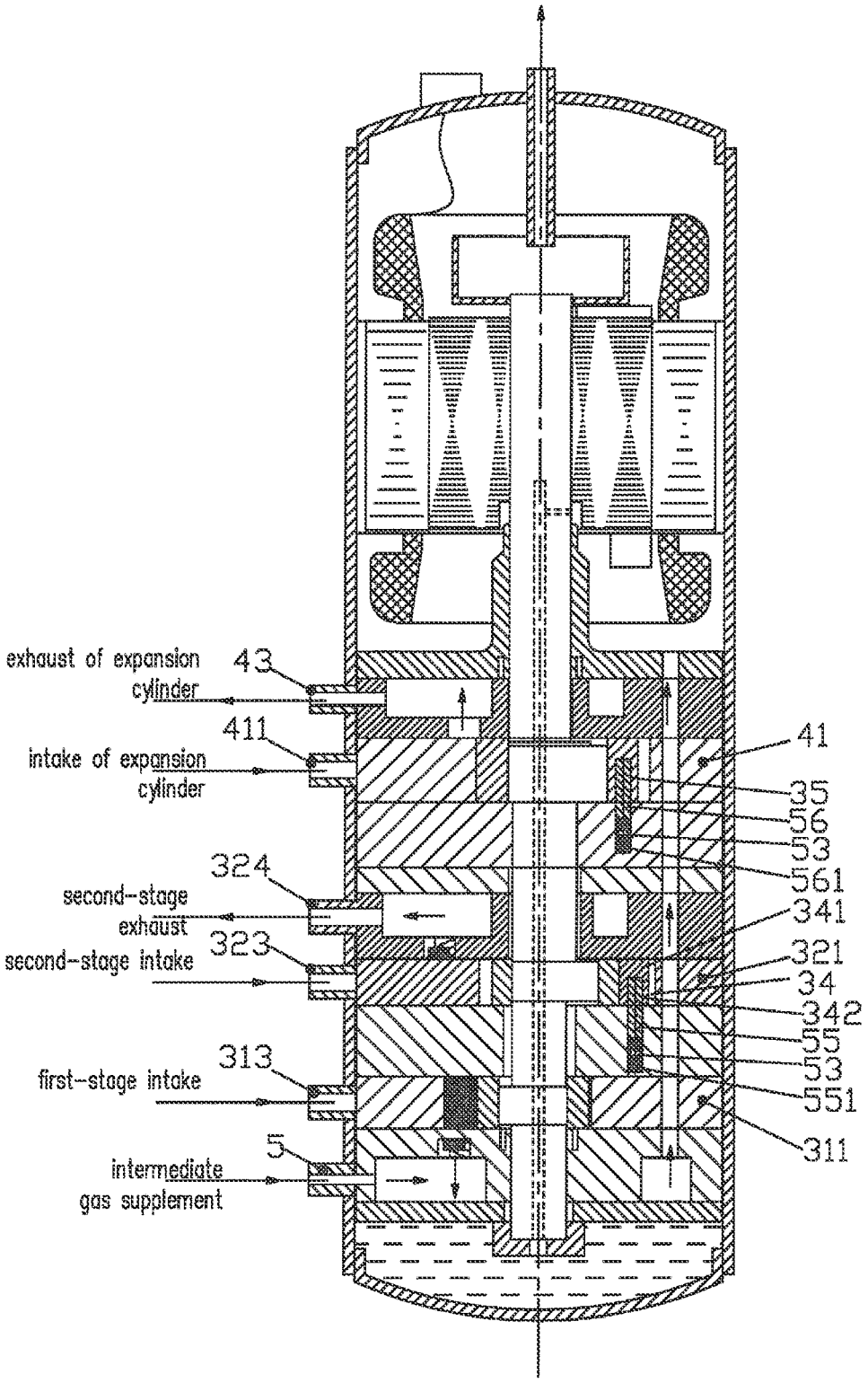
FIG. 33 is a schematic structure diagram of a twentieth type of compressor according to some embodiments of the present disclosure.
Figure 34:
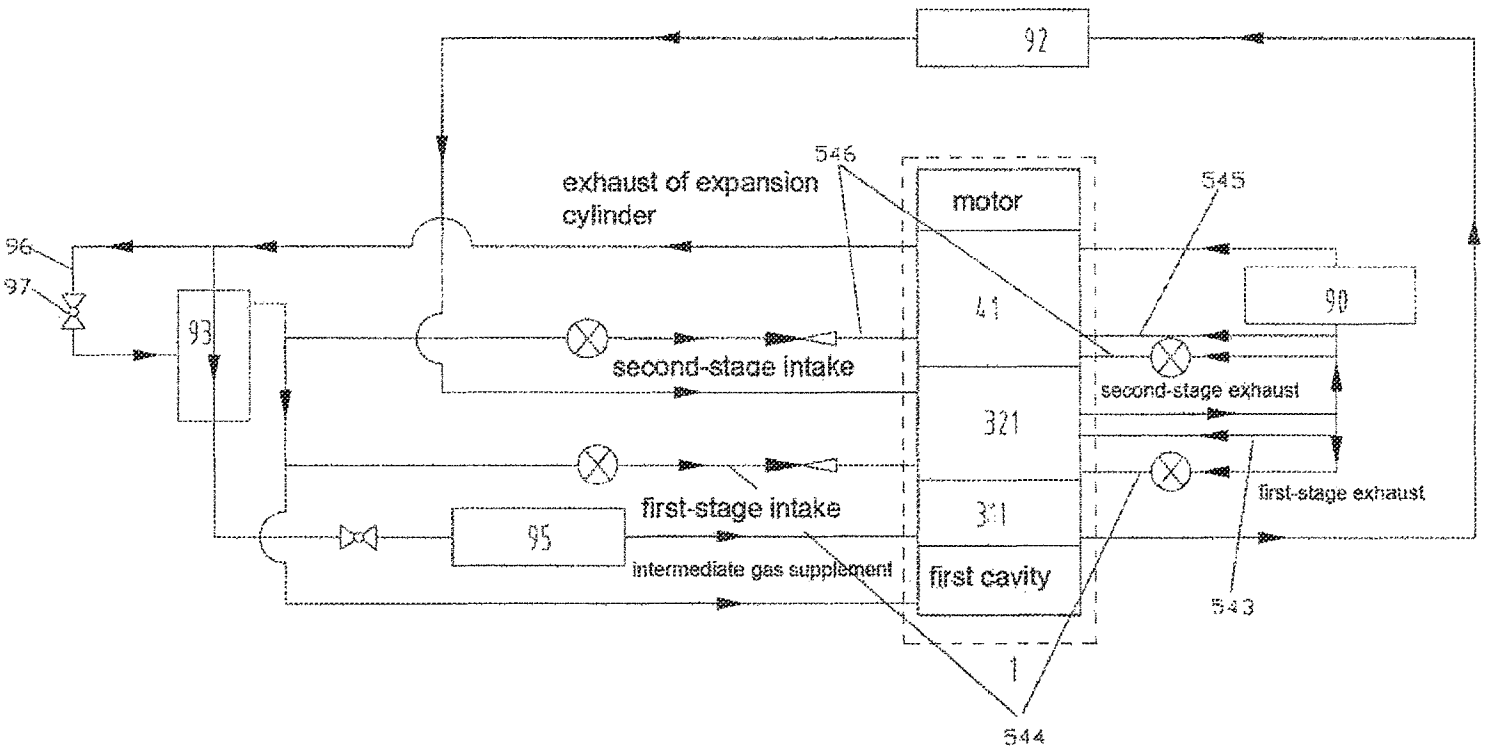
FIG. 34 is a simplified structure diagram of an eighth type of refrigeration cycle device according to some embodiments of the present disclosure.

With reference to FIGS. 33 and 34, which show a twentieth type of compressor according to embodiments of the present disclosure substantially the same as the compressor in FIG. 29, except that, in the embodiment, not only the second-stage compressor has a variable volume, but the expansion assembly 4 also has a variable volume, that is, what is achieved by the embodiment is "two-stage+enthalpy increase+variable-volume second-stage cylinder+variable-volume expansion cylinder"; the second-stage cylinder 321 and the first expansion cylinder 41 are both variable-volume cylinders.

Figure 35:
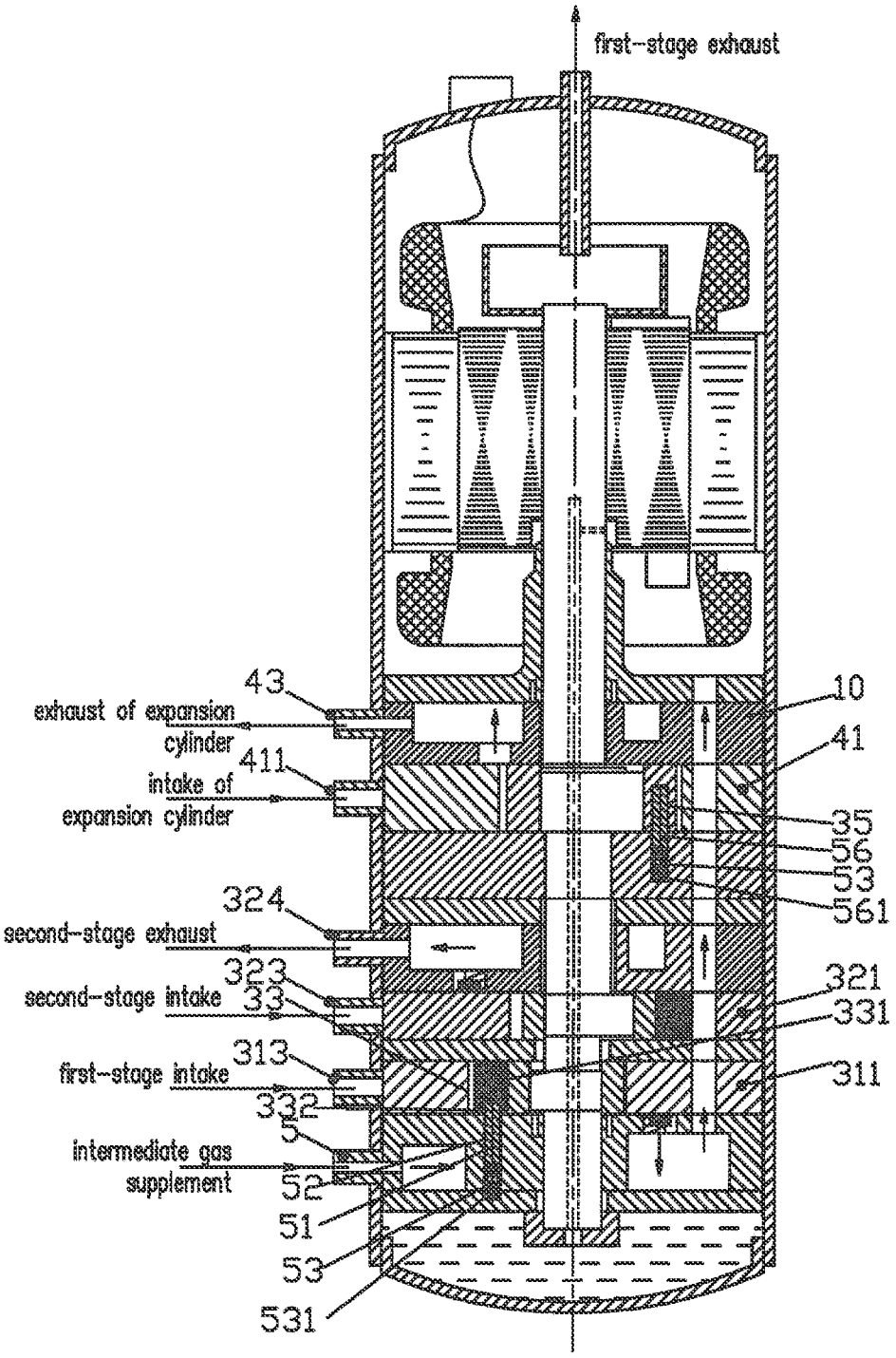
FIG. 35 is a schematic structure diagram of a twenty-first type of compressor according to some embodiments of the present disclosure.
Figure 36:
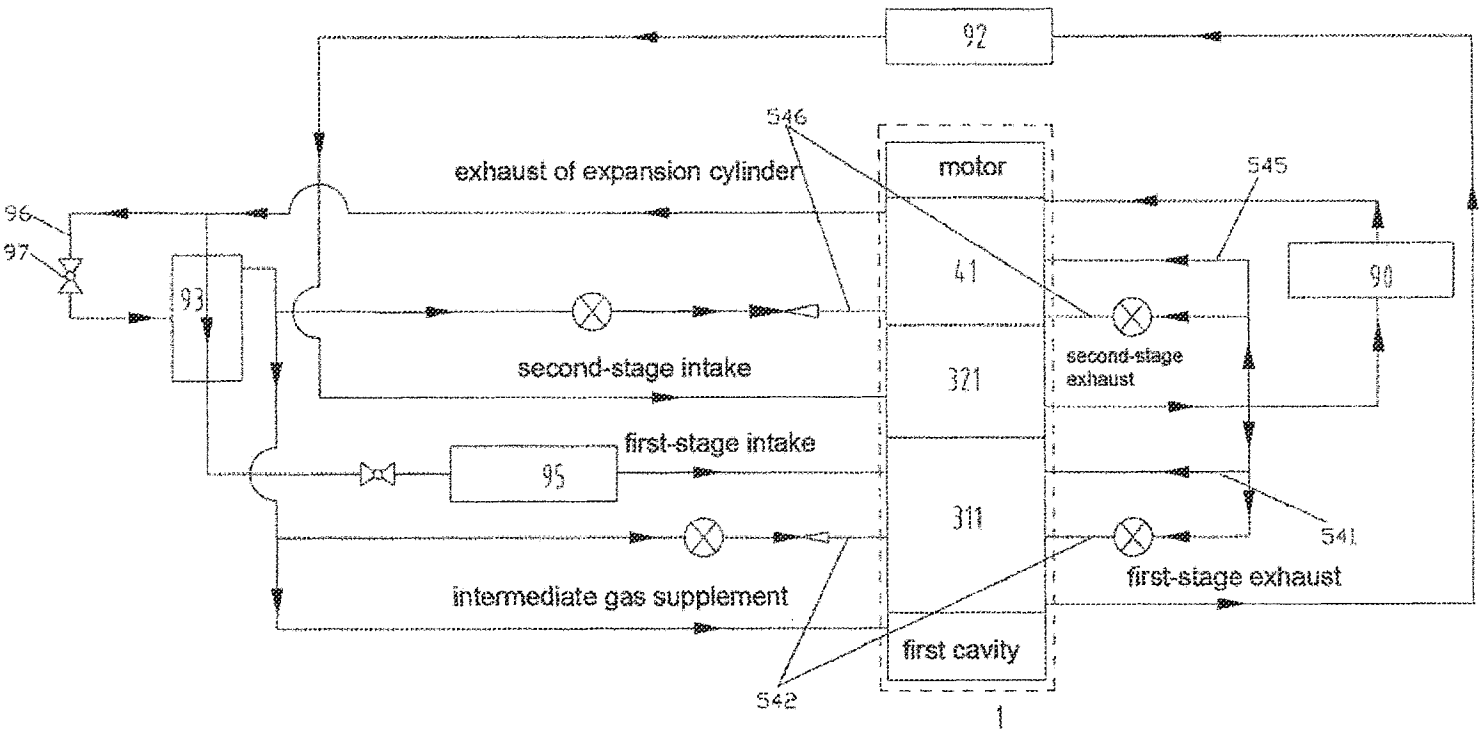
FIG. 36 is a simplified structure diagram of a ninth type of refrigeration cycle device according to some embodiments of the present disclosure.

With reference to FIGS. 35 and 36, which show a twenty-first type of compressor according to embodiments of the present disclosure substantially the same as the compressor in FIG. 17, except that, in the embodiment, not only the first-stage compression structure 31 has a variable volume, but the expansion assembly 4 also has a variable volume, that is, what is achieved by the embodiment is "two-stage+enthalpy increase+variable-volume first-stage cylinder+variable-volume expansion cylinder"; the first-stage cylinder 311 and first expansion cylinder 41 are both variable-volume cylinders.

Figure 37:
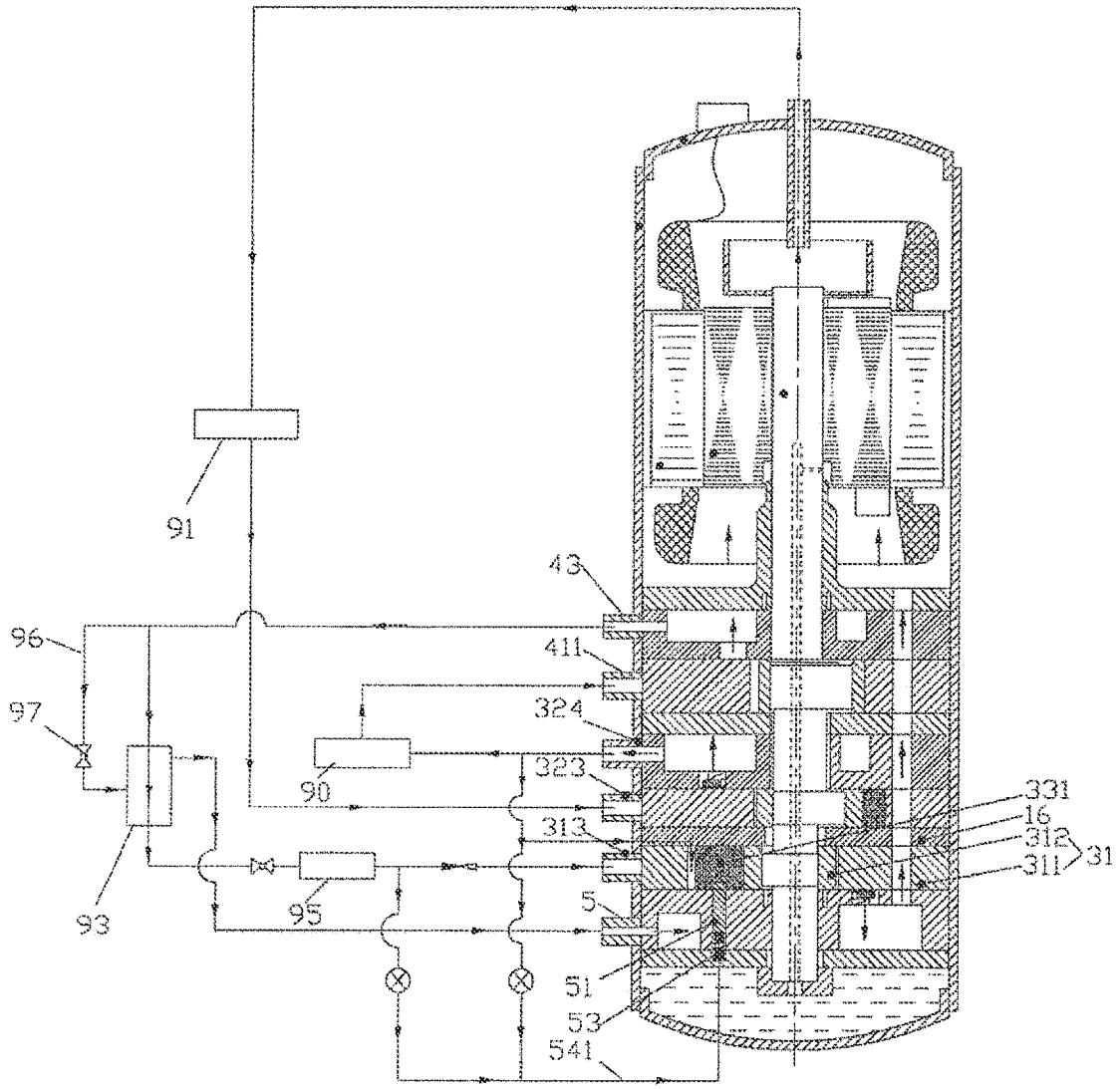
FIG. 37 is a schematic structure diagram of a tenth type of refrigeration cycle device according to some embodiments of the present disclosure.
Figure 38:
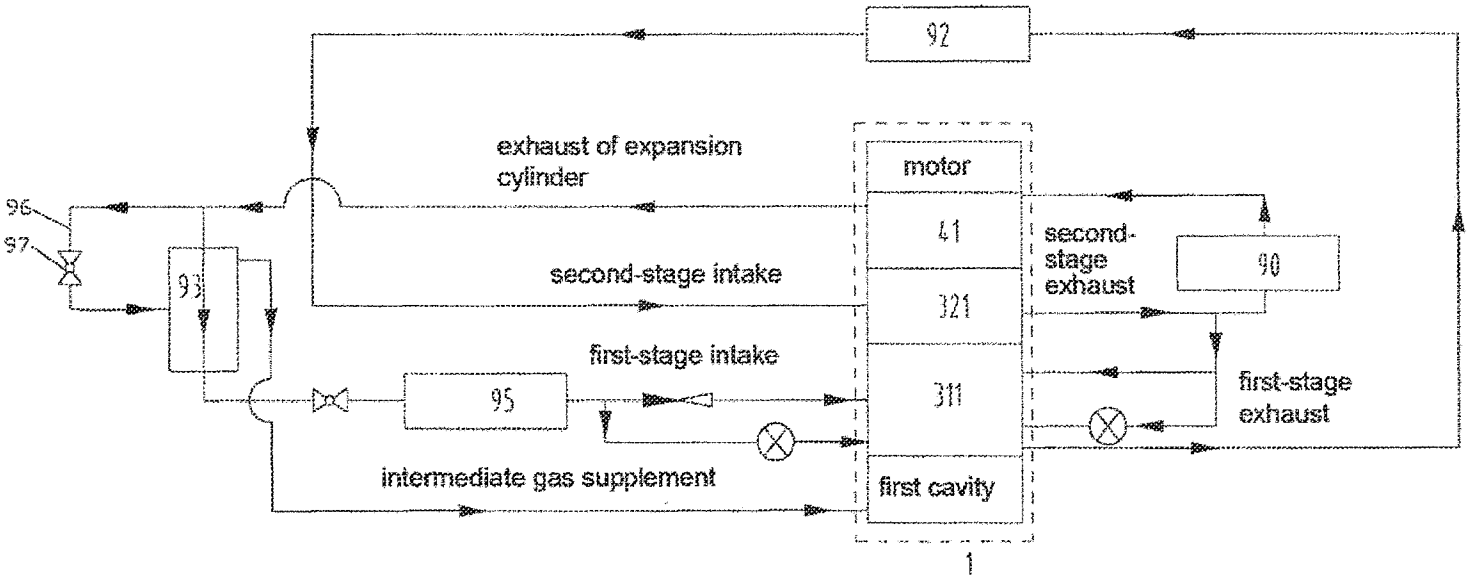
FIG. 38 is a simplified structure diagram of the refrigeration cycle device shown in FIG. 37.

With reference to FIGS. 37 and 38, which are schematic structure diagrams of a tenth type of refrigeration cycle device according to embodiments of the present disclosure. The compressor structure of the refrigeration cycle device is substantially the same as that in FIG. 17, except that, in the embodiment, the pressure at the tail end of the first pin 51 is switched between the intake pressure and the second-stage exhaust pressure.

In the embodiment, when the pressure at the tail end of the first pin 51 is the intake pressure, the first pin 51 is separated from the first sliding vane 331 and contacts the first-stage roller 312 under the action of the pressure difference to form an intake compression process. When the pressure at the tail end of the first pin 51 is the second-stage exhaust pressure, this moment since the there is a balance between the pressures at the top end and at the tail end of the first pin 51, the first pin 51 is pushed up and stuck in the first sliding vane 331 under the spring force; since the first sliding vane 331 cannot reciprocate, the crankshaft 23 idles in the first-stage cylinder 311, and the intake compression process cannot be formed.

Figure 39:
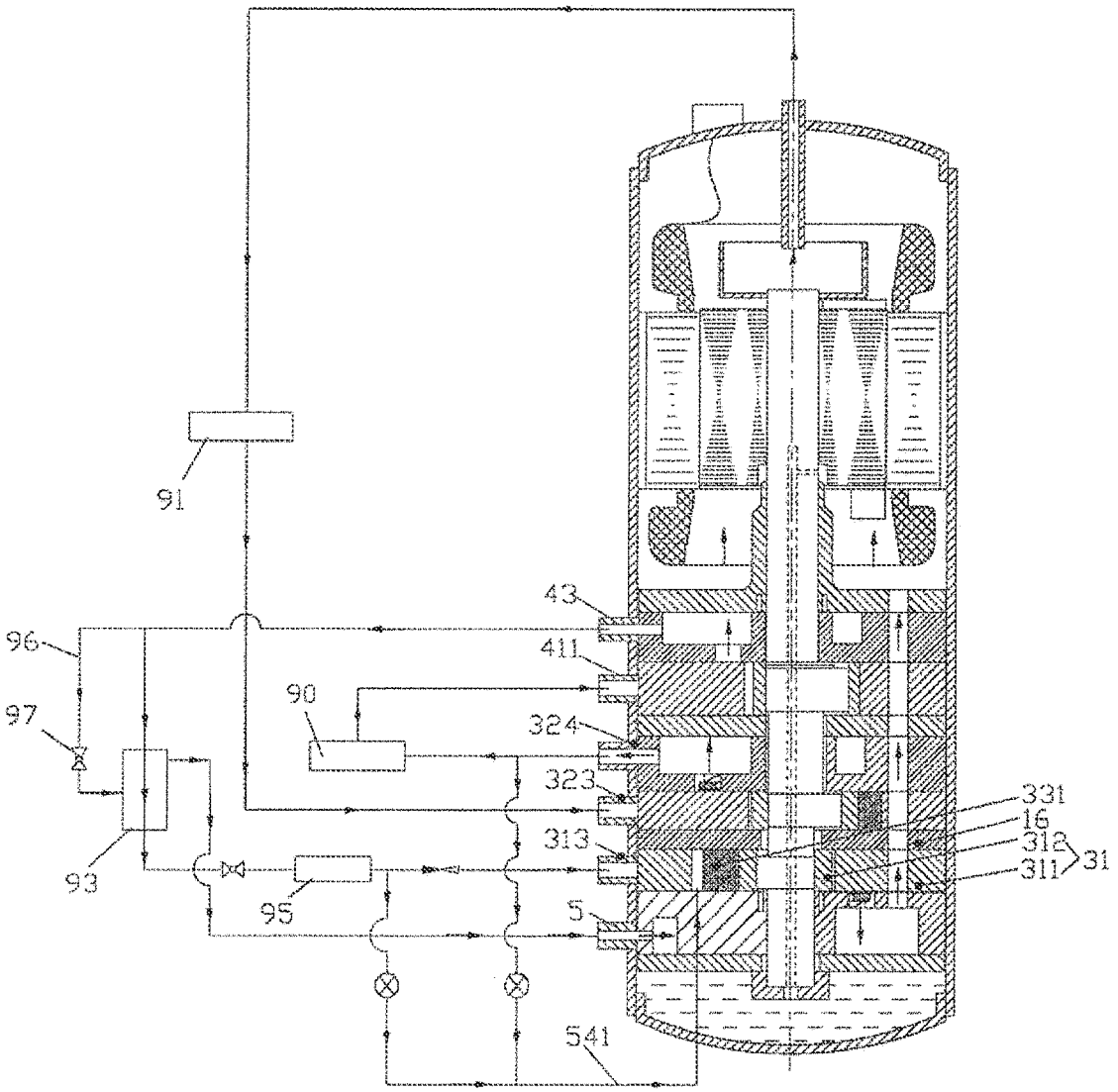
FIG. 39 is a schematic structure diagram of an eleventh type of refrigeration cycle device according to some embodiments of the present disclosure.

With reference to FIG. 39, which is a schematic structure diagram of an eleventh type of refrigeration cycle device according to some embodiments of the present disclosure. The compressor structure of the refrigeration cycle device is substantially the same as that of FIG. 17, except that, in the embodiment, the variable-volume assembly 50 is configured to supply the refrigerant with the first pressure to a side of the first sliding groove 33 away from the first-stage roller 312; and the first pressure is the intake pressure or the second-stage exhaust pressure.

In the embodiment, the control of the loading and unloading of the first-stage compression structure 31 is implemented by changing the pressure of the refrigerant on the side of the first sliding groove 33 away from the first-stage roller 312.

The compressor further includes a gas supplement inlet. The variable-volume assembly 50 further includes a first pipeline 541. A first end of the first pipeline 541 is selectively in communication with at least one of the gas supplement inlet and the gas outlet of the second-stage compression structure as well as the first gas inlet 313; a second end of the first pipeline 541 is in communication with a side of the first sliding groove 33 away from the first-stage roller 312.

When the intake pressure is applied to the tail portion of the first sliding vane 331, there is no pressure difference between the head portion and the tail portion of the first sliding vane 331 due to the first-stage pressure in the first-stage cylinder 311. When the first sliding vane 331 is separated from the first-stage roller 312 under the action of a centrifugal force, the first sliding vane 331 cannot reciprocate because there is no pressure difference; accordingly, the intake compression process cannot be formed. The switching between the above two modes can form a variable-volume adjustment of the compressor.

Figure 40:
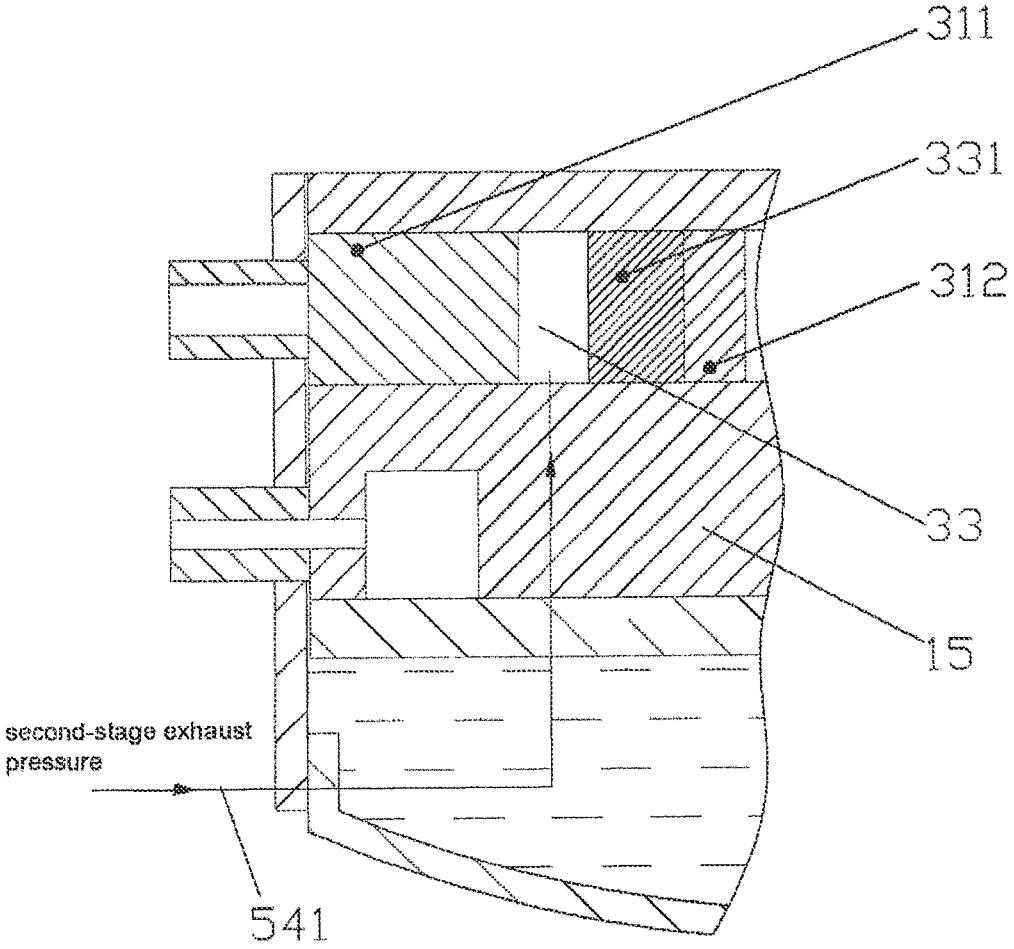
FIG. 40 is a partial cross-sectional structure diagram of the refrigeration cycle device shown in FIG. 39 with the first-stage cylinder being loaded.
Figure 41:
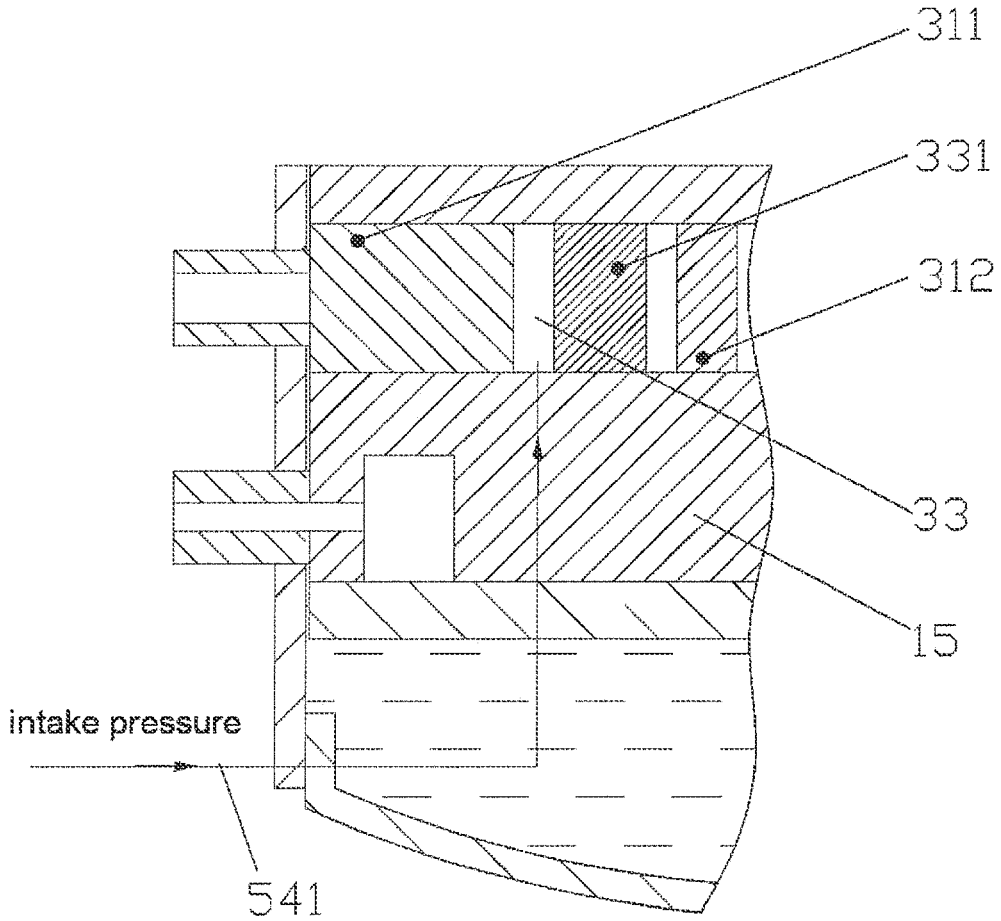
FIG. 41 is a partial cross-sectional structure diagram of the refrigeration cycle device shown in FIG. 39 with the first-stage cylinder being unloaded.

With reference to FIGS. 40 and 41, which are schematic diagrams illustrating that the first sliding vane 331 contacts and separates from the first-stage roller 312 by using a switching mode of the second-stage exhaust pressure and the intake pressure. Such mode differs from that shown in FIG. 17 in that there is no first pin 51 and a spring.

When the second-stage exhaust pressure is applied to the tail portion of the first sliding vane 331, since the first-stage pressure is in the first-stage cylinder 311 and is the same as a pressure at the head portion of the first sliding vane 331, the pressure at the tail portion of the first sliding vane 331 away from the first-stage roller is much greater than the pressure at the head portion. The first sliding vane 331 is in close contact with the first-stage roller 312 under the action of the pressure difference, accordingly an intake compression process can be formed.

Embodiment VI

As shown in FIGS. 1, 12 to 15, 17 to 18, 30, 32, 34 and 36 to 39, a refrigeration cycle device of the embodiment includes the compressor 1 of any one of the above embodiments.

Specifically, the refrigeration cycle device further includes an evaporator 95. An inlet of the evaporator 95 is configured to communicate with the master gas outlet of the expansion assembly 4; and an outlet of the evaporator is configured to communicate with the compression assembly (the gas inlet of the first-stage compression structure).

In some embodiments, when the compressor 1 includes the gas supplement passage 5, the refrigeration cycle device further includes the economizer 93. The inlet of the economizer 93 is in communication with the master gas outlet of the expansion assembly. The economizer 93 is provided with a first outlet and a second outlet. The first outlet is in communication with the inlet of the evaporator 95 and is configured to transport the liquid refrigerant to the evaporator 95; the second outlet is in communication with the gas supplement passage 5 and is configured to supplement gaseous refrigerant emitted through flash evaporation into the compressor 1 through the gas supplement passage 5. In some embodiments, the economizer 93 functions to emit an intermediate-pressure gaseous refrigerant through the flash evaporation.

In some embodiments, the pipeline connecting the economizer 93 and the evaporator 95 is further provided with an expansion mechanism 94 for reducing power of operation of the refrigerant. In some embodiments, the expansion mechanism 94 mainly includes an expansion valve, an expander, a throttle valve, and the like.

In some embodiments, the cooling modes of the first cooler 90 and the second cooler 91 are capable of being air cooling or water cooling.

Figure 12:
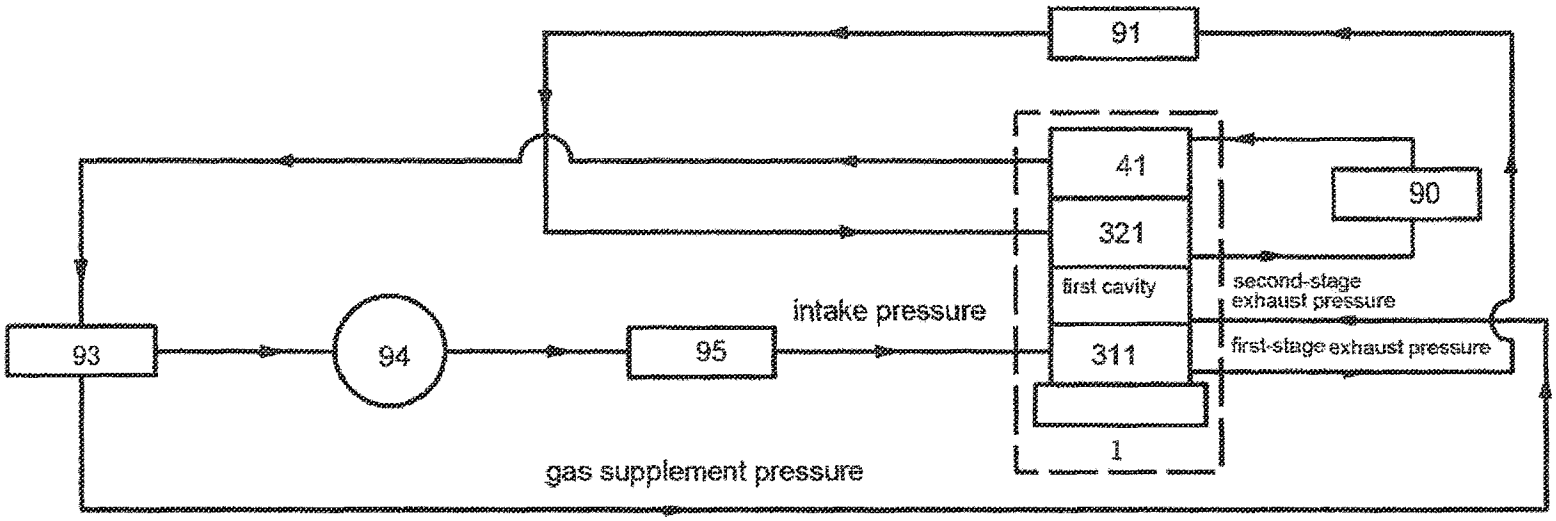
FIG. 12 is a simplified structure diagram of the refrigeration cycle device shown in FIG. 1.

The working principle of the refrigeration cycle device shown in FIGS. 1 and 12 is as follows. After the terminal 111 is energized, a magnetic pull force is generated between the motor stator 21 and the motor rotor 22, and drives the crankshaft 23 mounted in the middle of the motor rotor 22 to rotate at a high speed. The crankshaft 23 has three eccentric portions; the first-stage roller 312, the second-stage roller 322, and the first roller 42 are respectively mounted on the three eccentric portions; and the first-stage roller 312, the second-stage roller 322, and the first roller 42 respectively rotate in the first-stage cylinder 17, the second-stage cylinder 20, and the first expansion cylinder 24. After inhaling the low-temperature and low-pressure refrigerant from the evaporator 95, the first-stage cylinder 311 discharges the refrigerant processed under the first-stage compression into the first-stage cavity 310 formed by the lower cover plate 14 and the lower flange 15, and the intermediate-pressure refrigerant emitted from the economizer 95 through the flash evaporation passes through the gas supplement passage 5, and enters the first-stage cavity 310 at the same time to mix with the refrigerant compressed through the first-stage compression and then pass through the middle circulation passages of the first-stage cylinder 311, the lower partition plate 16, the second-stage cylinder 321, and the middle partition plate 17, the upper partition plate 18, the first expansion cylinder 41, the exhaust cavity 10, and the upper flange 19, to enter the inner cavity of the housing of the compressor. The pressure inside the housing is the first-stage exhaust pressure, and the motor stator and motor rotor are cooled, while the oil baffle plate 7 separates the oil and gas from the refrigerant. The separated refrigerant passes through the exhaust pipeline 8 to the second cooler 91 for cooling, and then passes through the second gas inlet 324 on the second-stage cylinder 321 to enter the second-stage cylinder 321 for compression; the refrigerant compressed through the second-stage compression enters the first gas cooler 90 for heat release through the master gas outlet 324 of the second-stage compression structure; and then the refrigerant after the heat release enters the first expansion cylinder 41 for refrigerant expansion through the gas inlet 411 of the first expansion cylinder 41, and forms a low-pressure two-phase refrigerant in the first expansion cylinder 41, and finally passes through the master gas outlet 43 of the expansion assembly 43 to enter the economizer 93. Part of the refrigerant forms an intermediate-pressure gaseous refrigerant through the flash evaporation and is injected into the compressor 1 through the gas supplement passage 5. The remaining liquid refrigerant is depressurized by the expansion mechanism 94 and enters the evaporator 95 to absorb heat to form a gaseous refrigerant, and finally enters the compressor, thereby forming a refrigeration cycle.

Figure 13:
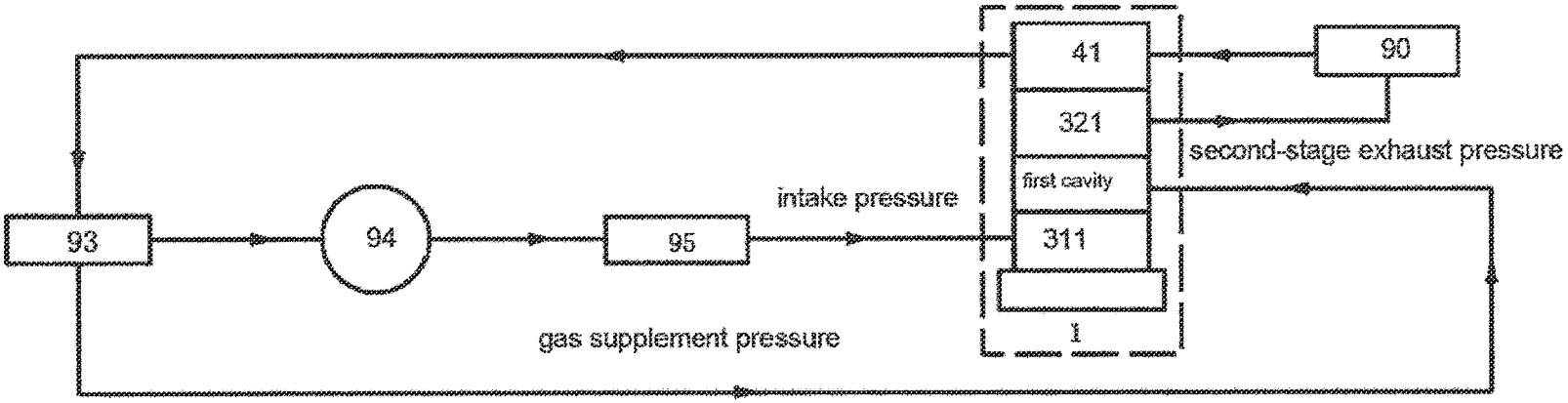
FIG. 13 is a simplified structure diagram of a second type of refrigeration cycle device according to some embodiments of the present disclosure.

The refrigeration cycle device shown in FIG. 13 (corresponding to the compressor shown in FIGS. 8 and 9) differs from the refrigeration cycle device in FIGS. 1 and 12 in that the second cooler is not provided, and the first-stage refrigerant does not enter the inner cavity of the housing of the compressor, but directly enters the second-stage cylinder 321 for the second-stage compression, so there is no refrigeration cycle of intercooling after the first-stage compression.

Figure 14:
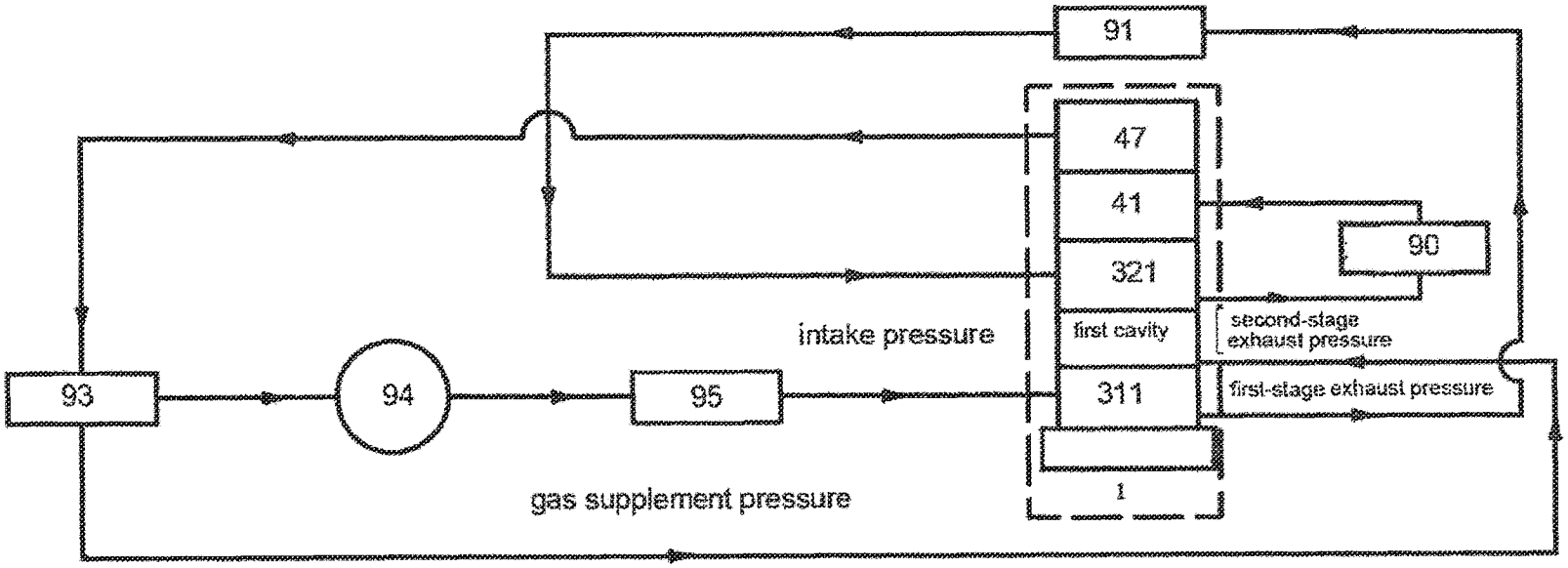
FIG. 14 is a simplified structure diagram of a third type of refrigeration cycle device according to some embodiments of the present disclosure.

For the refrigeration cycle device shown in FIG. 14, which differs from the refrigeration cycle device shown in FIGS. 1 and 12 in that the expansion assembly is a two-cylinder expansion unit; after being compressed by the second-stage compression structure, the refrigerant enters the first expansion cylinder for expansion and then enters the second expansion cylinder for expansion.

Figure 15:
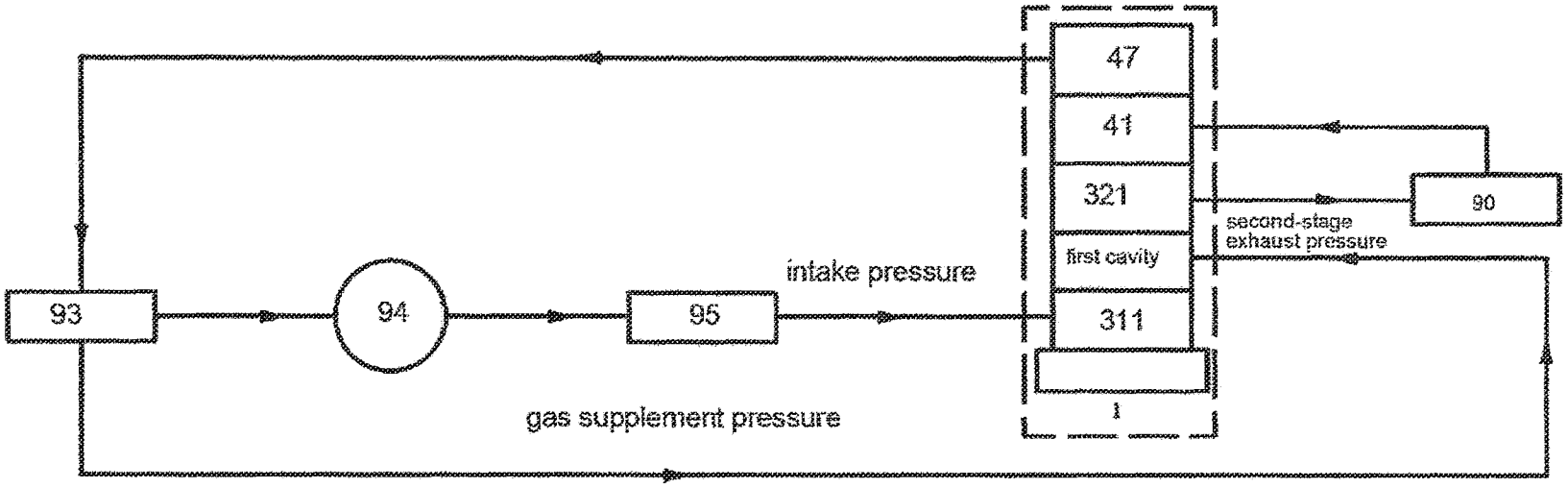
FIG. 15 is a simplified structure diagram of a fourth type of refrigeration cycle device according to some embodiments of the present disclosure.

For the refrigeration cycle device shown in FIG. 15, which differs from FIG. 14 in that the second cooler is not provided, and the first-stage refrigerant does not enter the inner cavity of the housing of the compressor, but directly enters the second-stage cylinder 321 for the second-stage compression. Therefore, there is no refrigeration cycle of intercooling after the first-stage compression.

Figure 16:
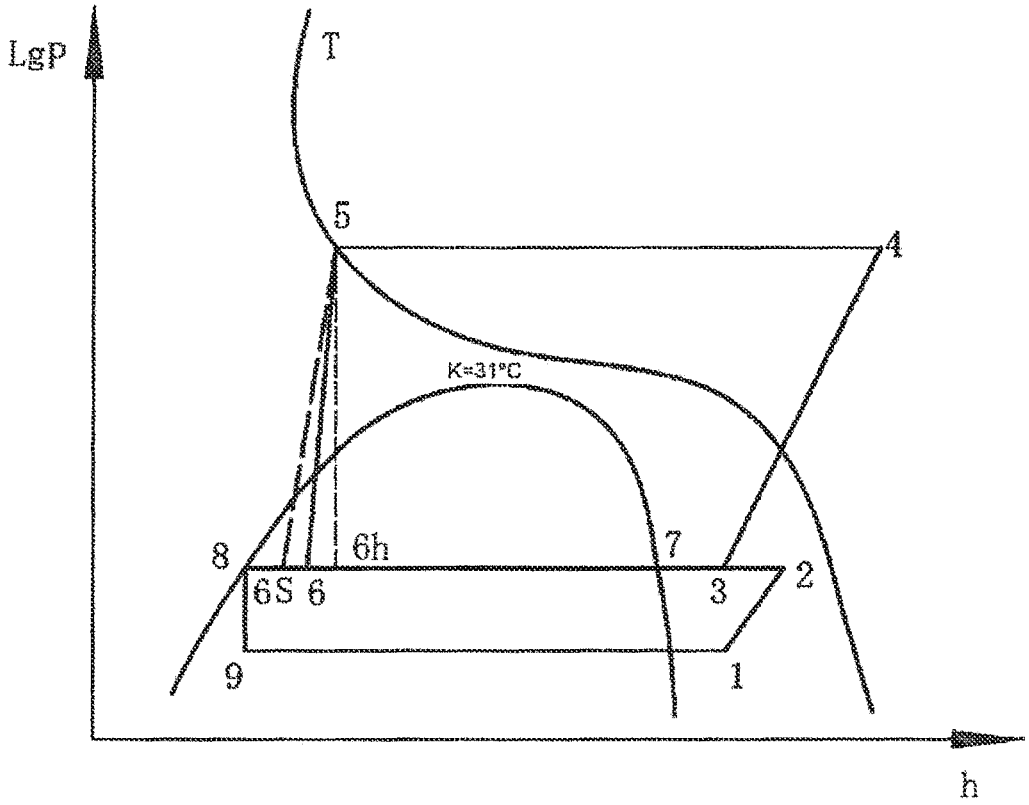
FIG. 16 is a pressure-enthalpy diagram of a refrigeration cycle device according to some embodiments of the present disclosure.

In addition, referring to FIG. 16, which is a pressure-enthalpy diagram of the refrigeration system provided by some embodiments of the present disclosure. Where "5-6h" means an isenthalpic expansion (implemented by a throttle valve); "5-6S" means an isentropic expansion (which is an ideal condition, but is practically difficult to implement); "5-6" means an actual expansion process of an expander; an enthalpy difference "5-6h" means expansion energy recovery per unit mass of refrigerant.

With reference to FIGS. 17 and 18, in the embodiment, which is substantially the same as FIG. 1, except that, in the embodiment, a compressor with variable-volume function is used in the refrigeration cycle device to enable the refrigeration cycle device to change the volume as needed during the working process. Specifically, a variable-volume first-stage compression structure is adopted, such that the first-stage cylinder 311 becomes a variable-volume cylinder, thereby forming a refrigeration cycle device of "two-stage+enthalpy increase+expansion+volume change of the first-stage cylinder".

In the embodiment, the economizer is a flash evaporator, and the refrigeration cycle device further includes an adjustment pipeline 96. One end of the adjustment pipeline 96 is connected to the expansion assembly, and the other end of the adjustment pipeline 96 is connected to the inlet of the flash evaporator. An expansion valve 97 is provided on the adjustment pipeline 96. The expansion valve 97 functions to control the amount of supplemented gas by adjusting the opening of the valve, so as to making the amount of gaseous refrigerant in the flash evaporator more reasonable and improve the applicability of the flash evaporator.

In the embodiment, the first pipeline 541 of the variable-volume assembly 50 is connected between the second-stage gas outlet of the compressor and the first pin hole 332 at the top end of the first pin 51; and one end of the second pipeline 542 is connected to the first guide groove 52 at the bottom portion of the first pin 51, the other end is respectively connected to two branches; one end of the first branch 547 is connected to the second pipeline 542, and the other end is connected to the second outlet of the economizer 93, that is, in communication with the gas supplement pipeline, a first control valve 37 is provided on the first branch 547, one end of the second branch 548 is connected to the second pipeline 542, and the other end is connected to the second-stage gas outlet of the compressor, a second control valve 38 is provided on the second branch 548. The above-mentioned first control valve 37 and second control valve 38 may be both solenoid valves.

The above-mentioned pipeline structure can also adopt a form in which the end portion of the second pipeline 542 is respectively connected to the first branch 547 and the second branch 548 through a three-way valve. In such a way, two control valves can be saved, and the difficulty of control can be reduced.

After the compressor 1 starts up and operates, the first-stage cylinder 311 draws a low-temperature and low-pressure refrigerant produced in the evaporator 95; after the first-stage compression, the low-temperature and low-pressure refrigerant mixes with the intermediate-temperature and intermediate-pressure refrigerant injected into the compressor 1 by the flash evaporator and then enters the interior of the housing of the compressor 1; after cooling the motor, the mixed refrigerant enters the second cooler 91 of the system for cooling and heat release, and then enters the second-stage cylinder 321 for the second-stage compression; and the refrigerant compressed through the second-stage compression enters the first cooler 90 of the system to release heat, and then enters the first expansion cylinder 41 to recover part of the compression work, and then enters the flash evaporator, where part of the refrigerant emits an intermediate-pressure gaseous refrigerant through the flash evaporation and the intermediate-pressure gaseous refrigerant is injected into the compressor, while the remaining liquid refrigerant enters the evaporator 95 to absorb the heat to form a gaseous refrigerant, and finally enters the compressor for the first-stage compression, thereby forming a refrigeration cycle. Part of the high-temperature and high-pressure refrigerant discharged after the second-stage compression is introduced into the tail end of the first pin 41 of the first-stage cylinder 311; and a part is introduced into the top end of the first sliding vane 331 of the first-stage cylinder 311; the intermediate-temperature and intermediate-pressure refrigerant formed after the flash evaporation in the flash evaporator is also introduced into the tail end of the first pin 41; and the high-pressure refrigerant and intermediate-pressure refrigerant are in communication with or in non-communication with the tail end of the first pin 41 of the first-stage cylinder 311 through the opening and closing of the first control valve 37 and the second control valve 38, so as to implement the loading and unloading of the first-stage cylinder 311, and realize the variable-volume mode of the compressor.

With reference to FIG. 19, for the refrigeration cycle device using the compressor of the embodiment, the variable volume control process is as follows.

A first pin 51 and a first sliding vane 331 are provided in the lower flange 15 of the compressor 1. The tail portion of the first pin 51 is in communication with a second-stage exhaust pipe and an intermediate pressure pipe of the system; meanwhile the head portion of the first pin 51 is in communication with the second-stage exhaust pipe of the system, accordingly there is a continuous high pressure on the head portion of the first pin 51; a second control valve 38 is provided on the second-stage exhaust pipe, and a first control valve 37 is provided on the intermediate pressure pipe; when the first control valve 37 is opened while the second control valve 38 is closed, the tail portion of the first pin 51 is exposed to the high pressure. Since the pressure balance between the upper and lower ends of the first pin 51, the first pin 51 moves up and is stuck at the lower portion of the first sliding vane 331 under the force of the elastic member 53; this moment, the first sliding vane 331 is stuck and cannot reciprocate; thus, the first-stage cylinder 311 does not form a first-stage compression process, which is similar to an idle operation; When the control valve 37 is closed while the second control valve 38 is opened, the intermediate-pressure refrigerant flows into the tail portion of the first pin 51; since the top portion of the first pin 51 is continuously at a high pressure, the first pin 51 falls off the first sliding vane 331 under the force of the pressure difference, the first sliding vane 331 is capable of reciprocating in the first-stage cylinder 311 so as to contact the first-stage roller 312 to form a first-stage compression process. Accordingly, the variable-volume mode of the compressor is formed through the switching of the above process.

For the sixth type of refrigeration cycle device shown in FIG. 30, which is substantially the same as FIG. 17, except that the variable-volume cylinder in the embodiment is a second-stage cylinder.

For the seventh type of refrigeration cycle device shown in FIG. 32, which is substantially the same as FIG. 17, except that the variable-volume cylinder in the embodiment is an expansion cylinder.

For the eighth type of refrigeration cycle device shown in FIG. 34, which is substantially the same as FIG. 17, except that both the second-stage cylinder and the expansion cylinder in the embodiment are variable-volume cylinders.

For the ninth type of refrigeration cycle device shown in FIG. 36, which is substantially the same as FIG. 17, except that both the first-stage cylinder and the expansion cylinder in the embodiment are variable-volume cylinders.

For the tenth type of refrigeration cycle device shown in FIGS. 37 and 38, which is substantially the same as FIG. 17, except that the pressure at the tail end of the first pin 51 is switched between the intake pressure and the second-stage exhaust pressure in the embodiment.

For the eleventh type of refrigeration cycle device shown in FIG. 39, which is substantially the same as FIG. 17, except that the first pin 511 is omitted in the embodiment, so that loading or unloading of the first-stage cylinder 311 is not implemented by controlling the first pin 51, but implemented by directly changing a pressure comparison between the two ends of the first sliding vane 331.

In conclusion, the compressor and refrigeration cycle device provided by the embodiments of the present disclosure are in a form of a two-stage compression with inter-stage gas supplement and enthalpy structure. Compared to a single-stage compression, the pressure difference of each stage can be reduced, the leakage can be reduced, and the volumetric efficiency and cooling capacity of the compressor can be improved; at the same time, the expansion work is recovered through the expansion assembly, the power consumption of the compressor is reduced, and performance coefficients of the compressor and the circulation system are improved; and a performance coefficient of the transcritical refrigeration cycle device can be greatly improved.

The above are merely some embodiments of the present disclosure, and are not intended to limit the present disclosure in any form. Any simple variations, equivalent changes, and modifications made to the above embodiments based on the technical essence of the present disclosure still within the scope of the technical solution of the present disclosure.

What is claimed is:

1. A compressor, comprising:

a housing;

a drive assembly, provided in the housing;

a compression assembly, provided in the housing, and connected to and driven by the drive assembly, wherein the compression assembly is configured to perform a multi-stage compression on a refrigerant under drive of the drive assembly an expansion assembly, provided in the housing and connected to the drive assembly, wherein the expansion assembly is configured to expand the refrigerant compressed by the compression assembly;

a variable-volume assembly, the variable-volume assembly being configured to control loading or unloading of at least one of the compression assembly and the expansion assembly;

wherein the compression assembly comprises:

a first-stage compression structure, configured to perform a first-stage compression on a refrigerant discharged from an evaporator;

a second-stage compression structure, configured to perform a second-stage compression on a first-stage refrigerant, wherein the first-stage refrigerant comprises the refrigerant compressed through the first-stage compression of the first-stage compression structure;

wherein the variable-volume assembly is configured to control loading or unloading of the second-stage compression structure;

the second-stage compression structure comprises:

a second-stage cylinder, provided with a second gas inlet and a second gas outlet, wherein the second gas inlet draws the first-stage refrigerant into the second-stage cylinder;

a second-stage roller, arranged in the second-stage cylinder and configured to cooperate with the second-stage cylinder to perform the second-stage compression on the first-stage refrigerant under drive of the drive assembly;

a second-stage cavity, being in communication with the second gas outlet to discharge the refrigerant compressed through the second-stage compression into the second-stage cavity;

wherein a second sliding groove is provided in the second-stage cylinder, a second sliding vane is slidably provided in the second sliding groove, the variable-volume assembly controls loading or unloading of the second-stage compression structure by controlling a working state of the second sliding vane.

2. The compressor according to claim 1, further comprising a first cooler; wherein the refrigerant compressed by the compression assembly is cooled by the first cooler before being expanded by the expansion assembly.

3. The compressor according to claim 1, wherein the compression assembly comprises:

a first-stage compression structure, configured to perform a first-stage compression on a refrigerant discharged from an evaporator;

a second-stage compression structure, configured to perform a second-stage compression on a first-stage refrigerant, wherein the first-stage refrigerant comprises the refrigerant compressed through the first-stage compression of the first-stage compression structure;

wherein the compressor further comprises a gas supplement passage configured to supplement a gaseous refrigerant into the compressor;

the first-stage refrigerant further comprises the refrigerant supplemented by the gas supplement passage;

wherein the compressor further comprises a second cooler; the first-stage refrigerant is cooled by the second cooler before being compressed through the second-stage compression of the second-stage compression structure.

4. The compressor according to claim 3, wherein the first-stage compression structure comprises:

a first-stage cylinder, provided with a first gas inlet and a first gas outlet, wherein the first gas inlet is configured to communicate with an outlet of the evaporator;

a first-stage roller, arranged in the first-stage cylinder and configured to cooperate with the first-stage cylinder to perform the first-stage compression on refrigerant under drive of the drive assembly;

a first-stage cavity, being in communication with the first gas outlet to discharge the refrigerant compressed through the first-stage compression into the first-stage cavity;

wherein the second-stage compression structure comprises:

a second-stage cylinder, provided with a second gas inlet and a second gas outlet, wherein the second gas inlet draws the first-stage refrigerant into the second-stage cylinder;

a second-stage roller, arranged in the second-stage cylinder and configured to cooperate with the second-stage cylinder to perform the second-stage compression on the first-stage refrigerant under drive of the drive assembly;

a second-stage cavity, being in communication with the second gas outlet to discharge the refrigerant compressed through the second-stage compression into the second-stage cavity;

wherein a ratio of a volume of the first-stage cylinder to a volume of the second-stage cylinder is in a range of 0.5 to 1.35;

wherein an exhaust pipeline is provided on the housing, and the exhaust pipeline is in communication with an inner cavity of the housing; wherein, when the compressor comprises a second cooler, the first-stage cavity is in communication with the inner cavity of the housing, and the exhaust pipeline is configured to communicate with an inlet of the second cooler, an outlet of the second cooler is in communication with the second gas inlet on the second-stage cylinder; or the first-stage cavity is in communication with the second gas inlet on the second-stage cylinder, the second-stage cavity is in communication with the inner cavity of the housing, and the exhaust pipeline is configured to communicate with an inlet of the first cooler.

5. The compressor according to claim 1, wherein the expansion assembly comprises:

a first expansion cylinder, provided with a third gas inlet and a third gas outlet;

a first roller, arranged in the first expansion cylinder;

wherein the third gas inlet is configured to draw the refrigerant compressed through the multi-stage compression of the compression assembly into the first expansion cylinder; the first roller is configured to expand the refrigerant drawn into the first expansion cylinder under drive of the drive assembly; the expanded refrigerant is discharged from the third gas outlet;

wherein, when the compressor is connected to the first cooler, the third gas inlet is connected to an outlet of the first cooler;

wherein the expansion assembly further comprises a first cavity, wherein the first cavity is in communication with the third gas outlet, and the first cavity is provided with a fourth gas outlet to discharge the refrigerant expanded by the expansion assembly to a heat exchange component connected to the compressor;

wherein a ratio of an intake volume to an expansion volume of the first expansion cylinder is in a range of 2.0 to 5.55;

wherein the expansion assembly further comprises:

a second expansion cylinder, provided with a fourth gas inlet and a fifth gas outlet, wherein the fourth gas inlet is in communication with the third gas outlet;

a second roller, arranged in the second expansion cylinder, and connected to and driven by the drive assembly.

6. The compressor according to claim 1, wherein the drive assembly comprises a crankshaft and a drive structure configured to drive the crankshaft to operate; the drive structure comprises a motor stator and a motor rotor; wherein the compression assembly and the expansion assembly sleeve the crankshaft;

wherein, when an exhaust pipeline is provided on the housing, the refrigerant in a cavity of the housing passes through the drive structure before being drawn into the exhaust pipeline to cool the drive structure;

wherein an oil baffle plate is mounted on the crankshaft at a position higher than the drive structure and is configured to separate refrigerant oil from the refrigerant; and/or the expansion assembly is located above the drive structure; or the expansion assembly is located below the drive structure.

7. The compressor according to claim 1, wherein the variable-volume assembly comprises a second pin, a second mounting plate is provided on a side of the second-stage cylinder, a second guide groove is provided on the second mounting plate, the second pin is slidably provided in the second guide groove, a second pin hole is provided on a side of the second sliding vane facing the second mounting plate, and the second pin is capable of being switched between a first position at which the second pin is stuck into the second pin hole and a second position at which the second pin is out of the second pin hole;

the second pin hole is in communication with a side of the second sliding groove away from the second-stage roller, the second sliding groove is supplied with the refrigerant with the first pressure, a side of the second guide groove away from the second pin hole is supplied with the refrigerant with the second pressure, the first pressure and the second pressure are adjustable to enable the second pin to be switched between the first position and the second position;

wherein the first mounting plate is located on an upper side of the first-stage cylinder, the first pressure is a second-stage exhaust pressure, the second pressure is capable of being switched among the second-stage exhaust pressure, an intake pressure and an intermediate pressure; or, the first pressure is the intermediate pressure, the second pressure is capable of being switched among the second-stage exhaust pressure, the intermediate pressure and the intake pressure.

8. The compressor according to claim 7, wherein the variable-volume assembly comprises an elastic member, the elastic member is provided at an end of the second guide groove away from the second pin hole, the second pin is in contact with the elastic member, and the elastic member provides the second pin with an elastic force moving the second pin towards the second pin hole;

wherein the first pressure is a second-stage exhaust pressure, the second pressure is capable of being switched among the second-stage exhaust pressure, an intake pressure and an intermediate pressure; or, the first pressure is an intermediate pressure, the second pressure is capable of being switched among a second-stage exhaust pressure, the intermediate pressure and an intake pressure;

wherein the compressor further comprises a crankshaft, wherein the crankshaft comprises a center oil hole, one end of the crankshaft away from the drive assembly is provided with an oil suction assembly, and the oil suction assembly is configured to transport oil in the housing to the center oil hole;

wherein the oil suction assembly comprises a sealing housing and an oil suction pipe in communication with a cavity of the sealing housing, and the sealing housing is provided at and seals a first end of the crankshaft, and the oil suction pipe extends downward;

wherein the compressor further comprises an upper flange, wherein a side of the upper flange facing the drive assembly is provided with a pressure separation plate, and a refrigerant passage is provided on the pressure separation plate.

9. The compressor according to claim 8, wherein the compressor further comprises a gas supplement inlet, the variable-volume assembly further comprises a third pipeline and a fourth pipeline, a first end of the third pipeline is in communication with the second gas outlet, a second end of the third pipeline is in communication with a side of the second sliding groove away from the second-stage roller, a first end of the fourth pipeline is selectively in communication with at least one of the first gas inlet and the gas supplement inlet as well as the second gas outlet, a second end of the fourth pipeline is in communication with a side of the second guide groove away from the second pin hole;

or, the first end of the third pipeline is in communication with the gas supplement inlet, the second end of the third pipeline is in communication with the side of the second sliding groove away from the second-stage roller, the first end of the fourth pipeline is selectively in communication with at least one of the gas supplement inlet and the second gas outlet as well as the first gas inlet, the second end of the fourth pipeline is in communication with the side of the second guide groove away from the second pin hole;

wherein a one-way valve is provided on a pipeline between the variable-volume assembly and the first gas inlet.

10. The compressor according to claim 8, wherein a second end of the crankshaft is provided with a fan, and the fan is configured to generate a negative pressure on the center oil hole.

11. The compressor according to claim 7, wherein the expansion assembly, the second-stage compression structure and the first-stage compression structure are sequentially provided in an axial direction away from the drive assembly, and a lower flange is provided on a side of the first-stage compression structure away from the drive assembly, and the lower flange is the first mounting plate.

12. The compressor according to claim 7, wherein the expansion assembly, the second-stage compression structure and the first-stage compression structure are sequentially provided in the axial direction away from the drive assembly;

a lower partition plate is provided on a side of the second-stage compression structure away from the drive assembly, and the lower partition plate is the second mounting plate.

13. The compressor according to claim 7, wherein the first-stage compression structure, the expansion assembly and the second-stage compression structure are sequentially provided in an axial direction away from the drive assembly;

or the first-stage compression structure, the second-stage compression structure and the expansion assembly are sequentially provided in the axial direction away from the drive assembly, an upper partition plate is provided on a side of the first-stage compression structure away from the drive assembly, and the upper partition plate is the first mounting plate;

or, the second-stage compression structure, the expansion assembly, and the first-stage compression structure are sequentially provided in the axial direction away from the drive assembly; or, the second-stage compression structure, the first-stage compression structure and the expansion assembly are sequentially provided in the axial direction away from the drive assembly, an upper partition plate is provided on a side of the second-stage compression structure away from the drive assembly, and the upper partition plate is the second mounting plate;

wherein a middle partition plate is provided on a side of the upper partition plate away from the first-stage compression structure, and the middle partition plate is provided with a mounting groove corresponding to the first pin hole;

or, a middle partition plate is provided on a side of the upper partition plate away from the second-stage compression structure, and the middle partition plate is provided with a mounting groove corresponding to the second pin hole.

14. The compressor according to claim 1, wherein the variable-volume assembly is configured to control loading or unloading of the expansion assembly;

wherein the expansion assembly comprises:

a first expansion cylinder, provided with a third gas inlet and a third gas outlet;

a first roller, arranged in the first expansion cylinder;

wherein the third gas inlet is configured to draw the refrigerant compressed through the multi-stage compression of the compression assembly into the first expansion cylinder; the first roller is configured to expand the refrigerant drawn into the first expansion cylinder under drive of the drive assembly; the expanded refrigerant is discharged from the third gas outlet;

when the compressor is connected to the first cooler, the third gas inlet is connected to the outlet of the first cooler, and the variable-volume assembly controls loading or unloading of the expansion assembly by controlling a working state of the first roller;

wherein the variable-volume assembly further comprises a third pin, a third mounting plate is provided on a side of the first roller, the third mounting plate is provided with a third guide groove, the third pin is slidably provided in the third guide groove, a third pin hole is provided on a side of the first roller facing the third mounting plate, the third pin is capable of being switched between a first position at which the third pin is stuck into the third pin hole and a second position at which the third pin is out of the third pin hole;

wherein the third pin hole is supplied with a refrigerant with a first pressure, a side of the third guide groove away from the third pin hole is supplied with a refrigerant with a second pressure, the first pressure and the second pressure are adjustable to enable the third pin to be switched between the first position and the second position;

wherein the variable-volume assembly further comprises an elastic member, the elastic member is provided at one end of the third guide groove away from the third pin hole, the third pin is in contact with the elastic member, and the elastic member provides the third pin with an elastic force moving the third pin towards the third pin hole;

wherein the first pressure is a second-stage exhaust pressure, the second pressure is capable of being switched among the second-stage exhaust pressure, an intake pressure and an intermediate pressure; or, the first pressure is an intermediate pressure, the second pressure is capable of being switched among a second-stage exhaust pressure, the intermediate pressure and an intake pressure;

wherein the expansion assembly, the second-stage compression structure, and the first-stage compression structure are sequentially provided in an axial direction away from the drive assembly.

15. The compressor according to claim 14, wherein the second-stage compression structure, the first-stage compression structure and the expansion assembly are sequentially provided in an axial direction away from the drive assembly; or the first-stage compression structure, the second-stage compression structure and the expansion assembly are sequentially provided in the axial direction away from the drive assembly, a lower flange is provided on a side of the expansion assembly away from the drive assembly, and the lower flange is the third mounting plate;

wherein a lower cover plate is provided on a side of the lower flange away from the expansion assembly, and the lower cover plate is provided with a mounting groove corresponding to the third pin hole.

16. The compressor according to claim 14, further comprising a gas return inlet and a gas supplement inlet, wherein the variable-volume assembly further comprises a fifth pipeline and a sixth pipeline, a first end of the fifth pipeline is in communication with the gas outlet of the second-stage compression mechanism, a second end of the fifth pipeline is in communication with the third pin hole, a first end of the sixth pipeline is selectively in communication with at least one of the gas return inlet and the gas supplement inlet as well as the gas outlet of the second-stage compression mechanism, a second end of the sixth pipeline is in communication with a side of the third guide groove away from the third pin hole;

or, the first end of the fifth pipeline is in communication with the gas supplement inlet, the second end of the fifth pipeline is in communication with the third pin hole, the first end of the sixth pipeline is selectively in communication with at least one of the gas supplement inlet and the gas outlet of the second-stage compression mechanism as well as the gas return inlet, and the second end of the sixth pipeline is in communication with the side of the third guide groove away from the third pin hole.

17. The compressor according to claim 1, wherein the variable-volume assembly is configured to supply a refrigerant with a first pressure to a side of the first sliding groove away from the first-stage roller, and the first pressure is an intake pressure or a second-stage exhaust pressure;

wherein the compressor further comprises a gas supplement inlet, wherein the variable-volume assembly further comprises a first pipeline, a first end of the first pipeline is selectively in communication with at least one of the gas supplement inlet and the gas outlet of the second-stage compression structure as well as the first gas inlet, a second end of the first pipeline is in communication with the side of the first sliding groove away from the first-stage roller.

18. A refrigeration cycle device, comprising the compressor according to claim 1.

19. The refrigeration cycle device according to claim 18, further comprising:

an evaporator, an inlet of the evaporator being configured to communicate with the expansion assembly, and an outlet of the evaporator being configured to communicate with the compression assembly;

wherein when the compressor comprises a gas supplement passage, the refrigeration cycle device further comprises an economizer; wherein, an inlet of the economizer is in communication with the expansion assembly;

the economizer is provided with a first outlet and a second outlet, the first outlet is in communication with the inlet of the evaporator and is configured to transport a liquid refrigerant to the evaporator; the second outlet is in communication with the gas supplement passage and is configured to supplement a gaseous refrigerant emitted through flash evaporation into the compressor through the gas supplement passage;

wherein an expansion mechanism is further provided on a pipeline connected between the economizer and the evaporator, and is configured to reduce power of operation of the refrigerant;

wherein the economizer is a flash evaporator, the refrigeration cycle device further comprises an adjustment pipeline, one end of the adjustment pipeline is connected to the expansion assembly, the other end of the adjustment pipeline is connected to an inlet of the flash evaporator, and an expansion valve is provided on the adjustment pipeline.

* * * * *